United States Patent [19]

Saitoh et al.

[11] Patent Number: 4,592,981

[45] Date of Patent: Jun. 3, 1986

[54] PHOTOCONDUCTIVE MEMBER OF AMORPHOUS GERMANIUM AND SILICON WITH CARBON

[75] Inventors: Keishi Saitoh, Ibaraki; Yukihiko Ohnuki, Kawasaki; Shigeru Ohno, Yokohama, all of Japan

[73] Assignee: Canon Kabushiki Kaisha, Tokyo, Japan

[21] Appl. No.: 649,850

[22] Filed: Sep. 12, 1984

[30] Foreign Application Priority Data

| | | | |
|---|---|---|---|
| Sep. 13, 1983 | [JP] | Japan | 58-170383 |
| Sep. 17, 1983 | [JP] | Japan | 58-172032 |
| Dec. 28, 1983 | [JP] | Japan | 58-245307 |
| Dec. 28, 1983 | [JP] | Japan | 58-245311 |
| Dec. 29, 1983 | [JP] | Japan | 58-247252 |
| Dec. 29, 1983 | [JP] | Japan | 58-247256 |

[51] Int. Cl.[4] ..... G03G 5/082

[52] U.S. Cl. ..... 430/57; 430/69; 430/84; 430/95

[58] Field of Search ..... 430/69, 57, 60, 95, 430/84

[56] References Cited

U.S. PATENT DOCUMENTS

| | | | |
|---|---|---|---|
| 4,465,750 | 8/1984 | Ogawa et al. | 430/95 |
| 4,491,626 | 1/1985 | Kawamura et al. | 430/69 |

*Primary Examiner*—John L. Goodrow

*Attorney, Agent, or Firm*—Fitzpatrick, Cella, Harper & Scinto

[57] ABSTRACT

A photoconductive member comprises a substrate for photoconductive member and a light receiving layer having photoconductivity comprising an amorphous material containing silicon atoms and germanium atoms, said light receiving layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

88 Claims, 32 Drawing Figures

PHOTOCONDUCTIVE MEMBER OF AMORPHOUS GERMANIUM AND SILICON WITH CARBON

BACKGROUND OF THE INVENTION

1. Field of the Invention

This invention relates to a photoconductive member having sensitivity to electromagnetic waves such as light (herein used in a broad sense, including ultraviolet rays, visible light, infrared rays, X-rays, gamma-rays, and the like).

2. Description of the Prior Art

Photoconductive materials, which constitute photoconductive layers in solid state image pickup devices, image forming members for electrophotography in the field of image formation, or manuscript reading devices and the like, are required to have a high sensitivity, a high SN ratio [photocurrent ($I_p$)/dark current ($I_d$)], spectral characteristics matching to those of electromagnetic waves to be irradiated, a rapid response to light, a desired dark resistance value as well as no harm to human bodies during usage. Further, in a solid state image pick-up device, it is also required that the residual image should easily be treated within a predetermined time. Particularly, in case of an image forming member for electrophotography to be assembled in an electrophotographic device to be used in an office as office apparatus, the aforesaid harmless characteristic is very important.

From the standpoint as mentioned above, amorphous silicon (hereinafter referred to as a-Si) has recently attracted attention as a photoconductive material. For example, German OLS Nos. 2746967 and 2855718 disclose applications of a-Si for use in image forming members for electrophotography, and German OLS No. 2933411 discloses an application of a-Si for use in a photoelectric transducing reading device.

However, under the present situation the photoconductive members of the prior art having photoconductive layers constituted of a-Si are further required to be improved in a balance of overall characteristics including electrical, optical and photoconductive characteristics such as dark resistance value, photosensitivity and response to light, etc., and environmental characteristics during use such as humidity resistance, and further stability with the lapse of time.

For instance, when the above photoconductive member is applied in an image forming member for electrophotography, residual potential is frequently observed to remain during use thereof if improvements to higher photosensitivity and higher dark resistance are scheduled to be effected at the same time. When such a photoconductive member is repeatedly used for a long time, there will be caused various inconveniences such as accumulation of fatigues by repeated uses or so called ghost phenomenon wherein residual images are formed, or response characteristic will gradually be lowered when used at high speed repeatedly.

Further, a-Si has a relatively smaller coefficient of absorption of the light on the longer wavelength side in the visible light region as compared with that on the shorter wavelength side. Accordingly, in matching to the semiconductor laser practically applied at the present time, the light on the longer wavelength side cannot effectively be utilized, when employing a halogen lamp or a fluorescent lamp as the light source. Thus, various points remain to be improved.

On the other hand, when the light irradiated is not sufficiently absorbed in the photoconductive layer, but the amount of the light reaching the substrate is increased, interference due to multiple reflection may occur in the photoconductive layer to become a cause for "unfocused" image, in the case when the substrate itself has a high reflectance against the light transmitted through the photoconductive layer.

This effect will be increased, if the irradiated spot is made smaller for the purpose of enhancing resolution, thus posing a great problem in the case of using a semiconductor laser as the light source.

Further, a-Si materials to be used for constituting the photoconductive layer may contain as constituent atoms hydrogen atoms or halogen atoms such as fluorine atoms, chlorine atoms, etc. for improving their electrical, photoconductive characteristics, boron atoms, phosphorus atoms, etc. for controlling the electroconduction type as well as other atoms for improving other characteristics. Depending on the manner in which these constituent atoms are contained, there may sometimes be caused problems with respect to electrical or photoconductive characteristics of the layer formed.

That is, for example, in many cases, the life of the photocarriers generated by light irradiation in the photoconductive layer formed is insufficient, or at the dark portion, the charges injected from the substrate side cannot sufficiently be impeded.

Further, when the layer thickness is as thick as ten and some microns or higher, there tend to occur such phenomena as loosening or peeling of layers off from the substrate surface or formation of cracks in the layers with lapse of time when left to stand in air after taking out from a vacuum deposition chamber for layer formation. These phenomenon will occur particularly frequently when the substrate is a drum-shaped substrate conventionally employed in the field of electrophotography. Thus, there are problems to be solved with respect to stability with lapse of time.

Accordingly, while attempting to improve the characteristics of a-Si material per se on one hand, it is also required to make efforts to overcome all the problems as mentioned above in designing of the photoconductive member on the other hand.

In view of the above points, the present invention contemplates the achievement obtained as a result of extensive studies made comprehensively from the standpoints of applicability and utility of a-Si as a photoconductive member for image forming members for electrophotography, solid state image pick-up devices, reading devices, etc. It has now been found that a photoconductive member having a layer constitution comprising a light receiving layer exhibiting photoconductivity, which comprises an amorphous material containing at least one of hydrogen atom (H) and halogen atom (X) in a matrix of silicon atoms (Si) and germanium atoms (Ge) such as so called hydrogenated amorphous silicon germanium, halogenated amorphous silicon germanium or halogen-containing hydrogenated amorphous silicon [hereinafter referred to comprehensively as a-SiGe(H,X)], said photoconductive member being prepared by designing so as to have a specific structure as hereinafter described, not only exhibits practically extremely excellent characteristics but also surpass the photoconductive members of the prior art in substantially all respects, especially having markedly excellent characterisitcs as a photoconductive member for electrophotography and also excellent absorption spectrum characteristics on the longer wavelength side.

SUMMARY OF THE INVENTION

A primary object of the present invention is to provide a photoconductive member having electrical, optical and photoconductive characteristics which are constantly stable and all-environment type with virtually no dependence on the environments under use, which member is markedly excellent in photosensitive characteristics on the longer wavelength side and light fatigue resistance, and also excellent in durability without causing deterioration phenomenon when used repeatedly, exhibiting no or substantially no residual potential observed.

Another object of the present invention is to provide a photoconductive member which is high in photosensitivity throughout the whole visible light region, particularly excellent in matching to a semiconductor laser and also rapid in response, to light.

Another object of the present invention is to provide a photoconductive member which is excellent in adhesion between a substrate and a layer provided on the substrate or between respective laminated layers, stable with closeness of structural arrangement and high in layer quality.

Still another object of the present invention is to provide a photoconductive member having sufficiently an ability to retain charges during charging treatment for formation of electrostatic images, when applied as a member for formation of an electrophotographic image and having excellent electrophotographic characteristics which is not substantially lowered even in a humid atmosphere, for which ordinary electrophotographic methods can very effectively be applied.

Further, still another object of the present invention is to provide a photoconductive member for electrophotography, which can easily provide an image of high quality which is high in density, clear in halftone, high in resolution and free from "unfocused" image.

Still another object of the present invention is to provide a photoconductive member having high photosensitivity and high SN ratio characteristic, and a good electrical contact with the substrate.

According to one aspect of the present invention, there is provided a photoconductive member comprising a substrate for photoconductive member and a light receiving layer having photoconductivity comprising an amorphous material containing silicon atoms and germanium atoms, said light receiving layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

According to another aspect of the present invention, there is provided a photoconductive member comprising a substrate for photoconductive member and a light receiving layer having a layer constitution in which a first layer region (G) comprising an amorphous material containing germanium atoms, optionally together with at least one of silicon atoms, hydrogen atoms and halogen atoms [hereinafter written as "a-Ge(Si,H,X)"] and a second layer region (S) exhibiting photoconductivity comprising an amorphous material containing silicon atoms are successively provided from the substrate side, said light receiving layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either ohe of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum.

According to another aspect of the present invention, there is provided a photoconductive member comprising a substrate for photoconductive member and a light receiving layer comprising a first layer provided on said substrate having photoconductivity comprising an amorphous material containing silicon atoms and germanium atoms and a second layer provided on said first layer comprising an amorphous material containing silicon atoms and nitrogen atoms, said first layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

According to another aspect of the present invention, there is provided a photoconductive member comprising a substrate for photocondcutive member and a light receiving layer comprising a first layer having a first layer region (G) comprising an amorphous material containing germanium atoms provided on said substrate and a second layer region (S) exhibiting photoconductivity comprising an amorphous material containing silicon atoms provided on said first layer region (G) and a second layer comprising an amorphous material containing silicon atoms and nitrogen atoms provided on said first layer, said first layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

According to another aspect of the present invention, there is provided a photoconductive member comprising a substrate for photoconductive member and a light receiving layer comprising a first layer provided on said substrate having photoconductivity comprising an amorphous material containing silicon atoms and germanium atoms and a second layer provided on said first layer comprising an amorphous material containing silicon atoms and oxygen atoms, said first layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

According to another aspect of the present invention, there is provided a photoconductive member comprising a substrate for photoconductive member and a light receiving layer comprising a first layer having a first layer region (G) comprising an amorphous material containing germanium atoms provided on said substrate and a second layer region (S) exhibiting photoconductivity comprising an amorphous material containing silicon atoms provided on said first layer region (G) and a second layer comprising an amorphous material containing silicon atoms and oxygen atoms provided on said first layer, said first layer containing carbon atoms and having a first layer region, a third layer region and a second layer region with the carbon atom content in the layer thickness direction of C(1), C(3) and C(2), respectively, in the order from the substrate side [with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum].

The photoconductive member of the present invention designed to have such a layer constitution as described in detail above can solve all of the various problems as mentioned above and exhibit very excellent electrical, optical, photoconductive characteristics, dielectric strength and use environment characteristics.

In particular, the photoconductive member of the present invention is free from any influence from residual potential on image formation when applied for an image forming member for electrophotography, with its electrical characteristics being stable with high sensitivity, having a high SN ratio as well as excellent light fatigue resistance and excellent repeated use characteristic and being capable of providing images of high quality of high density, clear halftone and high resolution repeatedly and stably.

Also, in the photoconductive member of the present invention, the light receiving layer provided on the substrate is itself tough and markedly excellent in adhesion to the substrate, and therefore it can be used continuously for a long time repeatedly at high speed.

Further, the photoconductive member of the present invention is high in photosensitivity over all the visible light region, particularly excellent in matching to semiconductor laser and rapid in response to light.

DETAILED DESCRIPTION OF THE PREFERRED EMBODIMENTS

Referring not to the drawings, the photoconductive members according to the present invention are to be described in detail below.

Figure 1:
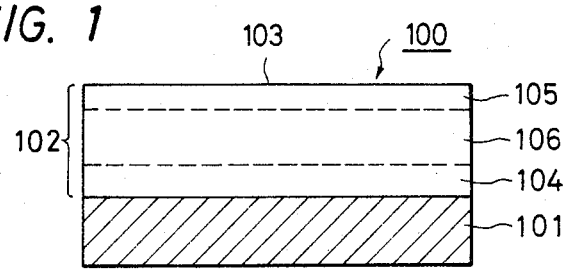
FIGS. 1 through 4 each shows a schematic sectional view for illustration of the layer constitution of a preferred embodiment of the photoconductive member according to the present invention.

FIG. 1 shows a schematic sectional view for illustration of the layer structure of a first preferred embodiment of the constitution of the photoconductive member of this invention.

The photoconductive member 100 as shown in FIG. 1 has a substrate 101 for photoconductive member and a light receiving layer 102 formed on said substrate 101, said light-receiving layer comprising a-SiGe(H,X), containing carbon atoms and having photoconductivity.

The germanium atoms contained in the light receiving layer 102 may be distributed evenly throughout the light receiving layer 102, or may be distributed ununiformly in content although contained everywhere in the layer thickness direction. However, in either case, it is required also for uniformizing the characteristics in the interplanar direction that germanium atoms should be contained uniformly within the plane in parallel to the surface of the substrate.

In particular, germanium atoms are contained in the light receiving layer 102 everywhere in the layer thickness direction but more enriched on the side of the substrate 101 than the side opposite to the side where the aforesaid substrate 101 is provided (namely the free surface 103 side of the light receiving layer 102), or in a distribution contrary to such a distribution.

In the photoconductive member of the present invention, it is desirable that the germanium atoms contained in the light receiving layer should be distributed in a state such that they may take a distribution as described above in the layer thickness direction and a uniform distribution in the interplanar direction in parallel to the surface of the substrate.

Figure 2:
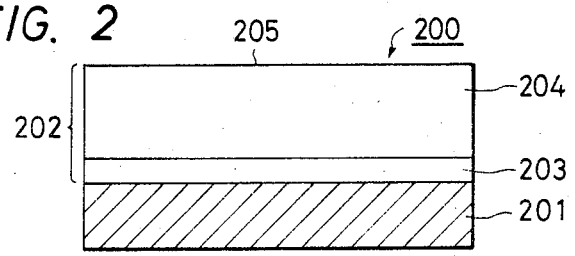

FIG. 2 shows a schematic sectional view for illustration of the layer structure of a second embodiment of the constitution of the photoconductive member of this invention.

The photoconductive member 200 as shown in FIG. 2 is constituted of a light receiving layer 202 formed on a substrate 201 for photoconductive member, said light receiving layer having a free surface 205 on one end surface.

The light receiving layer 202 has a layer structure constituted of a layer region (G) 203 consisting of a-Ge(Si,H,X) and a layer region (S) 204 having photoconductivity consisting of a-Si(H,X) laminated successively from the substrate side 201.

The germanium atoms contained in the layer region (G) 203, when contained together with other atoms in said first layer region (G) 203, may be distributed evenly throughout the light receiving layer 202, or in ununiform content although contained everywhere in the layer thickness direction. However, in either case, it is required also for uniformizing the characteristics in the interplanar direction that germanium atoms should be contained uniformly within the plane in parallel to the surface of the substrate. In particular, germanium atoms are contained in the layer region (G) 203 everywhere in the layer thickness direction but more enriched on the side on the substrate side 201 than the side opposite to the side where the aforesaid substrate 201 is provided (namely the free surface 205 side of the light receiving layer 202), or in a distribution contrary to such a distribution.

In the layer region (S) provided on the layer region (G), no germanium atom is contained, and by forming the light receiving layer to such a layer structure, it is possible to give a photoconductive member which is excellent in photosensitivity to the light over the entire wavelength region from relatively shorter wavelength to relatively longer wavelength including the visible light region.

Also, in a preferred embodiment in the case of a system where germanium atoms are ununiformly distributed, since the distribution of germanium atoms in the layer region (G) is varied such that germanium atoms are distributed continuously over all the layer region with the content C of germanium atoms in the layer thickness direction being reduced from the substrate side to the layer region (S), affinity between the layer region (G) and the layer region (S) is excellent. Also, as described hereinafter, by increasing the content C of germanium atoms at the end portion on the substrate side extremely great, the light on the longer wavelength side which cannot substantially be absorbed by the second layer region (S) can be absorbed in the layer region (G) substantially completely, when employing a semiconductor laser, whereby interference by reflection from the substrate surface can be prevented.

Also, when silicon atoms are contained in the layer region (G), the respective amorphous materials constituting the layer region (G) and the layer region (S) have the common constituent of silicon atoms, and therefore chemical stability can be sufficiently ensured at the laminated interface.

Figure 3:
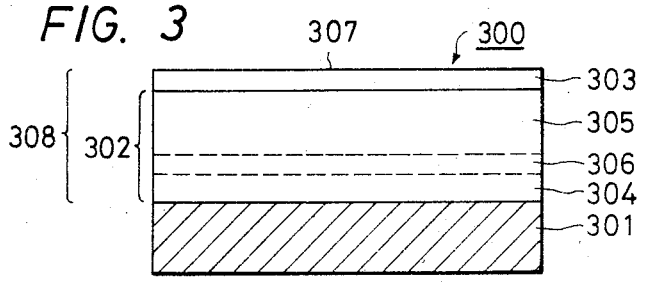

FIG. 3 is a schematic illustration of the layer structure of a third embodiment of the photoconductive member of the present invention.

The photoconductive member 300 shown in FIG. 3 has a substrate 301 for photoconductive member, a first layer (I) 302 provided on said substrate 301 and a second layer (II) 303 provided on the first layer (I) 302. The first layer (I) 302 comprises a-SiGe(H,X), contains carbon atoms and has photoconductivity. The light receiving layer 308 is constituted of the first layer (I) 302 and the second layer (II) 303.

The germanium atoms may be contained in the first layer (I) 302 evenly throughout the first layer (I) 302 or alternatively in an ununiform distribution in the layer thickness direction although contained everywhere in the layer. However, in either case, it is necessary for effecting uniformization of the characteristics that the germanium atoms should be contained in the interplanar direction in parallel to the surface of the substrate everyshere in uniform distribution.

In particular, the germanium atoms are contained in the above first layer (I) 302 so that they are contained everywhere in the layer thickness direction of the first layer (I), and more enriched on the side of the aforesaid substrate 301 (on the interface side between the light receiving layer 308 and the substrate 301) than the side opposite to the side where the above substrate 301 is provided (the free surface side 307 of the light receiving layer 308), or in a distribution contrary thereto.

As described above, the distribution of the germanium atoms contained in the first layer (I) 302 should desirably be such that they should take a distributed state as described above in the layer thickness direction and a uniform distributed state in the interplanar direction in parallel to the surface of the substrate 301.

Figure 4:
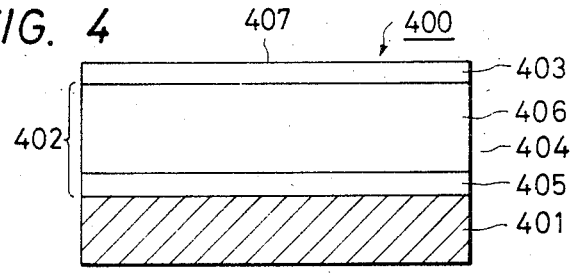

FIG. 4 is a schematic illustration of the layer structure of a fourth embodiment of the photoconductive member of the present invention.

The photoconductive member 400 shown in FIG. 4 has a substrate 401 for photoconductive member, a first layer (I) 402 provided on said substrate 401 and a second layer (II) 403 provided on the first layer (I) 402. The first layer (I) 402 is constituted of a layer region (G) 405 consisting of an amorphous material containing germanium atoms, and, if desired, at least one of silicon atoms, hydrogen atoms and halogen atoms (hereinafter abbreviated as "a-Ge(Si,H,X)" provided on the substrate and a layer region (S) 406 having photoconductivity consisting of an amorphous material containing silicon atoms and, if desired, at least one of hydrogen atoms and halogen atoms (hereinafter abbreviated as "a-Si(H,X)") provided on the first layer region (G) 405.

The germanium atoms containing in the first layer region (G) 405 may be distributed evenly throughout the first layer region (G) 405, or in ununiform content although contained everywhere in the layer thickness direction. However, in either case, it is required also for uniformizing the characteristics in the interplanar direction that germanium atoms should be contained in the first layer region (G) 405 uniformly within the plane in parallel to the surface of the substrate. In particular, germanium atoms are contained in the first layer region (G) 405 everywhere in the layer thickness direction but more enriched on the side on the substrate side 401 (the interface side between the light receiving layer and the substrate 401) than the side opposite to the side where the aforesaid substrate 401 is provided (namely the free surface 407 side of the light receiving layer 404), or in a distribution contrary to such a distribution.

As described above, the distribution of the germanium atoms contained in the first layer region (G) 405 should desirably be such that they should take a distributed state as described above in the layer thickness direction and a uniform distributed state in the interplanar direction in parallel to the surface of the substrate 401.

In the layer region(S) 406 provided on the layer region (G) 405, no germanium atom is contained, and by forming the first layer (I) 402 to such a layer structure, it is possible to give a photoconductive member which is excellent in photosensitivity to the light over the entire wavelength region from relatively shorter wavelength to relatively longer wavelength including the visible light region.

Also, in a preferred embodiment, since the distribution of germanium atoms in the first layer region (G) 405 is varied such that germanium atoms are distributed continuously over all the layer region with the content C of germanium atoms in the layer thickness direction being reduced from the substrate side to the layer region (S) 406, affinity between the layer region (G) 405 and the layer region (S) 406 is excellent. Also, as described hereinafter, by increasing the content C of germanium atoms at the end portion on the substrate side extremely great, the light on the longer wavelength side which cannot substantially be absorbed by the second layer region (S) 406 can be absorbed in the layer region (G) 405 substantially completely, when employing a semiconductor laser, whereby interference by reflection from the substrate surface 401 can be prevented.

The second layer is constituted of an amorphous material containing at least one of nitrogen atoms and oxygen atoms in a matrix of silicon atoms, and should also desirably contain at least one of hydrogen atoms and halogen atoms.

FIGS. 5 through 13 show typical examples of ununiform distribution in the direction of layer thickness of germanium atoms contained in the light receiving layer or the first layer of the photoconductive member in the present invention.

In FIGS. 5 through 13, the abscissa indicates the content C of germanium atoms and the ordinate the layer thickness of the light receiving layer or the first layer exhibiting photoconductivity, $t_B$ showing the position of the surface on the substrate side and $t_T$ the position of the surface of the light receiving layer or the first layer on the side opposite to the substrate side. That is, layer formation of the light receiving layer or the first layer containing germanium atoms proceeds from the $t_B$ side toward the $t_T$ side.

Figure 5:
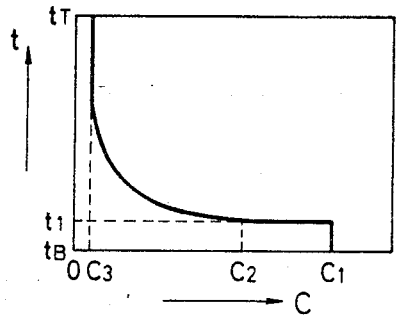
FIGS. 5 to 13 each shows a schematic illustration of the depth profiles of germanium atoms in the light receiving layer or the first layer region (G)

In FIG. 5, there is shown a first typical embodiment of the depth profile of germanium atoms in the layer thickness direction contained in the light receiving layer or the first layer.

In the embodiment as shown in FIG. 5, from the interface position $t_B$ at which the surface, on which the light receiving layer or the first layer containing germanium atoms is to be formed, is contacted with the surface of said light receiving layer or said first layer to the position $t_1$, germanium atoms are contained in the light receiving layer or the first layer formed, while the content C of germanium atoms taking a constant value of $C_1$, the content being gradually decreased from the content $C_2$ continuously from the position $t_1$ to the interface position $t_T$. At the interface position $t_T$, the content C of germanium atoms is made $C_3$.

Figure 6:
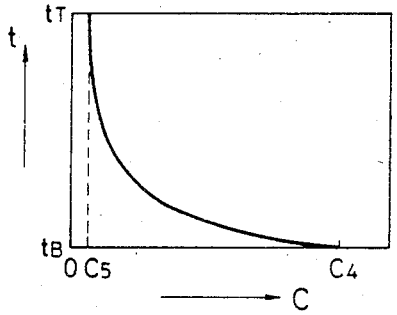

In the embodiment shown in FIG. 6, the content C of germanium atoms contained is decreased gradually and continuously from the position $t_B$ to the position $t_T$ from the content $C_4$ until it becomes the content $C_5$ at the position $t_T$.

Figure 7:
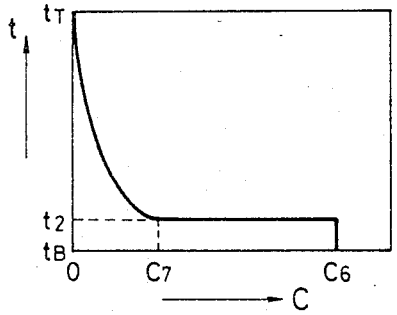

In case of FIG. 7, the content C of germanium atoms is made constnat as $C_6$, gradually decreased continuously from the position $t_2$ to the position $t_T$, and the content C is made substantially zero at the position $t_T$ (substantially zero herein means the content less than the detectable limit).

Figure 8:
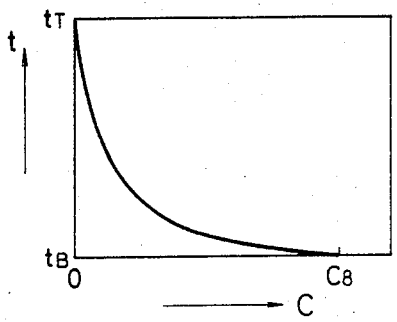

In case of FIG. 8, the content C of germanium atoms are decreased gradually and continuously from the position $t_B$ to the position $t_T$ from the content $C_8$, until it is made substantially zero at the position $t_T$.

Figure 9:
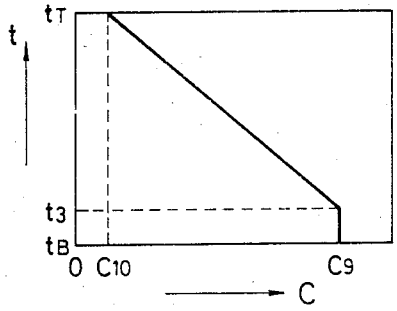

In the embodiment shown in FIG. 9, the content C of germanium atoms is constantly $C_9$ between the position $t_B$ and the position $t_3$, and it is made $C_{10}$ at the position $t_T$. Between the position $t_3$ and the position $t_T$, the content is reduced as a first order function from the position $t_3$ to the position $t_T$.

Figure 10:
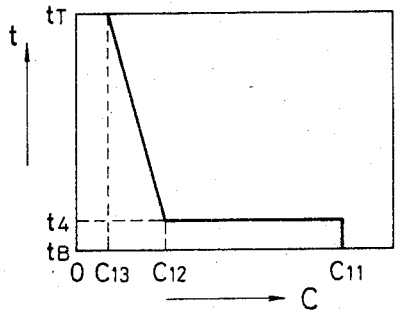

In the embodiment shown in FIG. 10, there is formed a depth profile such that the content C takes a constant value of $C_{11}$ from the position $t_B$ to the position $t_4$, and is decreased as a first order function from the content $C_{12}$ to the content $C_{13}$ from the position $t_4$ to the position $t_T$.

Figure 11:
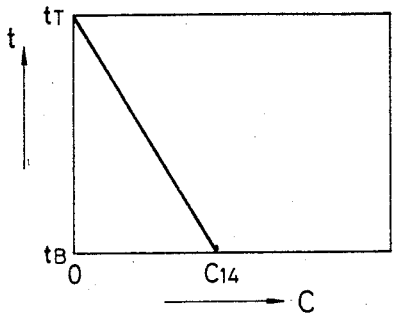

In the embodiment shown in FIG. 11, the content C of germanium atoms is decreased as a first order function from the content $C_{14}$ to zero from the position $t_B$ to the position $t_T$.

Figure 12:
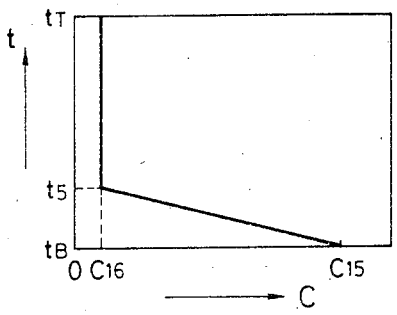

In FIG. 12, there is shown an embodiment, where the content C of germanium atoms is decreased as a first order function from the content $C_{15}$ to $C_{16}$ from the position $t_B$ to $t_5$ and made constantly at the content $C_{16}$ between the position $t_5$ and $t_T$.

Figure 13:
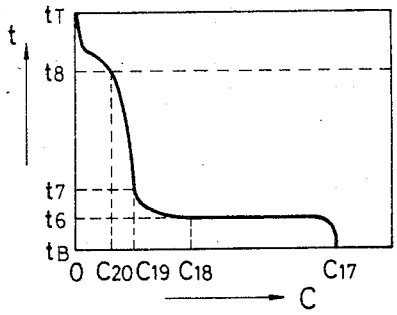

In the embodiment shown in FIG. 13, the content C of germanium atoms is at the content $C_{17}$ at the position $t_B$, which content $C_{17}$ is initially decreased gradually and abruptly near the position $t_6$ to the position $t_6$, until it is made the content $C_{18}$ at the position $t_6$.

Between the position $t_6$ and the position $t_7$, the content C is initially decreased abruptly and thereafter gradually, until it is made the content $C_{19}$ at the position $t_7$. Between the position $t_7$ and the position $t_8$, the content is decreased very gradually to the content $C_{20}$ at the position $t_8$. Between the position $t_8$ and the position $t_T$, the content is decreased along the curve having a shape as shown in the Figure from the content $C_{20}$ to substantially zero.

As described above about some typical examples of depth profiles of germanium atoms contained in the light receiving layer or the first layer in the direction of the layer thickness by referring to FIGS. 5 through 13, in the present invention, the light receiving layer or the first layer is provided desirably in a depth profile so as to have a portion enriched in content C of germanium atoms on the substrate side and a portion depleted in content C of germanium atoms to considerably lower than that of the substrate side on the interface $t_T$ side.

The light receiving layer or the first layer constituting the photoconductive member of the present invention is desired to have a localized region (A) containing germanium atoms preferably at a relatively higher content on the substrate side or alternatively on the free surface side as described above.

In the present invention, the localized region (A), as explained in terms of the symbols in FIG. 5 through FIG. 13, may be desirably provided within 5μ from the interface position $t_B$.

In the present invention, the above localized region (A) may be made to be identical with the whole layer region ($L_T$) up to the depth of 5μ from the interface position $t_B$, or alternatively a part of the layer region ($L_T$).

It may suitably be determined depending on the characteristics required for the light receiving layer or the first layer to be formed, whether the localized region (A) is made a part or whole of the layer region ($L_T$).

The localized region (A) may preferably be formed according to such a layer formation that the maximum value Cmax of the content of germanium atoms in a distribution in the layer thickness direction may preferably be 1000 atomic ppm or more, more preferably 5000 atomic ppm or more, most preferably $1\times10^4$ atomic ppm or more based on the sum of germanium atoms and silicon atoms.

That is, according to the present invention, the light receiving layer or the first layer containing germanium atoms is formed so that the maximum value Cmax of the content may exist within a layer thickness of 5μ from the substrate side (the layer region within 5μ thickness from $t_B$).

In the present invention, when the light receiving layer or the first layer is constituted of a-SiGe(H,X), the content of germanium atoms in the light receiving layer or the first layer containing germanium atoms, which may suitably be determined as desired so as to achieve effectively the objects of the present invention, may preferably be 1 to $9.5\times10^5$ atomic ppm, more preferalby 100 to $8\times10^5$ atomic ppm, most preferably 500 to $7\times10^5$ atomic ppm based on the sum with silicon atoms.

In the present invention, when the light receiving layer or the first layer is constituted of the first layer region (G) and the second layer region (S), the content of germanium atoms in the first layer region (G), which may suitably be determined as desired so as to achieve effectively the objects of the present invention, may preferably be 1 to $10\times10^5$ atomic ppm, more preferably 100 to $9.5\times10^5$ atomic ppm, most preferably 500 to $8\times10^5$ atomic ppm.

In the present invention, the layer thickness of the first layer region (G) and the layer thickness of the second layer region (S) are one of important factors for accomplishing effectively the object of the present invention and therefore sufficient care should be paid in designing of the photoconductive member so that desirable characteristics may be imparted to the photoconductive member formed.

In the present invention, the layer thickness $T_B$ of the layer region (G) may preferably be 30 Å to 50μ, more preferably 40 Å to 40μ, most preferably 50 Å to 30μ.

On the other hand, the layer thickness T of the layer region (S) may be preferably 0.5 to 90μ, more preferably 1 to 80μ, most preferably 2 to 50μ.

The sum of the above layer thickness $T_B$ and T, namely $(T_B+T)$ may be suitably determined as desired in designing of the layers of the photoconductive member, based on the mutual organic relationship between the characteristics required for both layer regions and the characteristics required for the whole light receiving layer.

In the photoconductive member of the present invention, the numerical range for the above $(T_B+T)$ may generally be from 1 to 100μ, preferably 1 to 80μ, most preferably 2 to 50μ.

In a more preferred embodiment of the present invention, it is preferred to select the numerical values for respective thicknesses $T_B$ and T as mentioned above so that the relation of $T_B/T\leqq1$ may be satisfied.

In selection of the numerical values for the thicknesses $T_B$ and T in the above case, the values of $T_B$ and T should preferably be determined so that the relation $T_B/T\leqq0.9$, most preferably, $T_B/T\leqq0.8$, may be satisfied.

In the present invention, when the content of germanium atoms in the first layer region (G) is $1\times10^5$ atomic ppm or more, the layer thickness $T_B$ of the first layer region (G) should desirably be made as thin as possible, preferably 30μ or less, more preferably 25μ or less, most preferably 20μ or less.

When the distribution of germanium atoms in the light receiving layer or the first layer is such that germanium atoms are continuously distributed throughout the whole layer and the content C of germanium atoms in the layer thickness direction is given a change so as to be reduced from the substrate side to the free surface side of the light receiving layer, or a change contrary thereto, a light receiving layer having required characteristics can be realized as desired by designing freely the change rate curve of the content C as desired.

For example, by giving a change in the content C to the depth profile of germanium atoms so as to make sufficiently higher the content C in the light receiving layer or the first layer on the substrate side, while reducing minimum on the free surafce side of the light receiving layer or the first layer, higher photosensitization can be effected to the light of all the region from relatively shorter wavelength to relatively longer wavelength including the visible light region, simultaneously with effective prevention of interference against interferable light such as laser beam.

Also, by making the content C of germanium atoms extremely great at the end portion of the substrate side of the light receiving layer or the first layer, when a semiconductor laser is employed, the light on the longer wavelength side which cannot sufficiently be absorbed on the side of the light receiving layer irradiated by laser can be absorbed substantially completely at the end portion layer region of the light receiving layer, whereby interference caused by reflection against the substrate surface can effectively be prevented.

In the photoconductive member of the present invention, for the purpose of making higher photosensitivity and dark resistance, and further for the purpose of improving adhesion between the substrate and the light receiving layer, carbon atoms are contained in the light receiving layer or the first layer.

Figure 20:
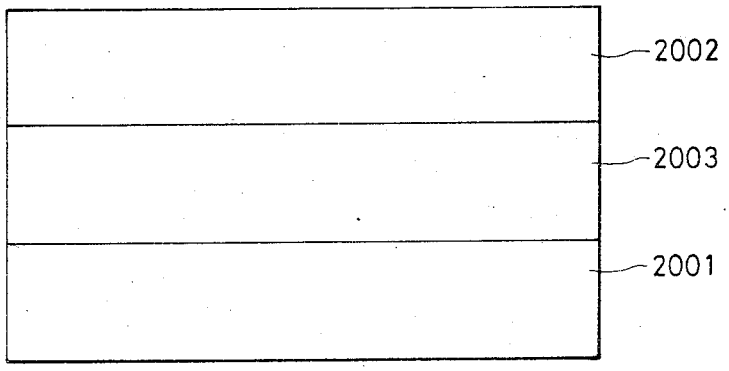
FIGS. 20 to 32 each shows a depth profile of the respective atoms in Examples of the present invention.

The light receiving layer or the first layer containing carbon atoms, as shown in FIG. 20, has a first layer region (1) 2001 with a content C(C) of a value C(1), a second layer region (2) 2002 with a content of a value C(2) and a layer region (3) 2003 with a content of a value C(3). When the light receiving layer or the first layer consists of the first layer region (G) and the second layer region (S), the contacted interface between the first layer region (G) and the second layer region (S) may exist in either one of the first layer region (1), the second layer region (2) and the third layer region (3).

In the present invention, it is not necessarily required that carbon atoms should be contained in all of the three layer regions of the above first, second and third layer regions. However, when no carbon atom is contained in one of the three layer regions, carbon atoms are necessarily contained in the other two layer regions, the content C(C) in the layer thickness direction are required to be different in those layer regions and the carbon atom content in the third layer region should not be solely the maximum.

In other words, when one of C(1), C(2) and C(3) is 0, the respective layer regions are required to be formed so that the other two are not 0 and not equal to each other, and C(3) is not solely the maximum. On the other hand, when carbon atoms are contained in all of the first, second and third layer regions, the contents in the three layer regions cannot be equal at the same time, and the content in the third layer region cannot be made solely the maximum. In short, when none of C(1), C(2) and C(3) is 0, the three of C(1), C(2) and C(3) cannot be equal at the same time and C(3) is not made solely the maximum.

By doing so, when charging treatment is applied, injection of charges from the side of the free surface or the side of the substrate into the light receiving layer can effectively be inhibited, and at the same time improvement of dark resistance of the light receiving layer itself as well as improvement of adhesion between the substrate and the light receiving layer can be effected.

In this case, preferably, the light receiving layer or the first layer should be designed so that the layer thickness of the third layer region (3) may be sufficiently thicker than the layer thicknesses of the other two layer regions. More preferably, the light receiving layer or the first layer should desirably be designed so that the layer thickness of the third layer (3) may comprise at least 1/5 of the layer thickness of the light receiving layer or the first layer.

In the present invention, the layer thickness of the first layer region (1) and the second layer region (2) should preferably be 0.003 to 30μ, more preferably 0.004 to 20μ, most preferably 0.005 to 10μ. On the other hand, the layer thickness of the third layer region (3) should preferably be 1 to 100μ, more preferably 1 to 80μ, more preferably 2 to 50μ.

When the light receiving layer is designed so as to impart primarily the function of the so called charge injection inhibiting layer, which inhibits injection of charges into the light receiving layer, to the first layer region (1) and the second layer region (2), each of the layer thicknesses of the first layer region (1) and the second layer region (2) should desirably be made 10μ at its maximum.

When the light receiving layer or the first layer is designed so as to impart primarily the function of charge generating layer to the third layer region (3), the layer thickness of the layer region (3) is determined suitably depending on the absorption coefficient of light of the light source employed. In this case, if a light source conventionally used in the field of electrophotography is to be employed, the layer thickness of the third layer region (3) may be at most about 10μ. In order to impart primarily the function of charge transport layer to the third layer region (3), its thickness should desirably be at least 5μ.

FIGS. 14 through 18 show typical examples of depth profile of carbon atoms in the light receiving layer or the first layer as a whole. In explanation of these Figures, the symbols have the same meanings as employed in FIG. 5 through 13, unless otherwise noted.

Figure 14:
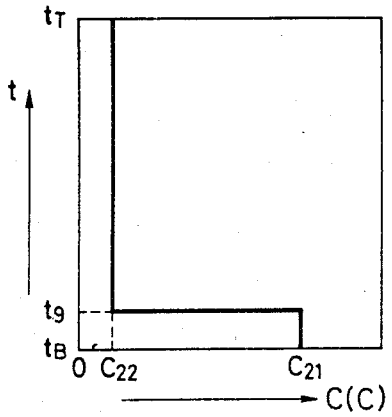
FIGS. 14 to 18 each shows a schematic illustration of the depth profile of carbon atoms in the light receiving layer or the first layer.

In the embodiment shown in FIG. 14, from the position $t_B$ to the position $t_9$, the content of carbon atoms C(C) is made a constant value of $C_{21}$, while from the position $t_9$ to the position $t_T$, it is made constantly $C_{22}$.

Figure 15:
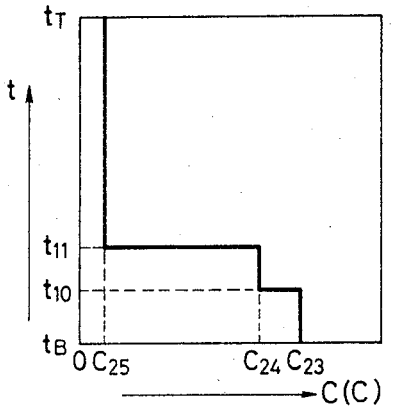

In the embodiment shown in FIG. 15, from the position $t_B$ to the position $t_{10}$, the content of carbon atoms C(C) is made a constant value of $C_{23}$, while it is made $C_{24}$ from the position $t_{10}$ to the position $t_{11}$ and $C_{25}$ from the position $t_{11}$ to the position $t_T$, thus being decreased in three stages.

Figure 16:
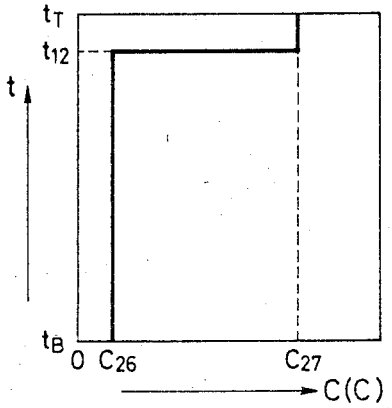

In the embodiment of FIG. 16, the content C(C) is made $C_{26}$ from the position $t_B$ to the position $t_{12}$, while it is made $C_{27}$ from the position $t_{12}$ to the position $t_T$.

Figure 17:
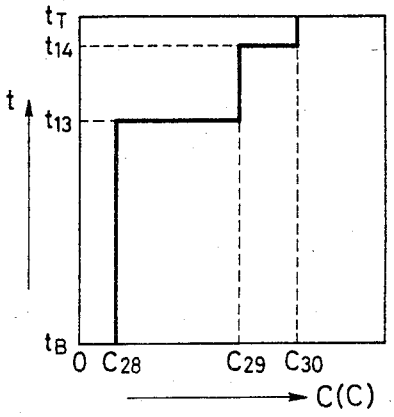

In the embodiment of FIG. 17, from the position $t_B$ to the position $t_{13}$, the content C(C) is made $C_{28}$, while it is made $C_{29}$ from the position $t_{13}$ to the position $t_{14}$, and $C_{30}$ from the position $t_{14}$ to the position $t_T$. Thus, the content of carbon atoms is increased in three stages.

Figure 18:
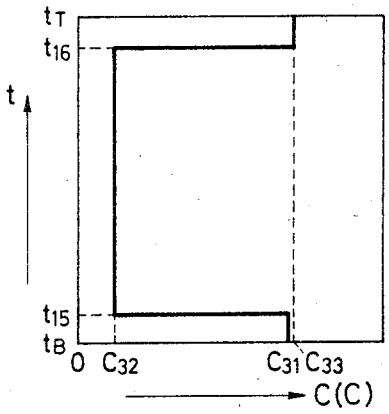

In the embodiment of FIG. 18, the carbon atoms content C(C) is made $C_{31}$ from the position $t_B$ to the position $t_{15}$, $C_{32}$ from the position $t_{15}$ to the position $t_{16}$ and $C_{33}$ from the position $t_{16}$ to the position $t_T$. The content is made higher on the substrate side and on the free surface side.

In the present invention, the layer region (C) containing carbon atoms provided in the light receiving layer or the first layer (constituted of at least 2 layer regions of the first, second and third layer regions as described above) is provided so as to occupy the whole layer region of the light receiving layer or the first layer when it is intended to improve primarily photosensitivity and dark resistance; or in the vicinity of the free surface for preventing injection of charges from the free surface of the light receiving layer; or so as to occupy the end portion layer region on the substrate side of the light receiving layer or the first layer for ensuring strengthening of adhesion between the substrate and the light receiving layer.

In the above first case, the content of carbon atoms in the layer region (C) is preferably made relatively smaller for maintaining high photosensitivity, while it is relatively larger in the second case for prevention of injection of charges from the free surface of the light receiving layer, and in the third case relatively larger for ensuring strengthening of adhesion to the substrate.

For accomplishing the above three cases at the same time, there may be created a layer region (C) having a depth profile of carbon atoms such as that they are contained in relatively higher content on the substrate side, in a relatively lower content at the central part of the light receiving layer and in greater amount of carbon atoms at the surface layer region on the free surface side of the light receiving layer or the first layer.

In the present invention, the content of carbon atoms to be contained in the layer region (C) provided in the light receiving layer or the first layer may be suitably selected depending on the characteristics required for the layer region (C) per se or, when said layer region (C) is provided in direct contact with the substrate, depending on the organic relationship such the relation with the characteristics at the contacted interface with said substrate and others.

When another layer region is to be provided in direct contact with said layer region (C), the content of carbon atoms may be suitably selected also with considerations about the characteristics of said another layer region and the relation with the characteristics of the contacted interface with said another layer region.

The content of carbon atoms in the layer region (C), which may suitably be determined as desired depending on the characteristics required for the photoconductive member to be formed, may be preferably 0.001 to 50 atomic %, more preferably 0.002 to 40 atomic %, most preferably 0.003 to 30 atomic % based on the sum T(SiGeC) of the three atoms of silicon atoms, germanium atoms and carbon atoms.

In the present invention, when the layer region (C) comprises the whole region of the light receiving layer or the first layer or when, although it does not comprises the whole layer region, the layer thickness To of the layer region (C) is sufficiently large relative to the layer thickness T of the light receiving layer or the first layer, the upper limit of the content of carbon atoms in the layer region (C) should desirably be sufficiently smaller than the aforesaid value.

In the case of the present invention, in such a case when the ratio of the layer thickness To of the layer region (C) relative to the layer thickness T of the light receiving layer or the first layer is 2/5 or higher, the upper limit of the content of carbon atoms in the layer region (C) may preferably be 30 atomic % or less, more preferably 20 atomic % or less, most preferably 10 atomic % or less based on the sum T(SiGeC) of silicon atoms, germanium atoms and carbon atoms.

In the present invention, the layer region (C) containing carbon atoms for constituting the light receiving layer or the first layer may preferably be provided so as to have a localized region (B) containing carbon atoms at a relatively higher content on the substrate side and in the vicinity of the free surface as described above, and in the former case adhesion between the susbstrate and the light receiving layer can be further improved, and improvement of acceptable potential can also be effected.

The localized region (B), as explained in terms of the symbols shown in FIGS. 14 to 18, may be desirably provided within 5 $\mu$ from the interface position $t_B$ or the free surface $t_T$.

In the present invention, the above localized region (B) may be made to be identical with the whole layer region ($L_T$) up to the depth of 5 $\mu$ thickness from the interface position $t_B$ or the free surface $t_T$, or alternatively a part of the layer region ($L_T$).

It may suitably be determined depending on the characteristics required for the light receiving layer to be formed, whether the localized region (B) is made a part or whole of the layer region ($L_T$).

The localized region (B) may preferably be formed according to such a layer formation that the maximum Cmax of the content C(C) of carbon atoms in a distribution in the layer thickness direction may preferably be 500 atomic ppm or more, more preferably 800 atomic ppm or more, most preferably 1000 atomic ppm or more.

That is, according to the present invention, the layer region (C) containing carbon atoms is formed so that the maximum value Cmax of the depth profile may exist whitin a layer thickness of 5 $\mu$ from the substrate side or the free surface (the layer region within 5 $\mu$ thickness from $t_B$ or $t_T$). In the present invention, halogen atoms (X) which may be incorporated in the light receiving layer, if desired, may include fluorine, chlorine, bromine and iodine, particularly preferably fluorine and chlorine.

In the present invention, by incorporating a substance (C) for controlling conductivity in the light receiving layer or the first layer, the conductivity characteristic of the light receiving layer or the first layer can freely be controlled as desired.

As a substance (C) for controlling conductivity characteristics, there may be mentioned so called impurities in the field of semiconductors. In the present invention, there may be included p-type impurities giving p-type conductivity characteristics and n-type impurities giving n-type conductivity characteristics to a-SiGe(H,X), a-Ge(H,X), a-Si(H,X), etc. constituting the light receiving layer or the first layer formed.

More specifically, there may be mentioned as p-type impurities atoms belonging to the group III of the periodic table (Group III atoms), such as B (boron), Al (aluminum), Ga (gallium), In (indium), Tl (thallium), etc., particularly preferably B and Ga.

As n-type impurities, there may be included the atoms belonging to the group V of the periodic table, such as P (phosphorus), As (arsenic), Sb (antimony), Bi (bismuth), etc., particularly preferably P and As.

In the present invention, the content of the substance (C) for controlling conductivity in the light receiving layer or the first layer may be suitably be selected depending on the conductivity required for said light receiving layer or said first layer, or the organic relationships such as relation with the characteristics of said light receiving layer or the first layer at the contacted interface with the substrate.

Also, when the above substance (C) for controlling conductivity is contained in the light receiving layer or the first layer locally in a desired layer region in said light receiving layer or the first layer, especially in the end portion layer region (E) on the substrate side of the light receiving layer, the content of the substance (C) for controlling conductivity is determined suitably with due considerations of the relationships with characteristics of other layer regions provided in direct contact with said layer region (E) or the characteristics at the contacted interface with said other layer regions.

In the present invention, the content of the substance (C) for controlling conductivity contained in the light receiving layer or the first layer should preferably be 0.01 to $5\times10^4$ atomic ppm, more preferably 0.5 to $1\times10^4$ atomic ppm, most preferably 1 to $5\times10^3$ atomic ppm.

In the present invention, when the content of said substance (C) in the layer region containing said substance (C) is 30 atomic ppm or more, more preferably 50 atomic ppm or more, most preferably 100 atomic ppm or more, the above substance (C) should desirably be contained locally in a part of the layer region in the light receiving layer or the first layer, especially localized in the end portion layer region (E) on the substrate side of the light receiving layer or the first layer.

Among the above cases, by incorporating the substance (C) for controlling conductivity in the end portion layer region (E) on the substrate side of the light receiving layer or the first layer in an amount of the value as mentioned above or more, in the case, for example, when said substance (C) to be incorporated is a p-type impurity as mentioned above, migration of electrons injected from the substrate side into the light receiving layer can be effectively inhibited when the free surface of the light receiving layer is subjected to the charging treatment to $\oplus$ polarity. On the other hand, when the substance to be incorporated is a n-type impurity, migration of positive holes injected from the substrate side into the light receiving layer can be effectively inhibited when the free surface of the light receiving layer is subjected to the charging treatment to $\ominus$ polarity.

In the case as mentioned above, when a substance for controlling conductivity of one polarity is contained in the end portion layer region (E), the layer region (Z) at the portion excluding the above end portion layer region (E) in the light receiving layer or the first layer may contain a substance for controlling conductivity of the other polarity, or a substance for controlling conductivity of the same polarity may be contained therein in an amount by far smaller than that practically contained in the end portion layer region (E).

In such a case, the content of the substance (C) for controlling conductivity contained in the above layer region (Z) can be determined adequately as desired depending on the polarity or the content of the substance contained in the end portion layer region (E), but it is preferably 0.001 to 1000 atomic ppm, more preferably 0.05 to 500 atomic ppm, most preferably 0.1 to 200 atomic ppm.

In the present invention, when the same kind of a substance for controlling conductivity is contained in the end portion layer region (E) and the layer region (Z), the content in the layer region (Z) should preferably be 30 atomic ppm or less. As different from the cases as mentioned above, in the present invention, it is also possible to provide a layer region containing a substance for controlling conductivity having one polarity and a layer region containing a substance for controlling conductivity having the other polarity in direct contact with each other in the light receiving layer or the first layer, thus providing a so called depletion layer at said contact region. In short, for example, a layer containing the aforesaid p-type impurity and a layer region containing the aforesaid n-type impurity are provided in the light receiving layer or the first layer in direct contact with each other to form the so called p-n junction, whereby a depletion layer can be provided.

In the present invention, formation of the light receiving layer or the first layer constituted of a-Ge(H,X), a-Si(H,X), a-SiGe(H,X), etc. may be conducted according to the vacuum deposition method utilizing discharging phenomenon, such as glow discharge method, sputtering method or ion-plating method. For example, for formation of the light receiving layer or the first layer constituted of a-SiGe(H,X) according to the glow discharge method, the basic procedure comprises introducing, a starting gas for Si supply capable of supplying silicon atoms (Si), a starting gas for Ge supply capable of supplying germanium atoms (Ge) together with, if desired, a starting gas for introduction of hydrogen atoms (H) and/or a starting gas for introduction of halogen atoms (X) into a deposition chamber which can be internally brought to a reduced pressure, and exciting glow discharge in said deposition chamber, thereby effecting formation of a layer consisting of a-SiGe(H,X) on the surface of a substrate placed at a predetermined position. For distributing ununiformly the germanium atoms, a layer consisting of a-SiGe(H,X) may be formed while controlling the depth profile of germanium atoms according to a desired change rate curve. Alternatively, for formation according to the sputtering method, when carrying out sputtering by use of a target constituted of Si or two sheets of targets of said target and a target constituted of Ge, or a target of a mixture of Si and Ge in an atmosphere of an inert gas such as Ar, He, etc. or a gas mixture based on these gases, a starting gas for Ge supply optionally diluted with He, Ar, etc., optionally together with, if desired, a gas for introduction of hydrogen atoms (H) and/or a gas for introduction of halogen atoms (X) may be introduced into a deposition chamber for sputtering, thereby forming a plasma atmosphere of a desired gas. For making the distribution of germanium atoms uniform, sputtering of the aforesaid target may be effected, while controlling the gas flow rate of the starting gas for supply of Ge according to a desired change rate curve.

In the case of the ion-plating method, for example, a vaporizing source such as a polycrystalline silicon or a single crystalline silicon and a polycrystalline germanium or a single crystalline germanium may be placed as vaporizing source in an evaporating boat, and the vaporizing source is heated by the resistance heating method or the electron beam method (EB method) to be vaporized, and the flying vaporized product is permitted to pass through a desired gas plasma atmosphere, otherwise following the same procedure as in the case of sputtering.

Formation of a layer region constituted of a-Ge(Si,H,X) or a a-Si(H,X) may also be conducted similarly. In this case, for example, if a layer region constituted of a-Si(H,X) is to be formed, layer formation may be carried out according to the method as described above by use of the starting materials from which the starting gas for supply of germanium atoms is removed.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

As the substances which can be starting gases for Ge supply, there may be effectively employed gaseous or gasifiable hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. In particular, $GeH_4$, $Ge_2H_6$ and $Ge_3H_8$ are preferred with respect to easy handling during layer formation and efficiency for supplying Ge.

Effective starting gases for introduction of halogen atoms to be used in the present invention may include a large number of halogenic compounds, as exemplified preferably by gaseous or gasifiable halogenic compounds such as halogenic gases, halides, interhalogen compounds, silane derivatives substituted with halogens, and the like.

Further, there may also be included gaseous or gasifiable silicon compounds containing halogen atoms constituted of silicon atoms and halogen atoms as constituent elements as effective ones in the present invention.

Typical examples of halogen compounds preferably used in the present invention may include halogen gases such as of fluorine, chlorine, bromine or iodine, interhalogen compounds such as BrF, ClF, $ClF_3$, $BrF_5$, $BrF_3$, $IF_3$, $IF_7$, ICl, IBr, etc.

As the silicon compounds containing halogen atoms, namely so called silane derivatives substituted with halogens, there may preferably be employed silicon halides such as $SiF_4$, $Si_2F_6$, $SiCl_4$, $SiBr_4$ and the like.

In the present invention, as the starting gas for introduction of halogen atoms, the halides or halo-containing silicon compounds as mentioned above can effectively be used. Otherwise, it is also possible to use effectively as the starting material for formation of the light receiving layer gaseous or gasifiable substances, including halides containing hydrogen atom as one of the constituents, e.g. hydrogen halides such as HF, HCl, HBr, HI, etc.; halo-substituted hydrogenated silicon such as $SiH_2F_2$, $SiH_2I_2$, $SiH_2Cl_2$, $SiHCl_3$, $SiH_2Br_2$, $SiHBr_3$, etc.; hydrogenated germanium halides such as $GeHF_3$, $GeH_2F_2$, $GeH_3F$, $GeHCl_3$, $GeH_2C_{12}$, $GeH_3Cl$, $GeHBr_3$, $GeH_2Br_2$, $GeH_3Br$, $GeHI_3$, $GeH_2I_2$, $GeH_3I$, etc.; germanium halides such as $GeF_4$, $GeCl_4$, $GeBr_4$, $GeI_4$, $GeF_2$, $GeCl_2$, $GeBr_2$, $GeI_2$, etc.

Among these substances, halides containing hydrogen atoms can preferably be used as the starting material for introduction of halogen atoms, because hydrogen atoms, which are very effective for controlling electrical or photoelectric characteristics, can be introduced into the layer simultaneously with introduction of halogen atoms during formation of the light receiving layer or the first layer.

For introducing hydrogen atoms structurally into the light receiving layer or the first layer, other than those as mentioned above, $H_2$ or a hydrogenated silicon such as $SiH_4$, $Si_2H_6$, $Si_3H_8$, $Si_4H_{10}$, etc. together with germanium or a germanium compound for supplying Ge, or a hydrogenated germanium such as $GeH_4$, $Ge_2H_6$, $Ge_3H_8$, $Ge_4H_{10}$, $Ge_5H_{12}$, $Ge_6H_{14}$, $Ge_7H_{16}$, $Ge_8H_{18}$, $Ge_9H_{20}$, etc. together with silicon or a silicon compound for supplying Si can be permitted to co-exist in a deposition chamber, followed by excitation of discharging.

When the characteristic photoconductive member of the present invention is formed according to the glow discharge method by employment of such a silicon compound containing halogen atoms, it is possible to form the layer comprising a-SiGe or a-Si containing halogen atoms on a desired substrate without use of a hydrogenated silicon gas as the starting gas.

In the case of forming a layer containing halogen atoms according to the glow discharge method, the basic procedure comprises introducing, for example, a silicon halide as the starting gas for Si supply, a hydrogenated germanium as the starting gas for Ge supply and a gas such as Ar, $H_2$, He, etc. at a predetermined mixing ratio into the deposition chamber for formation of the light receiving layer or the first layer and exciting glow discharge to form a plasma atmosphere of these gases, whereby the light receiving layer or the first layer can be formed on a desired substrate. In order to control the ratio of hydrogen atoms incorporated more easily, hydrogen gas or a gas of a silicon compound containing hydrogen atoms may also be mixed with these gases in a desired amount to form the layer.

Also, each gas is not restricted to a single species, but multiple species may be available at any desired ratio.

In either case of the sputtering method and the ion-plating method, introduction of halogen atoms into the layer formed may be performed by introducing the gas of the above halogen compound or the above silicon compound containing halogen atoms into a deposition chamber and forming a plasma atmosphere of said gas.

On the other hand, for introduction of hydrogen atoms, a starting gas for introduction of hydrogen atoms, for example, $H_2$ or gases such as silanes and/or hydrogenated germanium as mentioned above, may be introduced into a deposition chamber for sputtering, followed by formation of the plasma atmosphere of said gases.

According to a preferred embodiment of the present invention, the amount of hydrogen atoms (H) or the amount of halogen atoms (X) or the sum of the amounts of hydrogen atoms and halogen atoms (H+X) to be contained in the light receiving layer or the first layer of the photoconductive member to be formed should preferably be 0.01 to 40 atomic %, more preferably 0.05 to 30 atomic %, most preferably 0.1 to 25 atomic %, when the light receiving layer or the first layer is constituted of a-SiGe(H,X).

When the light receiving layer or a first layer is constituted of the first layer region (G) and the second layer region (S), the amount of hydrogen atoms, the amount of halogen atoms or the sum (H+X) of the amounts of hydrogen atoms and halogen atoms to be contained in the first layer region (G) formed should preferably be 0.01 to 40 atomic %, more preferably 0.05 to 30 atomic %, most preferably 0.1 to 25 atomic %, while the amount of hydrogen atoms, the amount of halogen atoms or the sum (H+X) of hydrogen atoms and halogen atoms to be contained in the second layer region (S) should preferably be 1 to 40 atomic %, more preferably 5 to 30 atomic %, most preferably 5 to 25 atomic %.

For controlling the amount of hydrogen atoms (H) and/or halogen atoms (X) to be contained in the light receivng layer or the first layer for example, the substrate temperature and/or the amount of the starting materials used for incorporation of hydrogen atoms (H) or halogen atoms (X) to be introduced into the deposition device system, discharging power, etc. may be controlled.

In the present invention, for provision of the layer region (C) containing carbon atoms in the light receiving layer or the first layer, a starting material for introduction of carbon atoms may be used together with the starting material for formation of the light receiving layer or the first layer as mentioned above during formation of the light receiving layer or the first layer and may be incorporated in the layer formed while controlling their amounts.

When the glow discharge method is to be employed for formation of the layer region (C), the starting material as the starting gas for formation of the layer region (C) may be constituted by adding a starting material for introduction of carbon atoms to the starting material selected as desired from those for formation of the light receiving layer or the first layer as mentioned above. As such a starting material for introduction of carbon atoms, there may be employed most of gaseous or gasifiable substances containing at least carbon atoms as constituent atoms.

The starting gas effectively used for introduction of the carbon atoms may include compounds containing C and H as constituent atoms such as saturated hydrocarbons containing 1 to 5 carbon atoms, ethylenic hydrocarbons having 2 to 5 carbon atoms, acetylenic hydrocarbons having 2 to 4 carbon atoms.

More specifically, there may be included, as saturated hydrocarbons, methane ($CH_4$), ethane ($C_2H_6$), propane ($C_3H_8$), n-butane (n-$C_4H_{10}$), pentane ($C_5H_{12}$); as ethylenic hydrocarbons, ethylene ($C_2H_4$), propylene ($C_3H_6$), butene-1 ($C_4H_8$), butene-2 ($C_4H_8$), isobutylene ($C_4H_8$), pentene ($C_5H_{10}$); as acetylenic hydrocarbons, acetylene ($C_2H_2$), methyl acetyllene ($C_3H_4$), butyne ($C_4H_6$).

Otherwise, as the starting gas containing Si, C and H as constituent atoms it is also possible to use alkyl silanes such as $Si(CH_3)_4$, $Si(C_2H_5)_4$, etc.

In the present invention, for further promoting the effect obtained by carbon atoms, it is possible to incorporate oxygen atoms and/or nitrogen atoms in addition to carbon atoms in the layer region (C). The starting gas for introduction of oxygen atoms in the layer region (C) may include, for example, oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane ($H_3SiOSiH_3$), trisiloxane ($H_3SiOSiH_2OSiH_3$), and the like.

The starting material effectively used as the starting gas for introduction of nitrogen atoms (N) to be used during formation of the layer region (C), it is possible to use compounds containing N as constituent atom or compounds containing N and H as constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), dinitrogen tetrafluoride ($F_4N_2$) and the like.

For formation of the layer region (C) containing carbon atoms during formation of the light receiving layer or the first layer according to the sputtering method, a single crystalline or polycrystalline Si wafer or C wafer or a wafer containing Si and C mixed therein may be employed and sputtering of these wafers may be conducted in various gas atmospheres.

For example, when Si wafer is employed as the target, a starting gas for introduction of carbon atoms optionally together with a starting gas for introduction of hydrogen atoms and/or halogen atoms, which may optionally be diluted with a diluting gas, may be introduced into a deposition chamber for sputtering to form gas plasma of these gases, in which sputtering of the aforesaid Si wafer may be effected.

Alternatively, by use of separate targets of Si and C or one sheet of a target containing Si and C mixed therein, sputtering may be effected in an atmosphere of a diluting gas as a gas for sputtering or in a gas atmosphere containing at least hydrogen atoms (H) and/or halogen atoms (X) as constituent atoms. As the starting gas for introduction of carbon atoms, there may be employed the starting gases shown as examples in the glow discharge method previously described also as effective gases in case of sputtering.

In the present invention, when providing a layer region (C) containing carbon atoms during formation of the light receiving layer or the first layer, formation of the layer region (C) having a desired distribution state in the direction of layer thickness (depth profile) by varying stepwise the content C(C) of carbon atoms contained in said layer region (C) may be conducted in case of glow discharge by introducing a starting gas for introduction of carbon atoms of which the content C(C) is to be varied into a deposition chamber, while varying suitably its gas flow rate according to a desired change rate curve. For example, by the manual method or any other method conventionally used such as an externally driven motor, etc., the opening of certain needle valve provided in the course of the gas flow channel system may be gradually varied. During this procedure, the rate of variation is not necessarily required to be linear, but the flow rate may be controlled according to a variation rate curve previously designed by means of, for example, a microcomputer to give a desired content curve.

In case when the layer region (C) is formed by the sputtering method, formation of a desired depth profile of carbon atoms in the direction of layer thickness by varying stepwise the content C(C) of carbon atoms in the direction of layer thickness may be performed first similarly as in case of the glow discharge method by employing a starting material for introduction of carbon atoms under gaseous state and varying suitably as desired the gas flow rate of said gas when introduced into the deposition chamber.

Secondly, formation of such a depth profile can also be achieved by previously changing the composition of a target for sputtering. For example, when a target comprising a mixture of Si and C is to be used, the mixing ratio of Si to C may be varied in the direction of layer thickness of the target.

For incorporating a substance for controlling conductivity such as the group III atoms or the group V atoms structurally into the light receiving layer or the first layer, a starting material for introduction of the group III atoms or a starting material for introduction of the group V atoms may be introduced under gaseous state into a deposition chamber together with the starting materials for formation of the light receiving layer or the first layer during layer formation. As the starting material which can be used for introduction of the group III atoms, it is desirable to use those which are gaseous at room temperature under atmospheric pressure or can readily be gasified at least under layer forming conditions. Typical examples of such starting materials for introduction of the group III atoms, there may be included as the compounds for introduction of boron atoms boron hydrides such as $B_2H_6$, $B_4H_{10}$, $B_5H_9$, $B_5H_{11}$, $B_6H_{10}$, $B_6H_{12}$, $B_6H_{14}$, etc. and boron halides such as $BF_3$, $BCl_3$, $BBr_3$, etc. Otherwise, it is also possible to use $AlCl_3$, $GaCl_3$, $Ga(CH_3)_3$, $InCl_3$, $TlCl_3$ and the like.

The starting materials which can effectively be used in the present invention for introduction of the group V atoms may include, for introduction of phosphorus atoms, phosphorus hydride such as $PH_3$, $P_2H_4$, etc., phosphorus halides such as $PH_4I$, $PF_3$, $PF_5$, $PCl_3$, $PCl_5$, $PBr_3$, $PBr_5$, $PI_3$ and the like. Otherwise, it is also possible to utilize $AsH_3$, $AsF_3$, $AsCl_3$, $AsBr_3$, $AsF_5$, $AsH_3$, $SbF_3$, $SbF_5$, $SbCl_3$, $SbCl_5$, $BiH_3$, $BiCl_3$, $BiBr_3$ and the like effectively as the starting material for introduction of the group V atoms.

In the present invention, the layer thickness of the layer region constituting the light receiving layer or the first layer and containing a substance (C) for controlling conductivity provided locally on the substrate side may be suitably be determined depending on the characteristics required for said layer region and other layer regions constituting the light receiving layer or the first layer provided on said layer region, but its lower limit may preferably 30Å or more, more preferably 40Å or more, most preferably 50Å or more.

When the content of the substance (C) for controlling conductivity contained in the above layer region is made 30 atomic ppm or more, the upper limit of the layer thickness of said layer region may preferably be 10μ or less, more preferably 8μ or less, most preferably 5μ or less.

In the photoconductive member of the present invention, when the light receiving layer formed on the substrate is made to have a layer constitution in which a first layer comprising a-SiGe(H,X) and containing carbon atoms as already described, or a first layer comprising a first layer region (G) comprising a-Ge(Si,H,X) and a second layer region (S) comprising a-Si(H,X) provided successively from the substrate side and containing carbon atoms, and a second layer laminated on the first layer, the second layer has a free surface and is provided for accomplishing the objects of the present invention primarily in humidity resistance, continuous repeated use characteristic, dielectric strength, use environment characteristic and durability.

The second layer is constituted of an amorphous material containing at least one of nitrogen atoms and oxygen atoms in a matrix of silicon atoms.

The above amorphous material constituting the second layer may include an amorphous material containing silicon atoms (Si) and nitrogen atoms (N), optionally together with hydrogen atoms (H) and/or halogen atoms (X) (hereinafter written as "a-$(Si_xN_{1-x})_y(H,X)_{1-y}$", wherein $0<x$, $y<1$) as one preferable example.

Formation of the second layer constituted of a-$(Si_xN_{1-x})_y(H,X)_{1-y}$ may be performed according to the glow discharge method, the sputtering method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of nitrogen atoms and halogen atoms with silicon atoms into the second layer to be prepared, there may preferably be employed the glow discharge method or the sputtering method.

Further, in the present invention, the glow discharge method and the sputtering method may be used in combination in the same device system to form the second layer.

For formation of the second layer according to the glow discharge method, starting gases for formation of a-$(Si_xN_{1-x})_y(H,X)_{1-y}$, which may optionally be mixed with a diluting gas at a predetermined mixing ratio, may be introduced into a deposition chamber for vacuum deposition in which a substrate is placed, and glow discharge is excited in said deposition chamber to form the gases introduced into a gas plasma, thereby depositing a-$(Si_xN_{1-x})_y(H,X)_{1-y}$ on the first layer already formed on the substrate.

In the present invention, as starting gases for formation of a-$(Si_xN_{1-x})_y(H,X)_{1-y}$, there may be employed most of substances containing at least one of silicon atoms (Si), nitrogen atoms (N), hydrogen atoms (H) and halogen atoms (X) as constituent atoms which are gaseous or gasified substances or readily gasifiable ones.

For example, when employing a starting gas containing Si as constituent atom as one of Si, N, H and X, a mixture of a starting gas containing Si as constituent atom, a starting gas containing N as constituent atom and optionally a starting gas containing H as constituent atom and/or a starting gas containing X as constituent atom at a desired mixing ratio, or a mixture of a starting gas containing Si as constituent atom and a starting gas containing N and H and/or a starting gas containing N and X as constituent atoms also at a desired ratio, or a mixture of a starting gas containing Si as constituent atom and a starting gas containing three constituent atoms of Si, N and H or a starting gas containing three constituent atoms of Si, N and X may be used.

Alternatively, it is also possible to use a mixture of a starting gas containing Si and H as constituent atoms with a starting gas containing N as constituent atom or a mixture of a starting gas containing Si and X as constituent atoms and a starting gas containing N as constituent atom.

In the present invention, suitable halogen atoms (X) contained in the second layer are F, Cl, Br and I, particularly preferably F and Cl.

In the present invention, the starting gases which can be effectively used for formation of the second layer may include gaseous or readily gasifiabe substances at normal temperature and normal pressure.

Formation of the second layer by the use of the above amorphous material may be performed according to the glow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of nitrogen atoms optionally together with hydrogen atoms and halogen atoms with silicon atoms into the second layer to be prepared, there may preferably be employed the glow discharge method or the sputtering method.

Further, in the present invention, the glow discharge method and the sputtering method may be used in combination in the same device system to form the second layer.

For formation of the second layer constituted of a-SiN(H,X) according to the glow discharge method, a starting gase for supplying Si capable of supplying silicon atoms (Si) and a starting gas for introduction of nitrogen atoms (N), optionally together with gases for introduction of hydrogen atoms (H) and/or halogen atoms (X), may be introduced into a deposition chamber in which a substrate is placed, and glow discharge is excited in said deposition chamber, thereby depositing the second layer constituted of a-SiN(H,X) on the first layer already formed on the substrate.

Formation of the second layer according to the sputtering method may be practiced as follows.

In the first place, when a target constituted of Si is subjected to sputtering in an atmosphere of an inert gas such as Ar, He, etc. or a gas mixture based on these gases, a starting gas for introduction of nitrogen atoms (N) may be introduced, optionally together with starting gases for introduction of hydrogen atoms (H) and/or halogen atoms (X), into a vacuum deposition chamber for carrying out sputtering.

In the second place, nitrogen atoms (N) can be introduced into the second layer formed by use of a target constituted of $Si_3N_4$, or two sheets of targets of a target constituted of Si and a target constituted of $Si_3N_4$, or a target constituted of Si and $Si_3N_4$. In this case, if the starting gas for introduction of nitrogen atoms (N) as mentioned above are used in combination, the amount of nitrogen atoms (N) to be incorporated in the second layer can easily be controlled as desired by controlling the flow rate thereof.

The amount of nitrogen atoms (N) to be incorporated into the second layer can be controlled as desired by controlling the flow rate of the starting gas for introduction of nitrogen atoms (N), adjusting the ratio of nitrogen atoms (N) in the target for introduction of nitrogen atoms during preparation of the target, or performing both of these.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

By use of these starting materials, H can also be incorporated in the second layer formed by adequate choice of the layer forming conditions.

As the starting materials effectively used for supplying Si, in addition to hydrogenated silicon as mentioned above, there may be included silicon compounds containing halogen atoms (X), namely the so called silane derivatives substituted with halogen atoms, including halogenated silicon such as $SiF_4$, $Si_2F_6$, $SiCl_4$, $SiBr_4$ as preferable ones.

Further, halides containing hydrogen atom as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_3Br$, $SiH_2Br_2$, $SiHBr_3$, etc. may also be mentioned as the effective starting materials for supplying Si for formation of the second layer.

Also, in the case of employing a silicon compound containing halogen atoms (X), X can be introduced together with Si in the second layer formed by suitable choice of the layer forming conditions as mentioned above.

Among these substances, halides containing hydrogen atoms can preferably be used as the starting material for introduction of halogens, because hydrogen atoms, which are very effective for controlling electrical or photoelectric characteristics, can be introduced into the layer simultaneously with introduction of halogen atoms during formation of the second layer.

Effective starting materials to be used as the starting gases for introduction of halogen atoms (X) in formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc.; hydrogen halides such as FH, HCl, HBr and HI.

The starting material effectively used as the starting gas for introduction of nitrogen atoms (N) to be used during formation of the second layer, it is possible to use compounds containing N as constituent atom or compounds containing N and H as constituent atoms, such as gaseous or gasifiable nitrogen compounds, nitrides and azides, including for example, nitrogen ($N_2$), ammonia ($NH_3$), hydrazine ($H_2NNH_2$), hydrogen azide ($HN_3$), ammonium azide ($NH_4N_3$) and so on. Alternatively, for the advantage of introducing halogen atoms (X) in addition to nitrogen atoms (N), there may be also employed nitrogen halide compounds such as nitrogen trifluoride ($F_3N$), nitrogen tetrafluoride ($F_4N_2$) and the like.

In the present invention, as the diluting gas to be used in formation of the second layer by the glow discharge method or the sputtering method, there may be included the so called rare gases such as He, Ne and Ar as preferable ones.

The second layer in the present invention should be carefully formed so that the required characteristics may be given exactly as desired.

That is, the above material containing Si and N, optionally together with H and/or X as constituent atoms can take various forms from crystalline to amorphous, electrical properties from conductive through semiconductive to insulating and show photoconductive properties from photoconductive to nonphotoconductive depending on the preparation conditions. Therefore, in the present invention, the preparation conditions are strictly selected as desired so that there may be formed a-$(Si_xN_{1-x})_y(H,X)_{1-y}$ having desired characteristics depending on the purpose. For example, when the second layer is to be provided primarily for the purpose of improvement of dielectric strength, the a-$(Si_xN_{1-x})_y(H,X)_{1-y}$ is prepared as an amorphous material having marked electric insulating behaviours under the use environment.

Alternatively, when the primary purpose for provision of the second layer is improvement of continuous repeated use characteristics or environmental use characteristics, the degree of the above electric insulating property may be alleviated to some extent and the aforesaid a-$(Si_xN_{1-x})_y(H,X)_{1-y}$ may be prepared as an amorphous material having sensitivity to some extent to the light irradiated.

In forming the second layer comprising a-$(Si_xN_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that the a-$(Si_xN_{1-x})_y(H,X)_{1-y}$ having intended characteristics may be prepared as desired.

As the substrate temperature in forming the second layer for accomplishing effectively the objects in the present invention, there may be selected suitably the optimum temperature range in conformity with the method for forming the second layer in carrying out formation of the second layer, preferably 20° to 400° C., more preferably 50° to 350° C., most preferably 100° to 300° C. For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to these layer forming methods, the discharging power during layer formation is one of important factors influencing the characteristics of the a-$(Si_xN_{1-x})_y$ $(H,X)_{1-y}$ to be prepared, similarly as the aforesaid substrate temperature.

The discharging power condition for preparing effectively a-$(Si_xN_{1-x})_y(H,X)_{1-y}$ having characteristics for accomplishing the objects of the present invention with good productivity may preferably be 1.0 to 300 W, more preferably 2.0 to 250 W, most preferably 5.0 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second layer. However, these factors for layer formation should not be determined separately independently of each other, but it is desirable that the optimum values of respective layer forming factors should be determined based on mutual organic relationships so that the second layer having desired characteristics may be formed.

The content of nitrogen atoms in the second layer in the photoconductive member of the present invention are important factors for obtaining the desired characteristics to accomplish the objects of the present invention, similarly as the conditions for preparation of the second layer. The content of nitrogen atoms contained in the second layer in the present invention are determined as desired depending on the amorphous material constituting the second layer and its characteristics.

More specifically, the amorphous material represented by the above formula a-$(Si_xN_{1-x})_y(H,X)_{1-y}$ may be broadly classified into an amorphous material constituted of silicon atoms and nitrogen atoms (hereinafter written as "a-$Si_aN_{1-a}$", where $0<a<1$), an amorphous material constituted of silicon atoms, nitrogen atoms and hydrogen atoms (hereinafter written as a-$(Si_bN_{1-b})_cH_{1-c}$, where $0<b$, $c<1$) and an amorphous material constituted of silicon atoms, nitrogen atoms, halogen atoms and optionally hydrogen atoms (hereinafter written as "a-$(Si_dN_{1-d})_e(X,H)_{1-e}$", where $0<d, e<1$).

In the present invention, when the second layer is to be constituted of a-$Si_aN_{1-a}$, the content of nitrogen atoms in the second layer may generally be $1\times10^{-3}$ to 60 atomic %, more preferably 1 to 50 atomic %, most preferably 10 to 45 atomic %, namely in terms of representation by a in the above a-$Si_aN_{1-a}$, a being preferably 0.4 to 0.99999, more preferably 0.5 to 0.99, most preferably 0.55 to 0.9.

In the present invention, when the second layer is to be constituted of a-$(Si_bN_{1-b})_cH_{1-c}$, the content of nitrogen atoms in the second layer may preferably be $1\times10^{-3}$ to 55 atomic %, more preferably 1 to 55 atomic %, most preferably 10 to 55 atomic %, the content of hydrogen atoms preferably 1 to 40 atomic %, more preferably 2 to 35 atomic %, most preferably 5 to 30 atomic %, and the photoconductive member formed when the hydrogen content is within these ranges can be sufficiently applicable as excellent one in practical aspect.

That is, in terms of the representation by the above a-$(Si_bN_{1-b})_cH_{1-c}$, b should preferably be 0.45 to 0.99999, more preferably 0.45 to 0.99, most preferably 0.45 to 0.9, and c preferably 0.6 to 0.99, more preferably 0.65 to 0.98, most preferably 0.7 to 0.95.

When the second layer to be constituted of a-$(Si_dN_{1-d})_e(H,X)_{1-e}$, the content of nitrogen atoms in the second layer may preferably be $1\times10^{-3}$ to 60 atomic %, more preferably 1 to 60 atomic %, most preferably 10 to 55 atomic %, the content of halogen atoms preferably 1 to 20 atomic %, more preferably 1 to 18 atomic %, most preferably 2 to 15 atomic %. When the content of halogen atoms is within these ranges, the photoconductive member prepared is sufficiently applicable in practical aspect. The content of hydrogen atoms optionally contained may preferably be 19 atomic % or less, more preferably 13 atomic % or less.

That is in terms of representation by d and e in the above a-$(Si_dN_{1-d})_e(H,X)_{1-e}$, d should preferably be 0.4 to 0.99999, more preferably 0.4 to 0.99, most preferably 0.45 to 0.9, and e preferably 0.8 to 0.99, more preferably 0.82 to 0.99, most preferably 0.85 to 0.98.

The layer thickness of the second layer is also required to be determined as desired suitably with due considerations about the relationships with the contents of nitrogen atoms, the relationship with the layer thickness of the first layer, as well as other organic relationships with the characteristics required for respective layer regions.

In addition, it is also desirable to have considerations from economical point of view such as productivity or capability of bulk production.

The second layer (II) in the present invention is desired to have a layer thickness preferably of 0.003 to 30 μ, more preferably 0.004 to 20μ, most preferably 0.005 to 10μ.

Next, another preferable example for constitution of the second layer is an amorphous material containing silicon atoms (Si) and oxygen atoms (0), optionally together with hydrogen atoms (H) and/or halogen atoms (X) (hereinafter written as "a-$Si_xO_{1-x})_y$ $(H,X)_{1-y}$", wherein $0<x, y<1$).

Formation of the second layer constituted of a-$(Si_xO_{1-x})_y(H,X)_{1-y}$ may be performed according to the glow discharge method, the sputtering method, the ion implantation method, the ion plating method, the electron beam method, etc. These preparation methods may be suitably selected depending on various factors such as the preparation conditions, the extent of the load for capital investment for installations, the production scale, the desirable characteristics required for the photoconductive member to be prepared, etc. For the advantages of relatively easy control of the preparation conditions for preparing photoconductive members having desired characteristics and easy introduction of oxygen atoms and halogen atoms with silicon atoms into the second layer to be prepared, there may preferably be employed the glow discharge method or the sputtering method.

Further, in the present invention, the glow discharge method and the sputtering method may be used in combination in the same device system to form the second layer.

For formation of the second layer according to the glow discharge method, starting gases for formation of a-$(Si_xO_{1-x})_y(H,X)_{1-y}$, which may optionally be mixed with a diluting gas at a predetermined mixing ratio, may be introduced into a deposition chamber for vacuum deposition in which a substrate is placed, and glow discharge is excited in said deposition chamber to form the gases introduced into a gas plasma, thereby depositing a-$(Si_xO_{1-x})_y(H,X)_{1-y}$ on the first layer already formed on the substrate.

In the present invention, as starting gases for formation of a-$(Si_xO_{1-x})_y(H,X)_{1-y}$, there may be employed most of substances containing at least one of silicon atoms (Si), oxygen atoms (O), hydrogen atoms (H) and halogen atoms (X) as constituent atoms which are gaseous or gasified substances of readily gasifiable ones.

For example, when employing a starting gas containing Si as constituent atom as one of Si, O, H and X, it is possible to use a mixture of a starting gas containing Si as constituent atom, a starting gas containing O as constituent atom and optionally a starting gas containing H as constituent atom and/or a starting gas containing X as constituent atom at a desired mixing ratio, or a mixture of a starting gas containing Si as constituent atom and a starting gas containing O and H as constituent atoms and/or a starting gas containing O and X as constituent atoms also at a desired ratio, or a mixture of a starting gas containing Si as constituent atom and a starting gas containing three constituent atoms of Si, O and H or a starting gas containing three constituent atoms of Si, O and X.

Alternatively, it is also possible to use a mixture of a starting gas containing Si and H as constituent atoms with a starting gas containing O as constituent atom or a mixture of a starting gas containing Si and X as constituent atoms and a starting gas containing O as constituent atom.

In the present invention, suitable halogen atoms (X) contained in the second layer are F, Cl, Br and I, particularly preferably F and Cl.

In the present invention, the starting gases which can be effectively used for formation of the second layer may include gaseous or readily gasifiable substances at normal temperature and normal pressure.

Formation of the second layer according to the sputtering method may be practiced as follows.

In the first place, when a target constituted of Si is subjected to sputtering in an atmosphere of an inert gas such as Ar, He, etc. or a gas mixture based on these gases, a starting gas for introduction of oxygen atoms (O) may be introduced, optionally together with starting gases for introduction of hydrogen atoms (H) and- /or halogen atoms (X), into a vacuum deposition chamber for carrying out sputtering.

In the second place, oxygen atoms (O) can be introduced into the second layer formed by use of a target constituted of $SiO_2$, or two sheets of targets of a target constituted of Si and a target constituted of $SiO_2$, or a target constituted of Si and $SiO_2$. In this case, if the starting gas for introduction of atoms (O) as mentioned above is used in combination with these targets, the amount of oxygen atoms (O) to be incorporated in the second layer can easily be controlled as desired by controlling the flow rate thereof.

The amount of oxygen atoms (O) to be incorporated into the second layer can be controlled as desired by controlling the flow rate of the starting gas for introduction of oxygen atoms (O), adjusting the ratio of oxygen atoms (O) in the target for introduction of oxygen atoms during preparation of the target, or performing both of these.

The starting gas for supplying Si to be used in the present invention may include gaseous or gasifiable hydrogenated silicons (silanes) such as $SiH_4$, $Si_2H_6$, $Si_3H_8$, $Si_4H_{10}$ and others as effective materials. In particular, $SiH_4$ and $Si_2H_6$ are preferred with respect to easy handling during layer formation and efficiency for supplying Si.

By use of these starting materials, H can also be incorporated in the second layer formed by adequate choice of the layer forming conditions.

As the starting materials effectively used for supplying Si, in addition to hydrogenated silicon as mentioned above, there may be included silicon compounds containing halogen atoms (X), namely the so called silane derivatives substituted with halogen atoms, including halogenated silicon such as $SiF_4$, $Si_2F_6$, $SiCl_4$, $SiBr_4$ as preferable ones.

Further, halides containing hydrogen atom as one of the constituents, which are gaseous or gasifiable, such as halo-substituted hydrogenated silicon, including $SiH_2F_2$, $SiH_2I_2$, $SiH_2Cl_2$, $SiHCl_3$, $SiH_3Br$, $SiH_2Br_2$, $SiHBr_3$, etc. may also be mentioned as the effective starting materials for supplying Si for formation of the second layer.

Also, in the case of employing a silicon compound containing halogen atoms (X), X can be introduced together with Si in the second layer formed by suitable choice of the layer forming conditions as mentioned above.

Among these substances, halides containing hydrogen atoms can preferably be used as the starting material for introduction of halogens, because hydrogen atoms, which are very effective for controlling electrical or photoelectric characteristics, can be introduced into the layer simultaneously with introduction of halogen atoms during formation of the second layer.

Effective starting materials to be used as the starting gases for introduction of halogen atoms (X) in formation of the second layer in the present invention, there may be included, in addition to those as mentioned above, for example, halogen gases such as fluorine, chlorine, bromine and iodine; interhalogen compounds such as BrF, ClF, $ClF_3$, $BrF_5$, $BrF_3$, $IF_3$, $IF_7$, ICl, IBr, etc.; hydrogen halides such as HF, HCl, HBr and HI.

The starting material effectively used as the starting gas for introduction of oxygen atoms (O) to be used during formation of the second layer, it is possible to use compounds containing O as constituent atom or compounds containing N and O as constituent atoms, such as oxygen ($O_2$), ozone ($O_3$), nitrogen monoxide (NO), nitrogen dioxide ($NO_2$), dinitrogen monoxide ($N_2O$), dinitrogen trioxide ($N_2O_3$), dinitrogen tetraoxide ($N_2O_4$), dinitrogen pentaoxide ($N_2O_5$), nitrogen trioxide ($NO_3$), and lower siloxanes containing silicon atoms (Si), oxygen atoms (O) and hydrogen atoms (H) as constituent atoms such as disiloxane ($H_3SiOSiH_3$), trisiloxane ($H_3SiOSiH_2OSiH_3$), and the like.

In the present invention, as the diluting gas to be used in formation of the second layer by the glow discharge method or the sputtering method, there may be included the so called rare gases such as He, Ne and Ar as preferable ones.

The second layer in the present invention should be carefully formed so that the required characteristics may be given exactly as desired.

That is, the above material containing Si, and O, optionally together with H and/or X as constituent atoms can take various forms from crystalline to amorphous and show electrical properties from conductive through semiconductive to insulating and photoconductive properties from photoconductive to non-photoconductive depending on the preparation conditions. Therefore, in the present invention, the preparation conditions are strictly selected as desired so that there may be formed a-$(Si_xO_{1-x})_y(H,X)_{1-y}$ having desired characteristics depending on the purpose. For example, when the second layer is to be provided primarily for the purpose of improvement of dielectric strength, the aforesaid a-$(Si_xO_{1-x})_y(H,X)_{1-y}$ are prepared as an amorphous material having marked electric insulating behaviours under the use environment.

Alternatively, when the primary purpose for provision of the second layer is improvement of continuous repeated use characteristics or environmental use characteristics, the degree of the above electric insulating property may be alleviated to some extent and the aforesaid a-$(Si_xO_{1-x})_y(H,X)_{1-y}$ may be prepared as an amorphous material having sensitivity to some extent to the light irradiated.

In forming the second layer constituted of a-$(Si_xO_{1-x})_y(H,X)_{1-y}$ on the surface of the first layer, the substrate temperature during layer formation is an important factor having influences on the structure and the characteristics of the layer to be formed, and it is desired in the present invention to control severely the substrate temperature during layer formation so that a-$(Si_xO_{1-x})_y(H,X)_{1-y}$ having intended characteristics may be prepared as desired.

As the substrate temperature in forming the second layer for accomplishing effectively the objects in the present invention, there may be selected suitably the optimum temperature range in conformity with the method for forming the second layer in carrying out formation of the second layer, preferably 20° to 400° C., more preferably 50° to 350° C., most preferably 100° to 300° C. For formation of the second layer, the glow discharge method or the sputtering method may be advantageously adopted, because severe control of the composition ratio of atoms constituting the layer or control of layer thickness can be conducted with relative ease as compared with other methods. In case when the second layer is to be formed according to those layer forming methods, the discharging power during layer formation is one of important factors influencing the characteristics of a-$(Si_xO_{1-x})_y(H,X)_{1-y}$ to be prepared, similarly as the aforesaid substrate temperature.

The discharging power condition for preparing effectively a-$(Si_xO_{1-x})_y(H,X)_{1-y}$ having characteristics for accomplishing the objects of the present invention with good productivity may preferably be 1.0 to 300 W, more preferably 2.0 to 250 W, most preferably 5.0 to 200 W.

The gas pressure in a deposition chamber may preferably be 0.01 to 1 Torr, more preferably 0.1 to 0.5 Torr.

In the present invention, the above numerical ranges may be mentioned as preferable numerical ranges for the substrate temperature, discharging power for preparation of the second layer. However, these factors for layer formation should not be determined separately independently of each other, but it is desirable that the optimum values of respectively layer forming factors should be determined base on mutual organic relationships so that a-$(Si_xO_{1-x})_y(H,X)_{1-y}$ having desired characteristics may be formed.

The content of oxygen atoms in the second layer in the photoconductive member of the present invention are important factors for obtaining the desired characteristics to accomplish the objects of the present invention, similarly as the conditions for preparation of the second layer. The content of oxygen atoms contained in the second layer in the present invention are determined as desired depending on the amorphous material constituting the second layer and its characteristics.

More specifically, the amorphous material represented by the above formula a-$(Si_xO_{1-x})_y(H,X)_{1-y}$ may be broadly classified into an amorphous material constituted of silicon atoms and oxygen atoms (hereinafter written as "a-$Si_aO_{1-a}$", where $0<a<1$), an amorphous material constituted of silicon atoms, oxygen atoms and hydrogen atoms (hereinafter written as a-$(Si_bO_{1-b})_cH_{1-c}$, where $0<b, c<1$) and an amorphous material constituted of silicon atoms, oxygen atoms, halogen atoms and optionally together with hydrogen atoms (hereinafter written as "a-$(Si_dO_{1-d})_e(H,X)_{1-e}$", where $0<d, e<1$).

In the present invention, when the second layer is to be constituted of a-$Si_aO_{1-a}$, the content of oxygen atoms in the second layer may preferably be 0.33 to 0.99999, more preferably 0.5 to 0.99, most preferably 0.6 to 0.9, in terms of a in the above formula a-$Si_aO_{1-a}$.

In the present invention, when the second layer is to be constituted of a-$(Si_bO_{1-b})_cH_{1-c}$, the content of oxygen atoms may preferably be such that b in the above formula a-$(Si_bO_{1-b})_cH_{1-c}$ may preferably 0.33 to 0.99999, more preferably 0.5 to 0.99, most preferably 0.6 to 0.9, and c preferably 0.6 to 0.99, more preferably 0.65 to 0.98, most preferably 0.7 to 0.95.

When the second layer is to be constituted of a-$(Si_dO_{1-d})_e(H,X)_{1-e}$, the content of oxygen atoms may preferably be such that d in the above formula a-$(Si_dO_{1-d})_e(H,X)_{1-e}$ may preferably be 0.33 to 0.99999, more preferably be 0.5 to 0.99, most preferably 0.6 to 0.9, and e preferably 0.8 to 0.99, more preferably 0.82 to 0.99, most preferably 0.85 to 0.98.

The range of the numerical value of layer thickness of the second layer should desirably be determined depending on the intended purpose so as to effectively accomplish the objects of the present invention.

The layer thickness of the second layer is also required to be determined as desired suitably with due considerations about the relationships with the contents of oxygen atoms in the layer, the relationship with the layer thickness of the first layer, as well as other organic relationships with the characteristics required for respective layer regions.

In addition, it is also desirable to have considerations from economical point of view such as productivity or capability of bulk production.

The second layer in the present invention is desired to have a layer thickness preferably of 0.003 to 30 $\mu$, more preferably 0.004 to 20 $\mu$, most preferably 0.005 to 10 $\mu$.

The substrate to be used in the present invention may be either electroconductive material or insulating material. As the electroconductive material, there may be mentioned metals such as NiCr, stainless steel, Al, Cr, Mo, Au, Nb, Ta, V, Ti, Pt, Pd, etc. or alloys thereof.

As insulating material, there may conventionally be used films or sheets of synthetic resins, including polyester, polyethylene, polycarbonate, cellulose acetate, polypropylene, polyvinyl chloride, polyvinylidene chloride, polystyrene, polyamide, etc., glasses, ceramics, papers and so on. These insulating substrates should preferably have at least one surface subjected to electroconductive treatment, and it is desirable to provide other layers on the side at which said electroconductive treatment has been applied.

For example, electroconductive treatment of a glass can be effected by providing a thin film of NiCr, Al, Cr, Mo, Au, Ir, Nb, Ta, V, Ti, Pt, Pd, $In_2O_3$, $SnO_2$, ITO ($In_2O_3+SnO_2$) thereon. Alternatively, a synthetic resin film such as polyester film can be subjected to the electroconductive treatment on its surface by vacuum vapor deposition, electron-beam deposition or sputtering of a metal such as NiCr, Al, Ag, Pb, Zn, Ni, Au, Cr, Mo, Ir, Nb, Ta, V, Ti, Pt, etc. or by laminating treatment with said metal, thereby imparting electroconductivity to the surface. The substrate may be shaped in any form such as cylinders, belts, plates or others, and its form may be determined as desired. For example, when the photoconductive member is to be used as an image forming member for electrophotography, it may desirably be formed into an endless belt or a cylinder for use in continuous high speed copying. The substrate may have a thickness, which is conveniently determined so that a photoconductive member as desired may be formed. When the photoconductive member is required to have a flexibility, the substrate is made as thin as possible, so far as the function of a substrate can be sufficiently exhibited. However, in such a case, the thickness is preferably 10 $\mu$ or more from the points of fabrication and handling of the substrate as well as its mechanical strength.

Next, an example of the process for producing the photoconductive member of this invention is to be breifly described.

Figure 19:
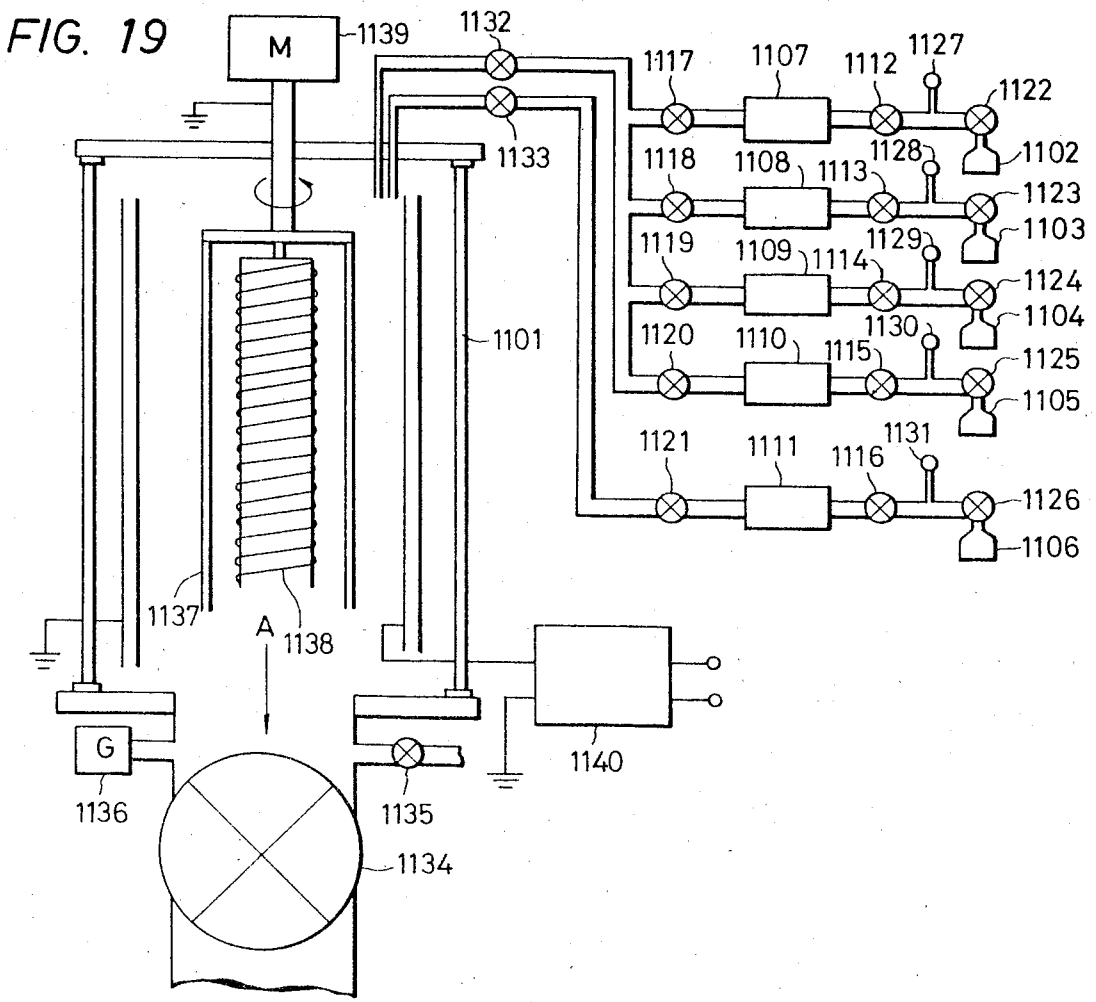
FIG. 19 is a schematic illustration of the device used in the present invention.

FIG. 19 shows one example of a device for producing a photoconductive member.

In the gas bombs 1102–1106 there are hermetically contained starting gases for formation of the photoconductive member of the present invention. For example, 1102 is a bomb containing $SiH_4$ gas diluted with He (purity: 99.999%, hereinafter abbreviated as "$SiH_4$/He"), 1103 is a bomb containing $GeH_4$ gas diluted with He (purity 99.999%, hereinafter abbreviated as "$GeH_4$/He"), 1104 is a $C_2H_4$ gas bomb (purity: 99.99%), 1105 is a He gas bomb (purity: 99,999%) and 1106 is a $H_2$ gas bomb (purity: 99.999%).

For allowing these gases to flow into the reaction chamber 1101, on confirmation of the valves 1122–1126 of the gas bombs 1102–1106 and the leak valve 1135 to be closed, and the inflow valves 1112–1116, the outflow valves 1117–1121 and the auxiliary valves 1132, 1133 to be opened, the main valve 1134 is first opened to evacuate the reaction chamber 1101 and the gas pipelines. As the next step, when the reading on the vacuum indicator 1136 becomes $5\times10^{-6}$ Torr, the auxiliary valves 1132, 1133 and the outflow valves 1117–1121 are closed.

Referring now to an example of forming a light-receiving layer region on the cylindrical substrate 1137, $SiH_4$/He gas from the gas bomb 1102, $GeH_4$/He gas from the gas bomb 1103, $C_2H_4$ gas from the gas bomb 1104 are permitted to flow into the mass-flow controllers 1107, 1108, 1109, respectively, by opening the valves 1122, 1123 and 1124 and controlling the pressure at the outlet pressure gauses 1127, 1128, 1129 to 1 kg/cm$^2$ and opening gradually the inflow valves 1112, 1113 and 1114, respectively. Subsequently, the outflow valves 1117, 1118, 1119 and the auxiliary valve 1132 are gradually opened to permit respective gases to flow into the reaction chamber 1101. The outflow valves 1117, 1118, 1119 are controlled so that the flow rate ratio of $SiH_4$/He, $GeH_4$/He and $C_2H_4$ gases may have a desired value and opening of the main valve 1134 is also controlled while watching the reading on the vacuum indicator 1136 so that the pressure in the reaction chamber may reach a desired value. And, after confirming that the temperature of the substrate 1137 is set at about 50°–400 ° C. by the heater 1138, the power source 1140 is set at a desired power to excite glow discharge in the reaction chamber 1101, and at the same time depth profiles of germanium atoms and carbon atoms contained in the layer formed are controlled by carrying out the operation to change gradually the flow rate of $GeH_4$/He gas of $C_2H_4$ gas according to the change rate curve previously designed by operation of the valves 1118 and 1119 manually or according to an externally driven motor, etc.

As described above, the light receiving layer is formed to a desired layer thickness on the substrate 1137 by maintaining the glow discharge for a desired period of time. When the light receiving layer is constituted of the first layer region (G) and the second layer region (S), at the stage when the layer region (G) is formed according to the same method and the procedure as described above to a desired thickness, and the following the same conditions and the procedure except for completely closing the outflow valve 1118 and changing the discharging conditions, if desired, glow discharging is maintained for a desired period of time, whereby the second layer region (S) containing substantially no germanium atom can be formed on the first layer region (G).

For incorporating a substance (C) for controlling the conductivity into the first layer region (G) and the second layer region (S), gases such as $B_2H_6$, $PH_3$, etc. may be added to the gases to be introduced into the deposition chamber 1101 during formation of the first layer region (G) and the second layer region (S).

When a second layer is formed on the first layer as prepared above to form a light receiving layer in combination, formation of the second layer may be conducted according to the same valve operation as in formation of the first layer.

During this operation, $NH_3$ gas bomb or NO gas bomb is newly provided or substituted for the bomb not employed, and the respective gases of $SiH_4$ gas, $NH_3$ gas or $SiH_4$ gas, NO gas may be diluted optionally with a diluting gas such as He, and the second layer can be formed by exciting glow discharge following the desired conditions.

For incorporation of halogen atoms in the second layer, for example, $SiF_4$ gas and $NH_3$ gas or $SiF_4$ gas and NO gas, or a gas mixture further added with $SiH_4$ gas, may be used to form the second layer according to the same procedure as described above.

During formation of the respective layers, outflow valves other than those for necessary gases should of course be closed. Also, during formation of respective layers, in order to avoid remaining of the gas employed for formation of the preceding layer in the reaction chamber 1101 and the gas pipelines from the outflow valves 1117–1121 to the reaction chamber 1101, the operation of evacuating the system to high vacuum by closing the outflow valves 1117–1121, opening the auxiliary valves 1132, 1133 and opening fully the main valve 1134 is conducted, if necessary.

The amount of nitrogen atoms or oxygen atoms in the second layer can be controlled as desired by, for example, in the case of glow discharge, changing the flow rate ratio of $SiH_4$ gas to $NH_3$ gas or $SiH_4$ gas to NO gas to be introduced into the reaction chamber 1101 as desired, or in the case of layer formation by sputtering, changing the sputtering area ratio of silicon wafer to silicon nitride plate or silicon wafer to $SiO_2$ plate, or molding a target with the use of a mixture of silicon powder with silicon nitride powder or $SiO_2$ powder with various mixing ratios. The content of halogen atoms (X) contained in the second layer can be controlled by controlling the flow rate of the starting gas for introduction of halogen atoms such as $SiF_4$ gas when introduced into the reaction chamber 1101.

Also, for uniformization of the layer formation, it is desirable to rotate the substrate 1137 by means of a motor 1139 at a constant speed during layer formation.

The present invention is described in more detail by referring to the following Examples.

EXAMPLE 1

By means of the device shown in FIG. 19, respective samples of image forming members for electrophotography (see Samples No. 11-1A to 13-6A in Table 2A) were prepared, respectively, on cylindrical aluminum substrates under the conditions shown in Table 1A.

Figure 21:
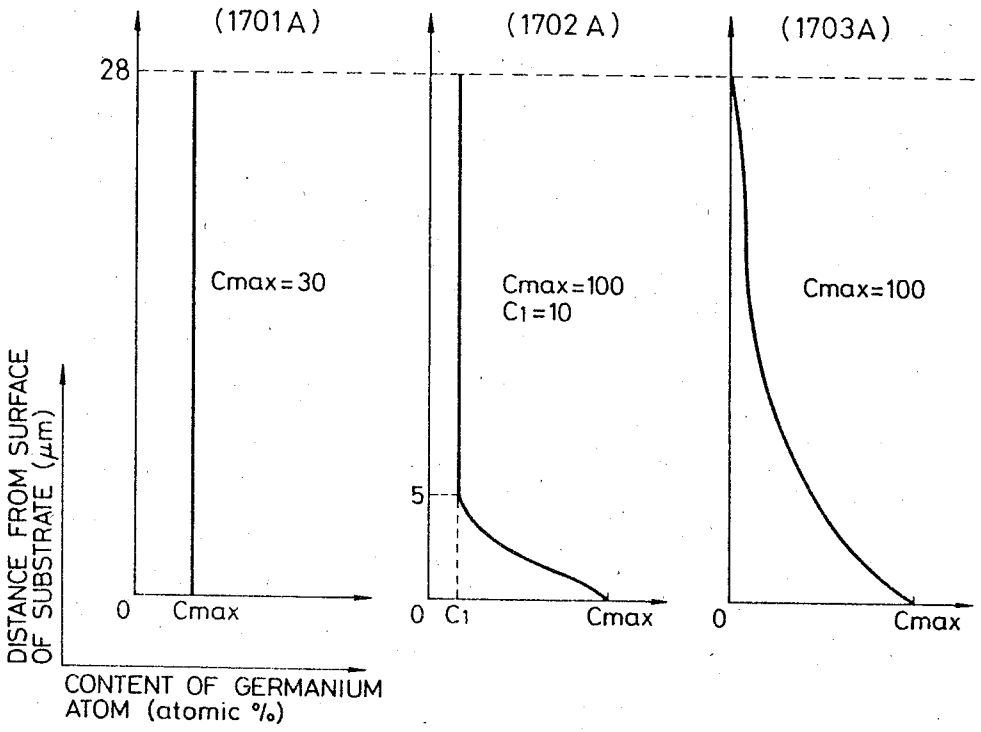
Figure 22:
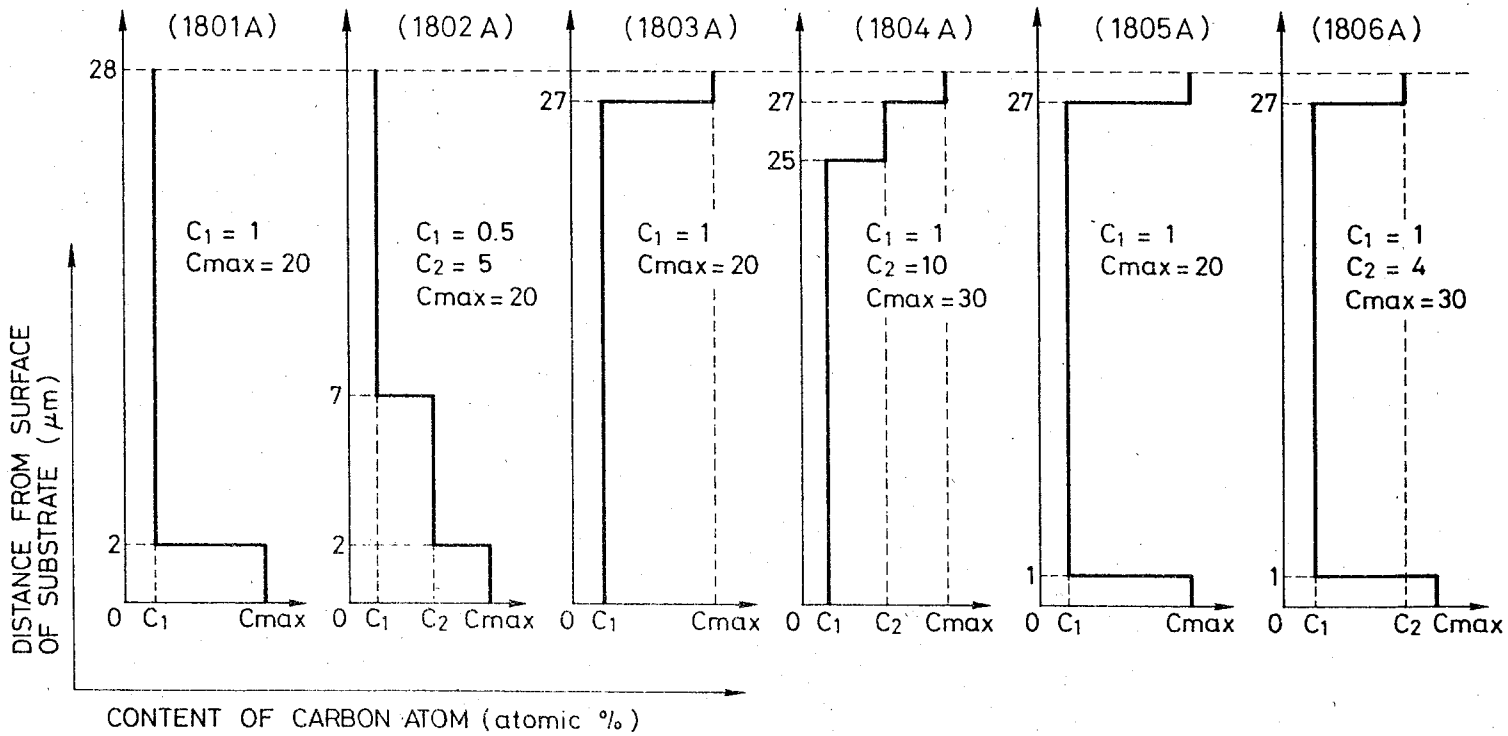

The depth profiles of germanium atoms in respective samples are shown in FIG. 21, and those of carbon atoms in FIG. 22.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image on the surface of the image forming member. When the toner image was transferred onto a transfer paper by corona charging of ⊕5.0 KV, a clear image of high density with excellent resolution and good gradation reproducibility was obtained in every sample.

The same experiments were repeated under the same toner image forming conditions as described above, except for using GaAs type semiconductor laser (10 mW) of 810 nm in place of the tungsten lamp as the light source, and image quality evaluation was performed for each sample. As the result, an image of high quality, excellent in resolution and good in gradation reproducibility, could be obtained in every sample.

EXAMPLE 2

By means of the device shown in FIG. 19, respective samples of image forming members for electrophotography (see Samples No. 21-1A to 23-6A in Table 4A) were prepared, respectively, on cylindrical aluminum substrates under the conditions shown in Table 3A).

The depth profiles of the germanium atoms in respective samples are shown in FIG. 21, and those of carbon atoms in FIG. 22.

For each of these samples, the same image evaluation test was conducted as in Example 1 to give a toner transferred image of high quality in each sample. Also, for each sample, usage test repated for 200,000 times was performed under the environment of 38° C. and 80% RH. As the result, no lowering in image quality was observed in each sample.

The common layer forming conditions in the above Examples of the present invention are shown below:

Substrate temperature: Germanium atom (Ge) containing layer . . . about 200° C.

Discharging frequency: 13.56 MHz

Inner pressure in reaction chamber during the reaction: 0.3 Torr

EXAMPLE 3

By means of the device shown in FIG. 19, respective samples of image forming members for electrophotography (see Samples No. 11-1B to 17-6B in Table 2B) were prepared, respectively, on cylindrical aluminum substrates under the conditions shown in Table 1B.

Figure 23:
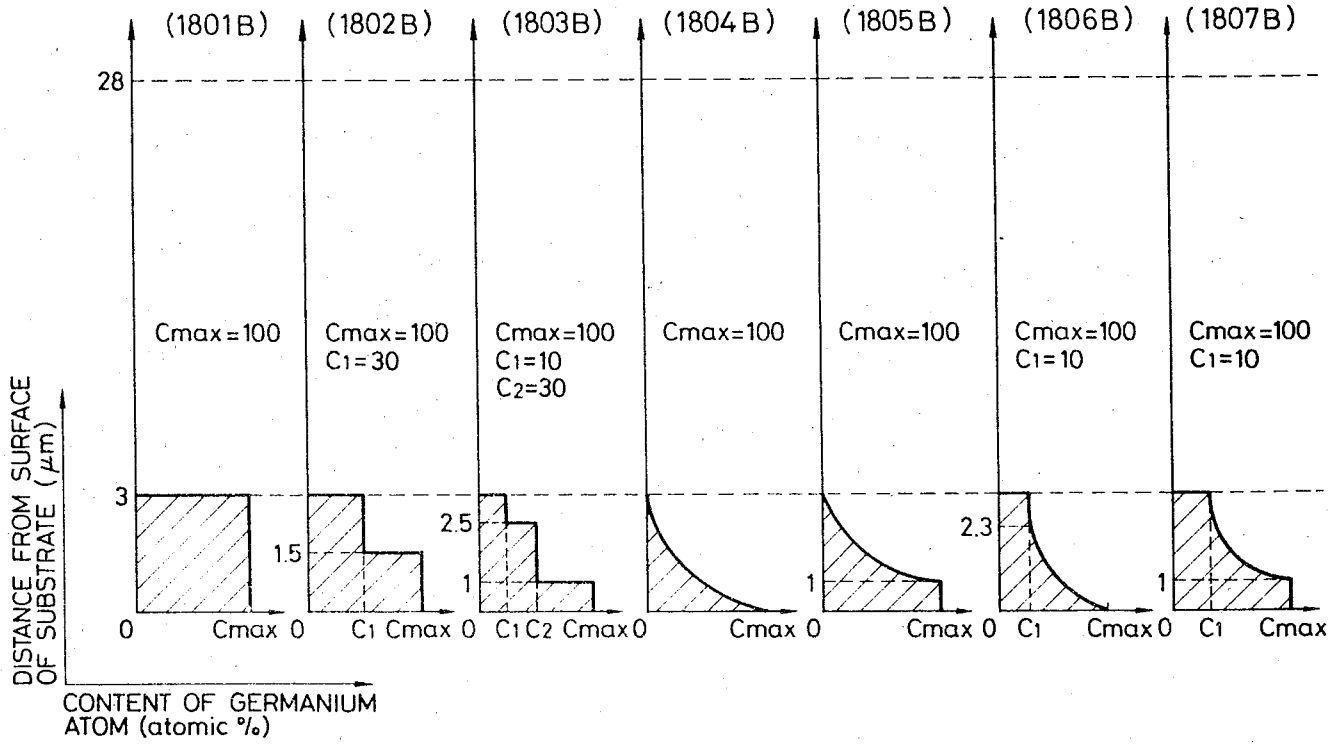
Figure 24:
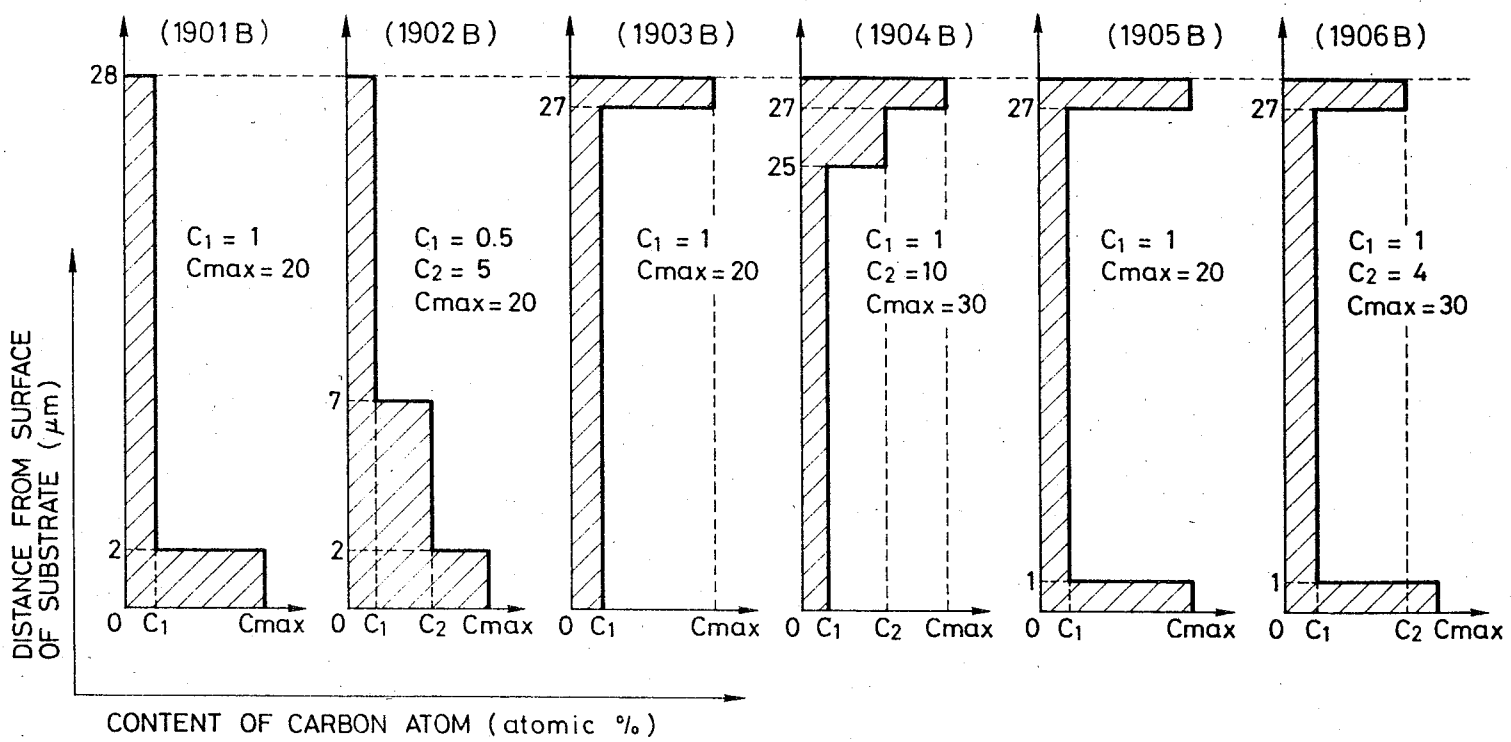

The depth profiles of germanium atoms in respective samples are shown in FIG. 23, and those of carbon atoms in FIG. 24.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image or the surface of the image forming member. When the toner image was transferred onto a transfer paper by corona charging of ⊕5.0 KV, a clear image of high density with excellent resolution and good gradation reproducibility was obtained in every sample.

The same experiments were repeated under the same toner image forming conditions as described above, except for using GaAs type semiconductor laser (10 mW) of 810 nm in place of the tungsten lamp as the light source, and image quality evaluation was performed for each sample. As the result, an image of high quality, excellent in resolution and good in gradation reproducibility, could be obtained in every sample.

EXAMPLE 4

By means of the device shown in FIG. 19, respective samples of image forming members for electrophotography (see Samples No. 21-1B to 27-6B in Table 4B) were prepared, respectively, on cylindrical aluminum substrates under the conditions shown in Table 3B.

The depth profiles of the germanium atoms in respective samples are shown in FIG. 23, and those of carbon atoms in FIG. 24.

For each of these samples, the same image evaluation test was conducted as in Example 3 to give a toner transferred image of high quality in each sample. Also, for each sample, usage test repeated for 200,000 times was performed under the environment of 38° C. and 80% RH. As the result, no lowering in image quality was observed in each sample.

The common layer forming conditions in the above Examples of the present invention are shown below:

Substrate temperature: Germanium atom (Ge) containing layer . . . about 200° C. No germanium atom (Ge) containing layer . . . about 250° C.

Discharging frequency: 13.56 MHz

Inner pressure in reaction chamber during the reaction: 0.3 Torr.

EXAMPLE 5

By means of the device shown in FIG. 19, respective samples of image forming members for electrophotography (see Samples No. 11-1C to 13-6C in Table 2C) were prepared, respectively, on cylindrical aluminum substrates under the conditions shown in Table 1C.

Figure 25:
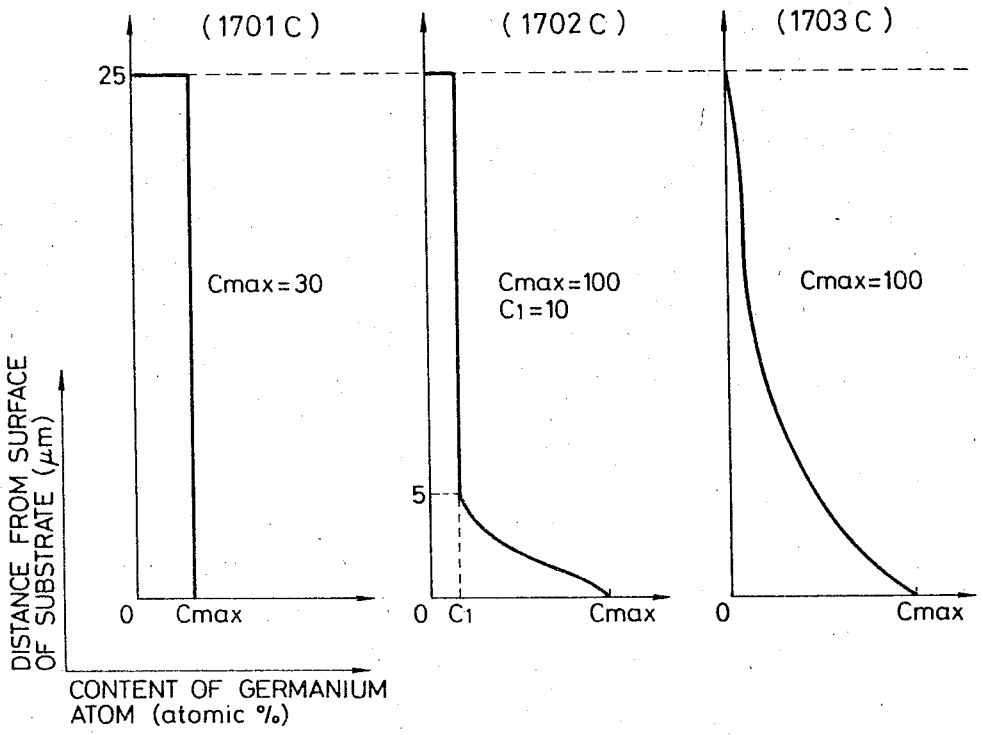
Figure 26:
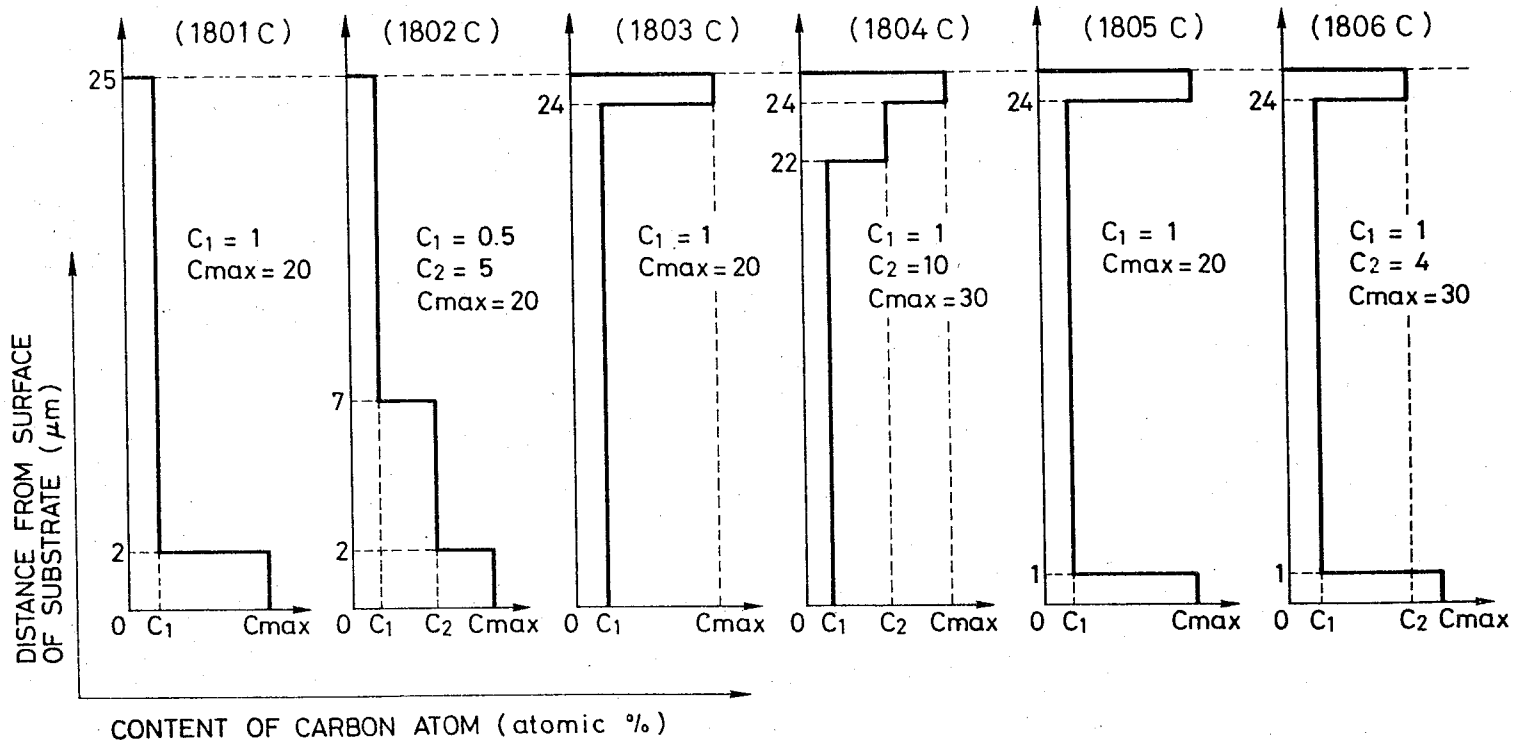

The depth profiles of germanium atoms in respective samples are shown in FIG. 25, and those of carbon atoms in FIG. 26.

Each of the samples thus obtained was set in a charg-exposure testing device and subjected to corona charging at ⊕5.0 KV for 0.3 sec., followed immediately by irradiation of a light image. The light image was irradiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image on the surface of the image forming member. When the toner image was transferred onto a transfer paper by corona charging of +5.0 KV, a clear image of high density with excellent resolution and good gradation reproducibility was obtained in every sample.

The same experiments were repeated under the same toner image forming conditions as described above, except for using GaAs type semiconductor layer (10 mW) of 810 nm in place of the tungsten lamp as the light source, and image quality evaluation was performed for each sample. As the result, an image of high quality, excellent in resolution and good in gradation reproducibility, could be obtained in every sample.

EXAMPLE 6

By means of the device shown in FIG. 19, respective samples of image forming members for electrophotography (see Samples No. 21-1C to 23-6C in Table 4C) were prepared, respectively, on cylindrical aluminum substrates under the conditions shown in Table 3C.

In Table 3C, the first layer region in the first layer (I) was formed on the aluminum substrate, and the second layer region was formed on the first layer region.

The depth profiles of the germanium atoms in respective samples are shown in FIG. 25, and those of carbon atoms in FIG. 26.

For each of these samples, the same image evaluation test was conducted as in Example 5 to give a toner transferred image of high quality in each sample. Also, for each sample, usage test repeated for 200,000 times was performed under the environment of 38° C. and 80% RH. As the result, no lowering in image quality was observed in each sample.

EXAMPLE 7

Following the same conditions and the procedure as in Sample Nos. 11-1C, 12-1C and 13-1C in Example 5, except for changing the conditions for preparation of the second layer (II) to the respective conditions as shown in Table 5C, image forming members for electrophotography were prepared, respectively (24 Samples of Sample No. 11-1-1C to 11-1-8C, 12-1-1C to 12-1-8C, 13-1-1C to 13-1-8C). The respective image forming members for electrophotography thus prepared were individually set on a copying device, and according to the condition as described in respective Examples, overall image quality and durability in continuous use were evaluated for each of the image forming members for electrophotography corresponding to respective Examples.

The results of the overall image quality evaluation and evaluation of durability by repeated continuous use for respective samples are shown in Table 6C.

EXAMPLE 8

Various image forming members were prepared according to the same method as in Sample No. 11-1C in Example 5, respectively, except for varying the content ratio of silicon atoms to nitrogen atoms in the second layer (II) by varying the target area ratio of silicon wafer to silicon nitride during formation of the second layer (II). For each of the image forming members thus obtained, the steps of image formation, developing and cleaning as described in Example 5 were repeated for about 50,000 times, and thereafter image evaluations were conducted to obtain the results as shown in Table 7C.

EXAMPLE 9

Various image forming members were prepared according to the same method as in Sample No. 12-1C in Example 5, respectively, except for varying the content ratio of silicon atoms to nitrogen atoms in the second layer (II) by varying the flow rate ratio of $SiH_4$ gas to $NH_3$ gas during formation of the second layer (II). For each of the image forming members thus obtained, the steps up to transfer were repeated for about 50,000 times according to the methods as described in Example 5, and thereafter image evaluations were conducted to obtain the results as shown in Table 8C.

EXAMPLE 10

Various image forming members were prepared according to the same method as in Sample No. 13-1C in Example 5, respectively, except for varying the content ratio of silicon atoms to nitrogen atoms in the second layer (II) by varying the flow rate ratio of $SiH_4$ gas, $SiF_4$ gas and $NH_3$ gas during formation of the second layer (II). For each of the image forming members thus obtained, the steps of image formation, developing and cleaning as described in Example 5 were repeated for about 50,000 times, and thereafter image evaluations were conducted to obtain the results as shown in Table 9C.

EXAMPLE 11

Respective image forming members were prepared in the same manner as in Sample No. 11-1C in Example 5, except for changing the layer thickness of the second layer (II), and the steps of image formation, developing and cleaning as described in Example 5 were repeated to obtain the results as shown in Table 10C.

The common layer forming conditions in the above Examples of the present invention are shown below:

Substrate temperature: Germanium atom (Ge) containing layer . . . about 200° C.

Discharging frequency: 13.56 MHz

Inner pressure in reaction chamber during the reaction: 0.3 Torr.

EXAMPLE 12

By means of the device shown in FIG. 19, respective samples of image forming members for electrophotography (see Samples No. 11-1D to 17-6D in Table 2D) were prepared, respectively, on cylindrical aluminum substrates under the conditions shown in Table 1D.

Figure 27:
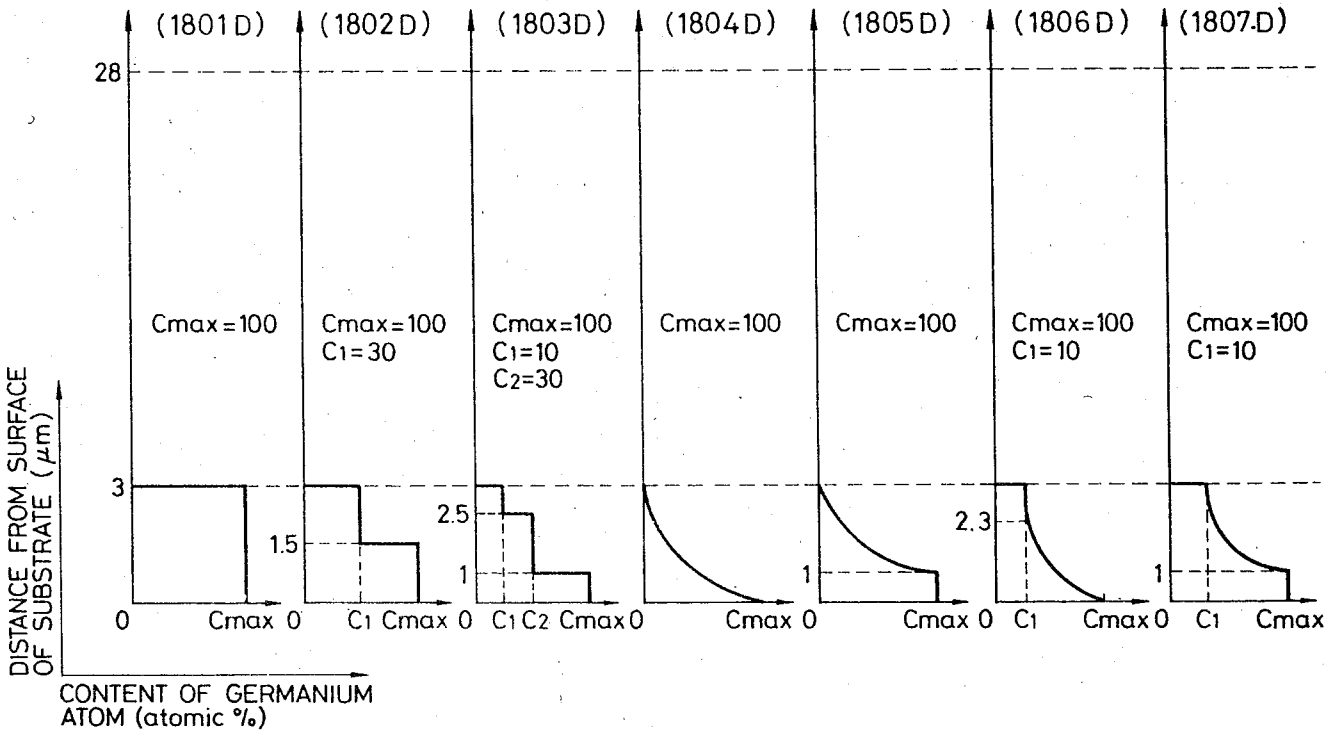
Figure 28:
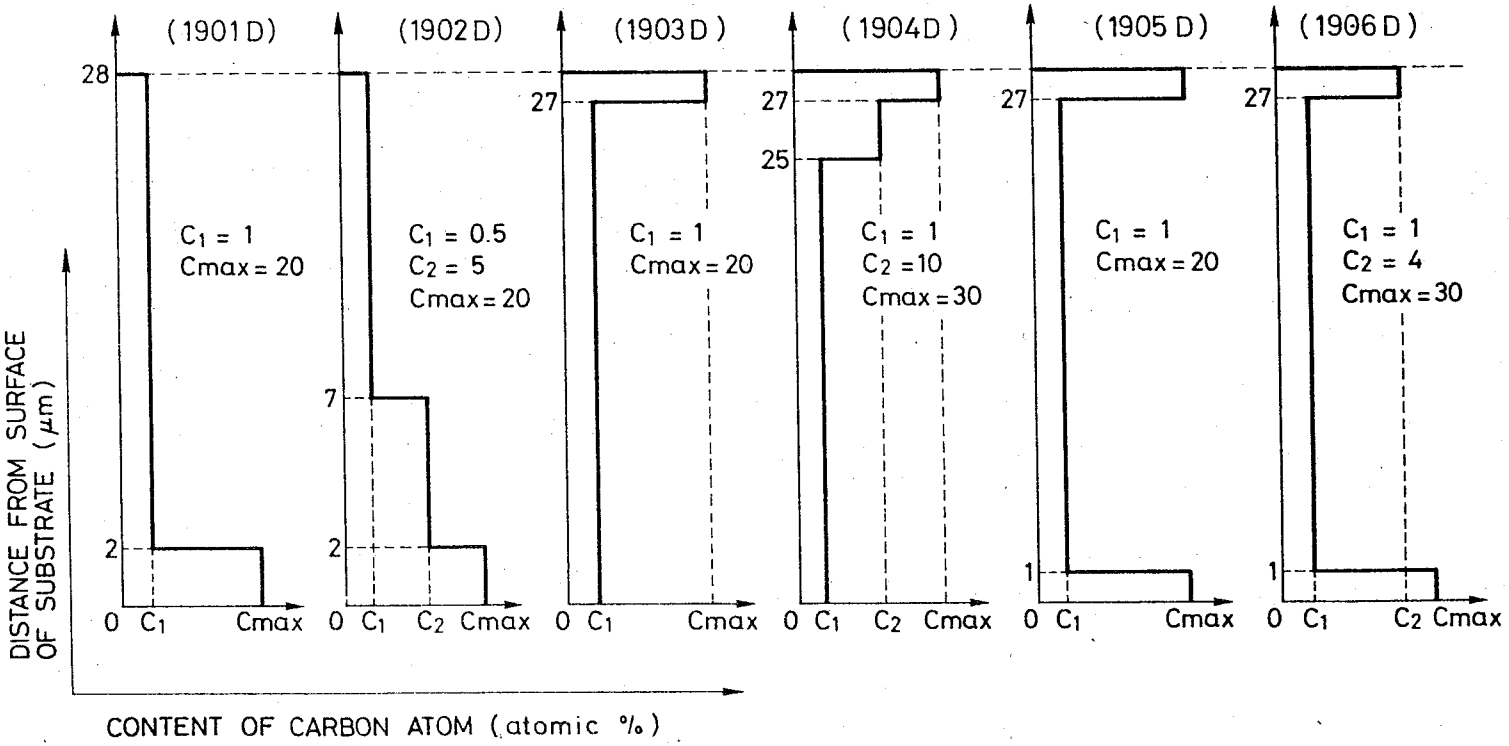

The depth profiles of germanium in respective samples are shown in FIG. 27, and those of carbon atoms in FIG. 28.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image on the surface of the image forming member. When the toner image was transferred onto a transfer paper by corona charging of ⊕5.0 KV, a clear image of high density with excellent resolution and good gradation reproducibility was obtained in every sample.

The same experiments were repeated under the same toner image forming conditions as described above, except for using GaAs type semiconductor laser (10 mW) of 810 nm in place of the tungsten lamp as the light source, and image quality evaluation was performed for each sample. As the result, an image of high quality, excellent in resolution and good in gradation reproducibility, could be obtained in every sample.

EXAMPLE 13

By means of the device shown in FIG. 19, respective samples of image forming members for electrophotography (see Samples No. 21-1D to 27-6D in Table 4D) were prepared, respectively, on cylindrical aluminum substrates under the conditions shown in Table 3D.

The depth profiles of the germanium atoms in respective samples are shown in FIG. 27, and those of carbon atoms in FIG. 28.

For each of these samples, the same image evaluation test was conducted as in Example 12 to give a toner transferred image of high quality in each sample. Also, for each sample, usage test repeated for 200,000 times was performed under the environment of 38° C. and 80% RH. As the result, no lowering in image quality was observed in each sample.

EXAMPLE 14

Following the same conditions and the procedure as in Samples Nos. 11-1D, 12-1D and 13-1D in Example 12, except for changing the conditions for preparation of the second layer (II) to the respective conditions as shown in Table 5D, image forming members for electrophotography were prepared, respectively (24 Samples of Sample No. 11-1-1D to 11-1-8D, 12-1-1D to 12-1-8D, 13-1-1D to 13-1-8D). The respective image forming members for electrophotography thus prepared were individually set on a copying device, and according to the conditions as described in respective Examples, overall image quality and durability in continuous use were evaluated for each of the image forming members for electrophotography corresponding to respective Examples.

The results of the overall image quality evaluation and evaluation of durability by repeated continuous use for respective samples are shown in Table 6D.

EXAMPLE 15

Various image forming members were prepared according to the same method as in Sample Nos. 11-1D in Example 12, respectively, except for varying the content ratio of silicon atoms to nitrogen atoms in the second layer (II) by varying the target area ratio of silicon wafer to silicon nitride during formation of the second layer (II). For each of the image forming members thus obtained, the steps of image formation, developing and cleaning as described in Example 12 were repeated for about 50,000 times, and thereafter image evaluations were conducted to obtain the results as shown in Table 7D.

EXAMPLE 16

Various image forming members were prepared according to the same method as in Sample No. 12-1D in Example 12, respectively, except for varying the content ratio of silicon atoms to nitrogen atoms in the second layer (II) by varying the flow rate ratio of $SiH_4$ gas to $NH_3$ gas during formation of the second layer (II). For each of the image forming members thus obtained, the steps up to transfer were repeated for about 50,000 times according to the methods as described in Example 12, and thereafter image evaluations were conducted to obtain the results as shown in Table 8D.

EXAMPLE 17

Various image forming members were prepared according to the same method as in Sample No. 13-1D in Example 12, respectively, except for varying the content ratio of silicon atoms to nitrogen atoms in the second layer (II) by varying the flow rate ratio of $SiH_4$ gas, $SiF_4$ gas and $NH_3$ gas during formation of the second layer (11). For each of the image forming members thus obtained, the steps of image formation, developing and cleaning as described in Example 12 were repeated for about 50,000 times, and thereafter image evaluations were conducted to obtain the results as shown in Table 9D.

EXAMPLE 18

Respective image forming members were prepared in the same manner as in Sample No. 11-1D in Example 12, except for changing the layer thickness of the second layer (II), and the steps of image formation, developing and cleaning as described in Example 12 were repeated to obtain the results as shown in Table 10D.

The common layer forming conditions in the respective Examples of the present invention are shown below:

Substrate temperature: Germanium atom (Ge) containing layer . . . about 200° C. No germanium atom (Ge) containing layer . . . about 250° C.

Discharging frequency: 13.56 MHz

Inner pressure in reaction chamber during the reaction: 0.3 Torr.

EXAMPLE 19

By means of the device shown in FIG. 19, respective samples of image forming members for electrophotography (see Samples No. 11-1E to 13-6E in Table 2E) were prepared, respectively, on cylindrical aluminum substrates under the conditions shown in Table 1E.

Figure 29:
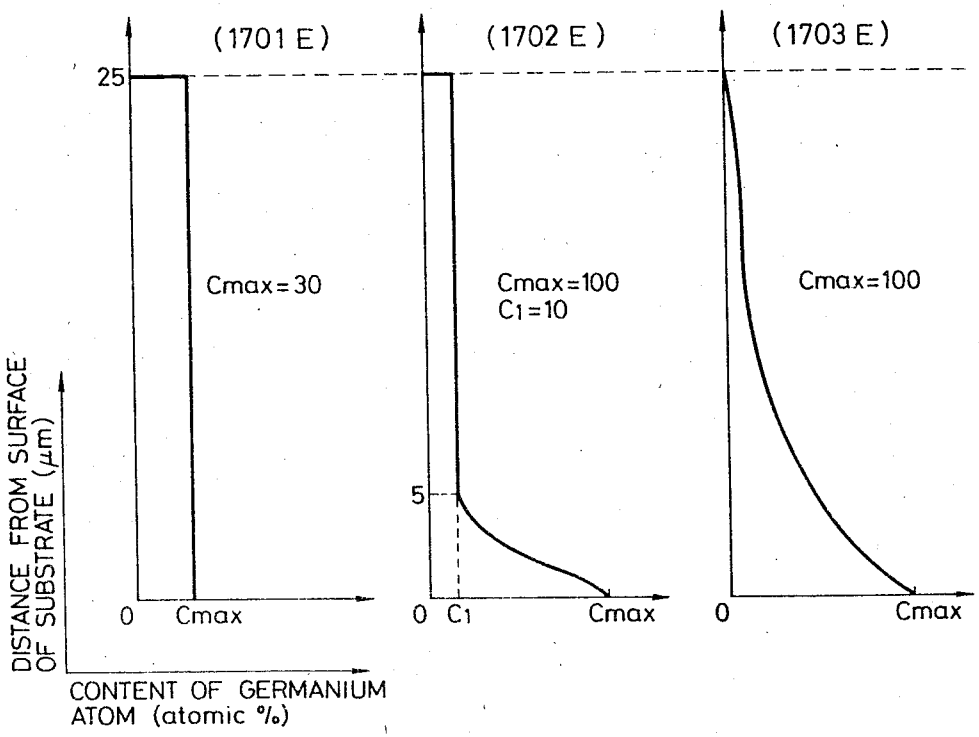
Figure 30:
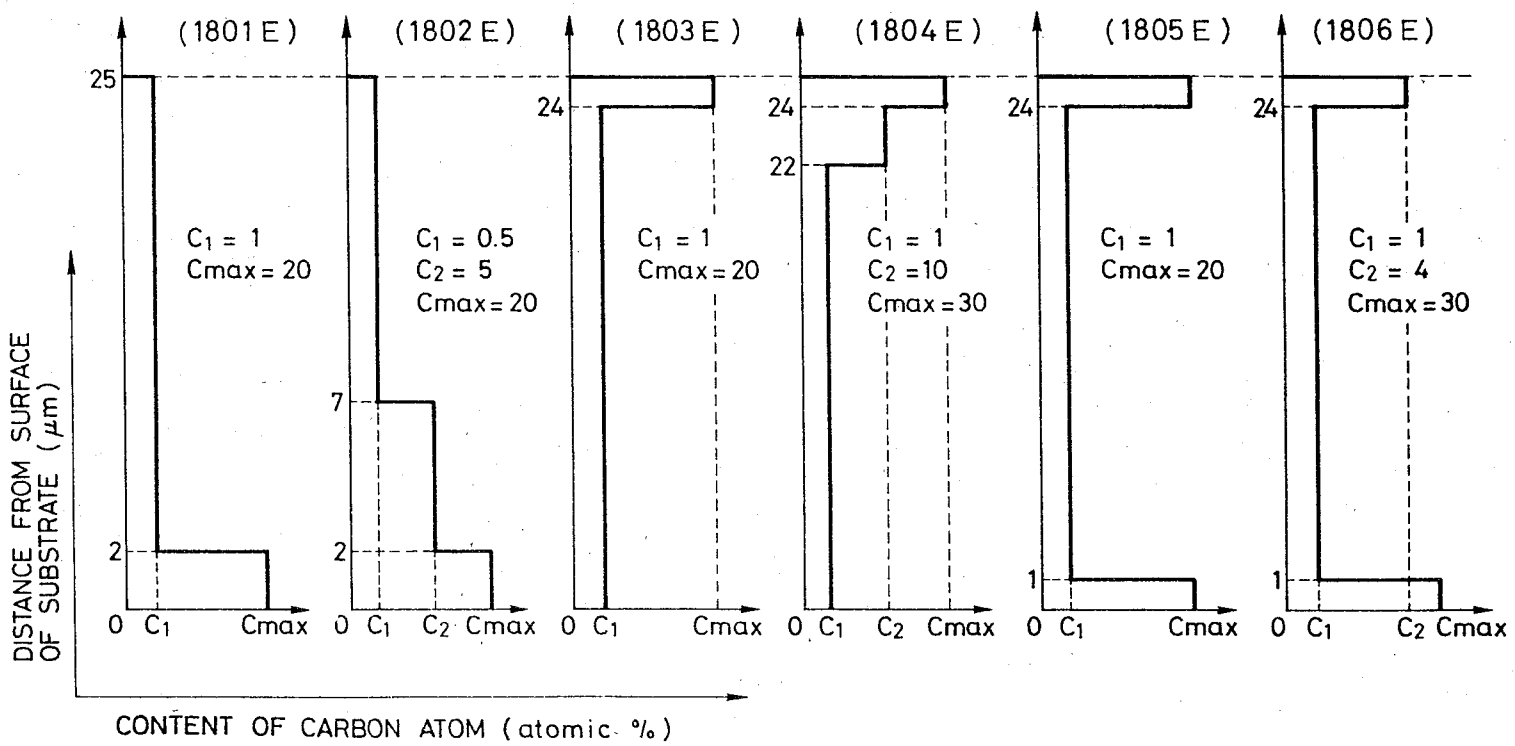

The depth profiles of germanium in respective samples are shown in FIG. 29, and those of carbon atoms in FIG. 30.

Each of the samples thus obtained was set in a charging-exposure testing device and subjected to corona charging at ⊕5.0 KV for 0.3 sec., followed immediately by irradiation of a light image. The light image was irradiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image on the surface of the image forming member. When the toner image was transferred onto a transfer paper by corona charging of ⊕5.0 KV, a clear image of high density with excellent resolution and good gradation reproducibility was obtained in every sample.

The same experiments were repeated under the same toner image forming conditions as described above, except for using GaAs type semiconductor laser (10 mW) of 810 nm in place of the tungsten lamp at the light source, and image quality evaluation was performed for each sample. As the result, an image of high quality, excellent in resolution and good in gradation reproducibility, could be obtained in every sample.

EXAMPLE 20

By means of the device shown in FIG. 19, respective samples of image forming members for electrophotography (see Samples No. 21-1E to 23-6E) in Table 4E were prepared, respectively, on cylindrical aluminum substrates under the conditions shown in Table 3E. The Table 3E, the first layer region in the first layer (I) was formed on the aluminum substrate, and the second layer region was formed on the first layer region.

The depth profiles of the germanium atoms in respective samples are shown in FIG. 29, and those of carbon atoms in FIG. 30.

For each of these samples, the same image evaluation test was conducted as in Example 19 to give a toner transferred image of high quality in each sample. Also, for each sample, usage test repeated 200,000 times was performed under the environment of 38° C. and 80% RH. As the result, no lowering in image quality was observed in each sample.

EXAMPLE 21

Following the same conditions and the procedure as in Samples Nos. 11-1E, 12-1E and 13-1E in Example 19, except for changing the conditions for preparation of the second layer (II) to the respective conditions as shown in Table 5E, image forming members for electrophotography were prepared, respectively (24 Samples of Sample No. 11-1-1E to 11-1-8E, 12-1-1E to 12-1-8E, 13-1-1E to 13-1-8E). The respective image forming members for electrophotography thus prepared were individually set on a copying device, and according to the conditions as described in respective Examples, overall image quality and durability in continuous use were evaluated for each of the image forming members for electrophotography corresponding to respective Examples.

The results of the overall image quality evaluation and evaluation of durability by repeated continuous use for respective samples are shown in Table 6E.

EXAMPLE 22

Various image forming members were prepared according to the same method as in Sample No. 11-1E in Example 19, respectively, except for varying the content ratio of silicon atoms to oxygen atoms in the second layer (II) by varying the target area ratio of silicon wafer to $SiO_2$ wafer during formation of the second layer (II). For each of the image forming members thus obtained, the steps of image formation, developing and cleaning as described in Example 19 were repeated for about 50,000 times, and thereafter image evaluations were conducted to obtain the results as shown in Table 7E.

EXAMPLE 23

Various image forming members were prepared according to the same method as in Sample No. 12-1E in Example 19, respectively, except for varying the content ratio of silicon atoms to oxygen atoms in the second layer (II) by varying the flow rate ratio of $SiH_4$ gas to NO gas during formation of the second layer (II). For each of the image forming members thus obtained, the steps up to transfer were repeated for about 50,000 times according to the methods as described in Example 19, and thereafter image evaluations were conducted to obtain the results as shown in Table 8E.

EXAMPLE 24

Various image forming members were prepared according to the same method as in Sample No. 13-1E in Example 19, respectively, except for varying the content ratio of silicon atoms to oxygen atoms in the second layer (II) by varying the flow rate ratio of $SiH_4$ gas, $SiF_4$ gas and NO gas during formation of the second layer (II). For each of the image forming members thus obtained, the steps of image formation, developing and cleaning as described in Example 19 were repeated for about 50,000 times, and thereafter image evaluations were conducted to obtain the results as shown in Table 9E.

EXAMPLE 25

Respective image forming members were prepared in the same manner as in Sample No. 11-1E in Example 19 except for changing the layer thickness of the second layer (II), and the steps of image formation, developing and cleaning as described in Example 19 were repeated to obtain the results as shown in Table 10E.

The common layer forming conditions in the respective Examples of the present invention are shown below:

Substrate temperature: Germanium atom (Ge) containing layer . . . about 200° C.

Discharging frequency: 13.56 MHz

Inner pressure in reaction chamber during the reaction: 0.3 Torr.

EXAMPLE 26

By means of the device shown in FIG. 19, respective samples of image forming members for electrophotography (see Samples No. 11-1F to 17-6F in Table 2F) were prepared, respectively, on cylindrical aluminum substrates under the conditions shown in Table 1F.

Figure 31:
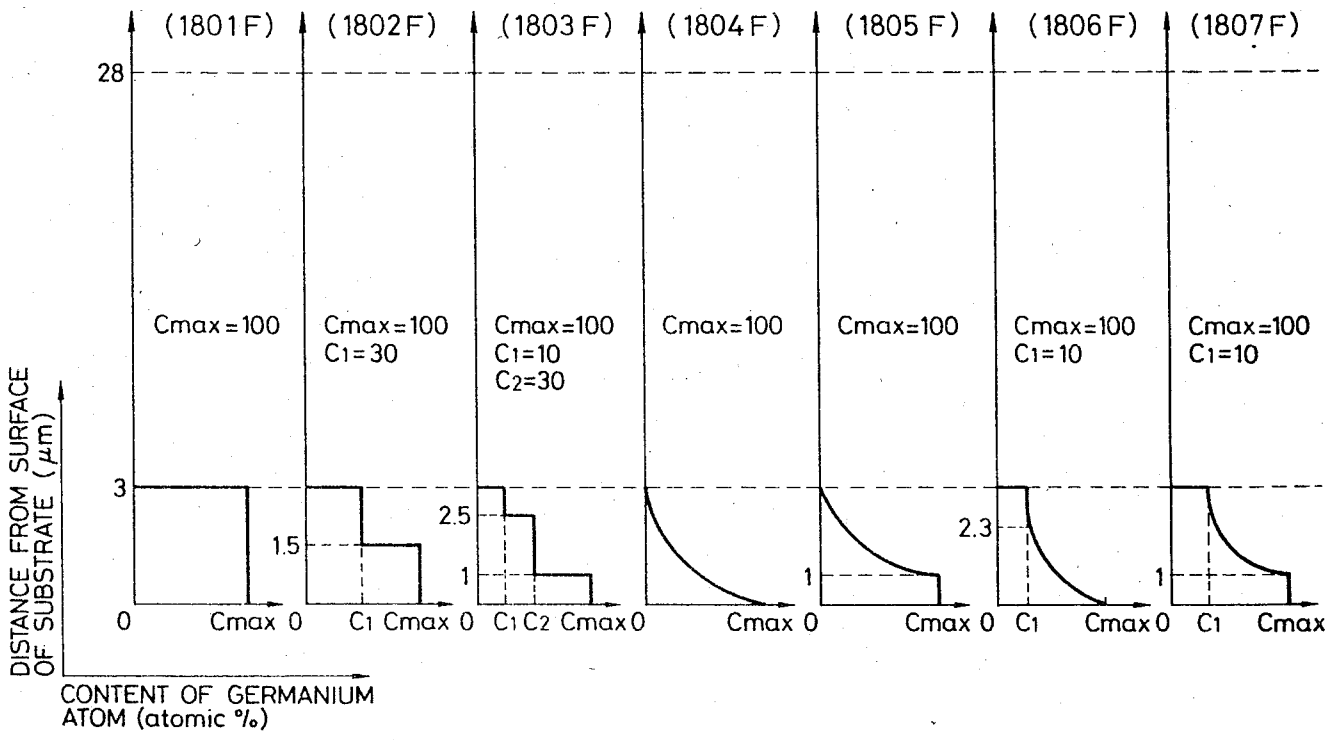
Figure 32:
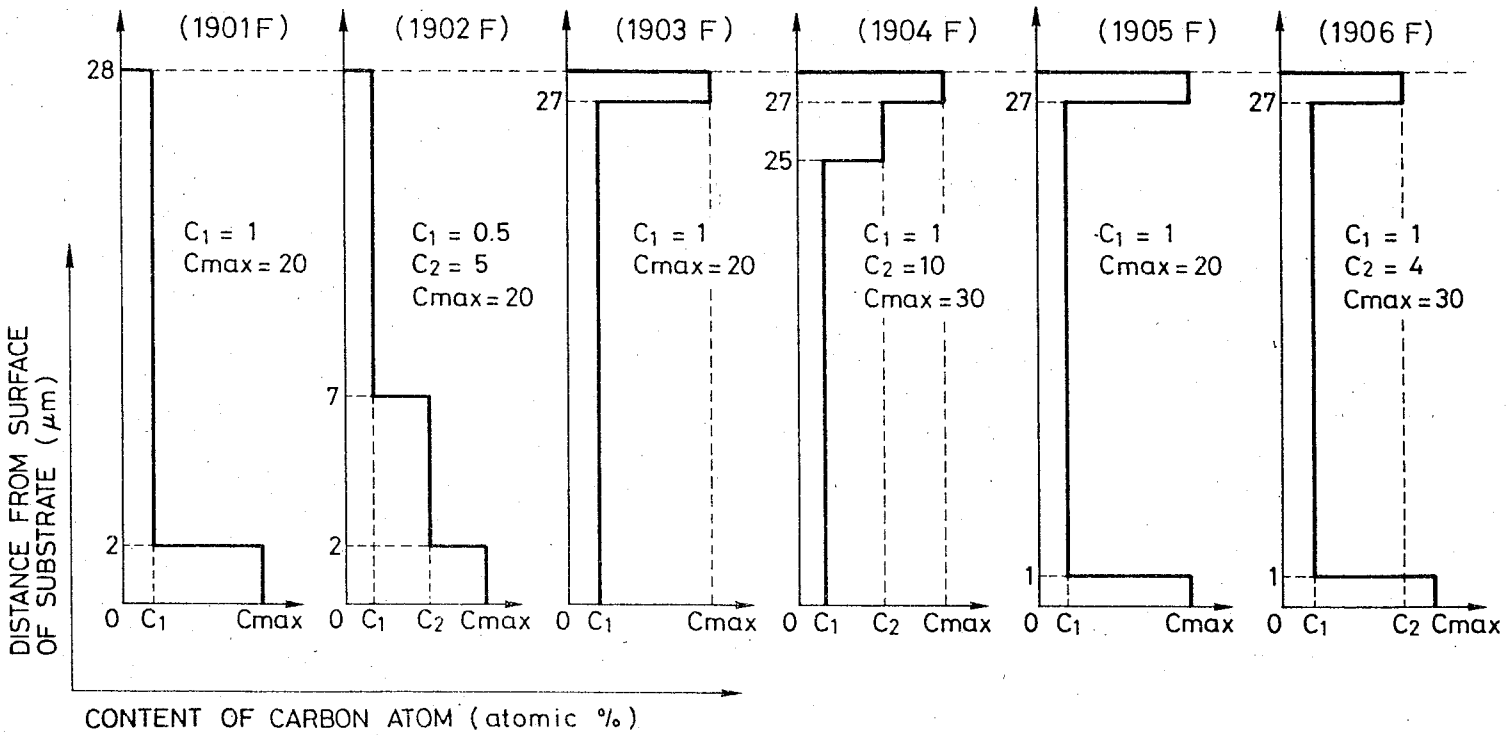

The depth profiles of germanium atoms in respective samples are shown in FIG. 31, and those of carbon atoms in FIG. 32.

Each of the samples thus obtained was set in a charging-exposure testing device and subjected to corona charging at ⊕5.0 KV for 0.3 sec., followed immediately by irradiation of a light image. The light image was irardiated by means of a tungsten lamp light source at a dose of 2 lux.sec through a transmission type test chart.

Immediately thereafter, ⊖ chargeable developer (containing toner and carrier) was cascaded on the surface of the image forming member to give a good toner image on the surface of the image forming member. When the toner image was transferred onto a transfer paper by corona charging of ⊕5.0 KV, a clear image of high density with excellent resolution and good gradation reproducibility was obtained in every sample.

The same experiments were repeated under the same toner image forming conditions as described above, except for using GaAs type semiconductor laser (10 mW) of 810 nm in place of the tungsten lamp as the light source, and image quality evaluation was performed for each sample. As the result, an image of high quality, excellent in resolution and good in gradation reproducibility, could be obtained in every sample.

EXAMPLE 27

By means of the device shown in FIG. 19, respective samples of image forming members for electrophotography (see Samples No. 21-1F to 27-6F in Table 4F) were prepared, respectively, on cylindrical aluminum substrates under the conditions shown in Table 3F. The Table 3F, the first layer region in the first layer (I) was formed on the aluminum substrate, and the second layer region was formed on the first layer region.

The depth profiles of the germanium atoms in respective samples are shown in FIG. 31, and those of carbon atoms in FIG. 32.

For each of these samples, the same image evaluation test was conducted as in Example 26 to give a toner transferred image of high quality in each sample. Also, for each sample, usage test repeated for 200,000 times was performed under the environment of 38° C. and 80% RH. As the result, no lowering in image quality was observed in each sample.

EXAMPLE 28

Following the same conditions and the procedure as in Samples Nos. 11-1E, 12-1E and 13-1E in Example 26, except for charging the conditions for preparation of the second layer (II) to the respective conditions as shown in Table 5F, image forming members for electrophotography were prepared, respectively (24 Samples of Sample No. 11-1-1F to 11-1-8F, 12-1-1F to 12-1-8F, 13-1-1F to 13-1-8F). The respective image forming members for electrophotography thus prepared were individually set on a copying device, and according to the conditions as described in respective Examples, overall image quality and durability in continuous use were evaluated for each of the image forming members for electrophotography corresponding to respective Examples.

The results of the overall image quality evaluation and evaluation of durability by repeated continuous use for respective samples are shown in Table 6F.

EXAMPLE 29

Various image forming members were prepared according to the same method as in Sample No. 11-1F in Example 26, respectively, except for varying the content ratio of silicon atoms to oxygen atoms in the second layer (II) by varying the target area ratio of silicon wafer to $SiO_2$ wafer during formation of the second layer (II). For each of the image forming members thus obtained, the steps of image formation, developing and cleaning as described in Example 26 were repeated for about 50,000 times, and thereafter image evaluations were conducted to obtain the results as shown in Table 7F.

EXAMPLE 30

Various image forming members were prepared according to the same method as in Sample No. 12-1F in Example 26, respectively, except for varying the content ratio of silicon atoms to oxygen atoms in the second layer (II) by varying the flow rate ratio of $SiH_4$ gas to NO gas during formation of the second layer (II). For each of the image forming members thus obtained, the steps up to transfer were repeated for about 50,000 times according to the methods as described in Example 26, and thereafter image evaluations were conducted to obtain the results as shown in Table 8F.

EXAMPLE 31

Various image forming members were prepared according to the same method as in Sample No. 13-1F in Example 26, respectively, except for varying the content ratio of silicon atoms to oxygen atoms in the second layer (II) by varying the flow rate ratio of $SiH_4$ gas, $SiF_4$ gas and NO gas during formation of the second layer (II). For each of the image forming members thus obtained, the steps of image formation, developing and cleaning as described in Example 26 were repeated for about 50,000 times, and thereafter image evaluations were conducted to obtain the results as shown in Table 9F.

EXAMPLE 32

Respective image forming members were prepared in the same manner as in Sample No. 11-1F in Example 26, except for changing the layer thickness of the second layer (II), and the steps of image formation, developing and cleaning as described in Example 26 were repeated to obtain the results as shown in Table 10F.

The common layer forming conditions in the respective Examples of the present invention are shown below:

Substrate temperature: Germanium atom (Ge) containing layer . . . about 200° C.; No germanium atom (Ge) containing layer . . . about 250° C.

Discharging frequency: 13.56 MHz

Inner pressure in reaction chamber during the reaction: 0.3 Torr.

TABLE 1A

| Layer constitution | Gases employed | Flow rate (SCCM) | Flow rate ratio | Discharging power ($W/cm^2$) | Layer formation rate (Å/sec) | Layer thickness (μm) |
|---|---|---|---|---|---|---|
| Light receiving layer | $SiF_4/He = 0.5$<br>$GeF_4/He = 0.5$<br>$C_2H_4$<br>$H_2$ | $SiF_4 + GeF_4 = 200$ | $\frac{(SiF_4 + GeF_4)}{(H_2 + SiF_4 + GeF_4)} = 7/10$ | 0.18 | 15 | 28 |

TABLE 2A

| Depth profile of C | Sample No. | Depth profile of Ge 1701A | 1702A | 1703A |
|---|---|---|---|---|
| 1801A | | 11-1A | 12-1A | 13-1A |
| 1802A | | 11-2A | 12-2A | 13-2A |
| 1803A | | 11-3A | 12-3A | 13-3A |
| 1804A | | 11-4A | 12-4A | 13-4A |
| 1805A | | 11-5A | 12-5A | 13-5A |
| 1806A | | 11-6A | 12-6A | 13-6A |

TABLE 3A

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiF_4/He = 0.5$<br>$GeF_4/He = 0.5$<br>$C_2H_4$<br>$H_2$<br>$B_2H_6/He = 1 \times 10^{-3}$ | $SiF_4 + GeF_4 = 200$ | $\frac{(SiF_4 + GeF_4)}{(H_2 + SiF_4 + GeF_4)} = 7/10$<br>$\frac{B_2H_6}{(SiF_4 + GeF_4)} = 2 \times 10^{-3}$ | 0.18 | 15 | 5 |
| Layer (II) | $SiF_4/He = 0.5$<br>$GeF_4/He = 0.5$<br>$C_2H_4$<br>$H_2$ | $SiF_4 + GeF_4 = 200$ | $\frac{(SiF_4 + GeF_4)}{(H_2 + SiF_4 + GeF_4)} = 7/10$ | 0.18 | 15 | 23 |

TABLE 4A

| Depth profile of C | Sample No. | Depth profile of Ge 1701A | 1702A | 1703A |
|---|---|---|---|---|
| 1801A | | 21-1A | 22-1A | 23-1A |
| 1802A | | 21-2A | 22-2A | 23-2A |
| 1803A | | 21-3A | 22-3A | 23-3A |
| 1804A | | 21-4A | 22-4A | 23-4A |
| 1805A | | 21-5A | 22-5A | 23-5A |
| 1806A | | 21-6A | 22-6A | 23-6A |

TABLE 1B

| Layer constitution | Gases employed | Flow rate (SCCM) | Flow rate ratio | Discharging power ($W/cm^2$) | Layer formation rate (Å/sec) | Layer thickness (μm) |
|---|---|---|---|---|---|---|
| Layer (I) | $SiH_4/He = 0.5$<br>$GeH_4/He = 0.5$<br>$C_2H_4$ | $SiH_4 + GeH_4 = 200$ | — | 0.18 | 15 | 5 |
| Layer (II) | $SiH_4/He = 0.5$<br>$C_2H_4$ | $SiH_4 = 200$ | — | 0.18 | 15 | 23 |

TABLE 2B

| Depth profile of C | Sample No. | Depth profile of Ge 1801B | 1802B | 1803B | 1804B | 1805B | 1806B | 1807B |
|---|---|---|---|---|---|---|---|---|
| | 1901B | 11-1B | 12-1B | 13-1B | 14-1B | 15-1B | 16-1B | 17-1B |
| | 1902B | 11-2B | 12-2B | 13-2B | 14-2B | 15-2B | 16-2B | 17-2B |
| | 1903B | 11-3B | 12-3B | 13-3B | 14-3B | 15-3B | 16-3B | 17-3B |
| | 1904B | 11-4B | 12-4B | 13-4B | 14-4B | 15-4B | 16-4B | 17-4B |
| | 1905B | 11-5B | 12-5B | 13-5B | 14-5B | 15-5B | 16-5B | 17-5B |
| | 1906B | 11-6B | 12-6B | 13-6B | 14-6B | 15-6B | 16-6B | 17-6B |

TABLE 3B

| Layer consititution | Gases employed | Flow rate (SCCM) | Flow rate ratio | Discharging power ($S/cm^2$) | Layer formation rate (Å/sec) | Layer thickness (μm) |
|---|---|---|---|---|---|---|
| Layer (I) | $SiH_4/He = 0.5$<br>$GeH_4/He = 0.5$<br>$C_2H_4$<br>$B_2H_6/He = 10^{-3}$ | $SiH_4 + GeH_4 = 200$ | — | 0.18 | 15 | 3 |
| Layer (II) | $SiH_4/He = 0.5$<br>$C_2H_4$ | $SiH_4 = 200$ | — | 0.18 | 15 | 25 |

TABLE 4B

| Depth profile of C | Sample No. | Depth profile of Ge 1801B | 1802B | 1803B | 1804B | 1805B | 1806B | 1807B |
|---|---|---|---|---|---|---|---|---|
| | 1901B | 21-1B | 22-1B | 23-1B | 24-1B | 25-1B | 26-1B | 27-1B |
| | 1902B | 21-2B | 22-2B | 23-2B | 24-2B | 25-2B | 26-2B | 27-2B |
| | 1903B | 21-3B | 22-3B | 23-3B | 24-3B | 25-3B | 26-3B | 27-3B |
| | 1904B | 21-4B | 22-4B | 23-4B | 24-4B | 25-4B | 26-4B | 27-4B |
| | 1905B | 21-5B | 22-5B | 23-5B | 24-5B | 25-5B | 26-5B | 27-5B |
| | 1906B | 21-6B | 22-6B | 23-6B | 24-6B | 25-6B | 26-6B | 27-6B |

TABLE 1C

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = (*)$<br>$\frac{C_2H_4}{SiF_4 + GeF_4} = (**)$ | 0.18 | 15 | 25 |
| Layer (II) | $SiH_4/He = 0.5$<br>$NH_3$ | $SiH_4 = 100$ | $SiH_4/NH_3 = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 2C

| Depth profile of C | Sample No. | Depth profile of Ge 1701C | 1702C | 1703C |
|---|---|---|---|---|
| | 1801C | 11-1C | 12-1C | 13-1C |
| | 1802C | 11-2C | 12-2C | 13-2C |
| | 1803C | 11-3C | 12-3C | 13-3C |

TABLE 2C-continued

| Depth profile of C | Sample No. | Depth profile of Ge 1701C | 1702C | 1703C |
|---|---|---|---|---|
| | 1804C | 11-4C | 12-4C | 13-4C |
| | 1805C | 11-5C | 12-5C | 13-5C |
| | 1806C | 11-6C | 12-6C | 13-6C |

TABLE 3C

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | | | | | | |
| First layer region | $SiF_4/He = 0.5$<br>$GeF_4/He = 0.5$<br>$C_2H_4$<br>$H_2$<br>$B_2H_6/He = 1 \times 10^{-3}$ | $SiF_4 + GeF_4 = 200$ | $\frac{GeF_4}{(H_2 + SiF_4 + GeF_4)} = (*)$<br>$\frac{B_2H_6}{(SiF_4 + GeF_4)} = 2 \times 10^{-3}$ | 0.18 | 15 | 5 |
| Second layer region | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = (*)$ | 0.18 | 15 | 20 |
| Layer (II) | $SiH_4/He = 0.5$<br>$NH_3$ | $SiH_4 = 100$ | $SiH_4/NH_3 = 3/7$ | 0.18 | 10 | 0.5 |

(*) Flow rate ratio was changed with regard to each sample according to the flow rate ratio change rate curve previously designed by controlling automatically the opening of the corresponding valve.

TABLE 4C

| Depth profile of C | Sample No. | Depth profile of Ge 1701C | 1702C | 1703C |
|---|---|---|---|---|
| | 1801C | 21-1C | 22-1C | 23-1C |
| | 1802C | 21-2C | 22-2C | 23-2C |
| | 1803C | 21-3C | 22-3C | 23-3C |
| | 1804C | 21-4C | 22-4C | 23-4C |
| | 1805C | 21-5C | 22-5C | 23-5C |
| | 1806C | 21-6C | 22-6C | 23-6C |

TABLE 5C

| Condition | Gases employed | Flow rate (SCCM) | Flow rate ratio or Area ratio | Discharging power ($W/cm^2$) | Layer thickness (μ) |
|---|---|---|---|---|---|
| 5-1C | Ar | 200 | Si wafer:Silicon nitride = 1:30 | 0.3 | 0.5 |
| 5-2C | Ar | 200 | Si wafer:Silicon nitride = 1:60 | 0.3 | 0.3 |
| 5-3C | Ar | 200 | Si wafer:Silicon nitride = 6:4 | 0.3 | 1.0 |
| 5-4C | $SiH_4/He = 1$<br>$NH_3$ | $SiH_4 = 15$ | $SiH_4:NH_3 = 1:100$ | 0.18 | 0.3 |
| 5-5C | $SiH_4/He = 0.5$<br>$NH_3$ | $SiH_4 = 100$ | $SiH_4:NH_3 = 1:30$ | 0.18 | 1.5 |
| 5-6C | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 5-7C | $SiH_4/He = 0.5$<br>$SiF_4/He = 0.5$<br>$NH_3$ | $SiH_4 + SiF_4 = 15$ | $SiH_4:SiF_4:NH_3 = 2:1:90$ | 0.18 | 0.3 |
| 5-8C | $SiH_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE 6C

| Layer (II) forming conditions | Sample No./Evaluation | | |
|---|---|---|---|
| 5-1C | 11-1-1C<br>○ ○ | 12-1-1C<br>○ ○ | 13-1-1C<br>○ ○ |
| 5-2C | 11-1-2C<br>○ ○ | 12-1-2C<br>○ ○ | 13-1-2C<br>○ ○ |

TABLE 6C-continued

| | Sample No. Overall image quality evaluation | Durability evaluation | |
|---|---|---|---|
| 5-3C | 11-1-3C<br>○ ○ | 12-1-3C<br>○ ○ | 13-1-3C<br>○ ○ |
| 5-4C | 11-1-4C<br>◎ ◎ | 12-1-4C<br>◎ ◎ | 13-1-4C<br>◎ ◎ |
| 5-5C | 11-1-5C<br>◎ ◎ | 12-1-5C<br>◎ ◎ | 13-1-5C<br>◎ ◎ |
| 5-6C | 11-1-6C<br>◎ ◎ | 12-1-3C<br>◎ ◎ | 13-1-6C<br>◎ ◎ |
| 5-7C | 11-1-7C<br>○ ○ | 12-1-7C<br>○ ○ | 13-1-7C<br>○ ○ |
| 5-8C | 11-1-8C<br>○ ○ | 12-1-8C<br>○ ○ | 13-1-8C<br>○ ○ |

Evaluation standards:
◎ Excellent
○ Good

TABLE 7C

| Sample No. | 1301C | 1302C | 1303C | 1304C | 1305C | 1306C | 1307C |
|---|---|---|---|---|---|---|---|
| $Si:Si_3N_4$ Target (Area ratio) ($NH_3/Ar$) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality | Δ | ◎ | ◎ | ○ | ○ | Δ | X |

TABLE 7C-continued

| Sample No. | 1301C | 1302C | 1303C | 1304C | 1305C | 1306C | 1307C |
|---|---|---|---|---|---|---|---|
| evaluation | | | | | | | |

◎: Very good
○: Good
Δ: Sufficiently practically usuable
X: Image defect formed

TABLE 8C

| Sample No. | 1401C | 1402C | 1403C | 1404C | 1405C | 1406C | 1407C | 1408C |
|---|---|---|---|---|---|---|---|---|
| $SiH_4$:$NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5;6.5 |
| Image quality evaluation | Δ | ◎ | ◎ | ◎ | ○ | Δ | Δ | X |

◎: Very good
○: Good
Δ: Sufficiently practically usuable
X: Image defect formed

TABLE 9C

| Sample No. | 1501C | 1502C | 1503C | 1504C | 1505C | 1506C | 1507C | 1508C |
|---|---|---|---|---|---|---|---|---|
| $SiH_4$:$SiF_4$:$NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○: Good
Δ: Sufficiently practically usable
X: Image defect formed

TABLE 10C

| Sample No. | Thickness of layer (II)(μ) | Results |
|---|---|---|
| 1601C | 0.001 | Image defect liable to be formed. |
| 1602C | 0.02 | No image defect formed up to successive copying for 20,000 times. |
| 1603C | 0.05 | Stable up to successive copying for 50,000 times. |
| 1604C | 1 | Stable up to successive copying for 200,000 times. |

TABLE 1D

| Layer constitution | Gases employed | Flow rate (SCCM) | Flow rate ratio | Discharging power (W/cm²) | Layer formation rate (Å/sec) | Layer thickness (μ) |
|---|---|---|---|---|---|---|
| Layer (I) | | | | | | |
| First layer region (G) | $SiH_4$/He = 0.5<br>$GeH_4$/He = 0.5<br>$C_2H_4$ | $SiH_4 + GeH_4 = 200$ | $\frac{GeH_4}{SiH_4 + GeH_4} = (*)$<br>$\frac{C_2H_4}{SiH_4 + C_2H_4} = (**)$ | 0.18 | 15 | 3 |
| Second layer region (S) | $SiH_4$/He = 0.5<br>$C_2H_4$ | $SiH_4 = 200$ | $\frac{C_2H_4}{SiH_4 + C_2H_4} = (**)$ | 0.18 | 15 | 25 |
| Layer (II) | $SiH_4$/He = 0.5<br>$NH_3$ | $SiH_4 = 100$ | $SiH_4/NH_3 = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 2D

| | | Depth profile of Ge | | | | | | |
|---|---|---|---|---|---|---|---|---|
| Depth profile of C | Sample No. | 1801D | 1802D | 1803D | 1804D | 1805D | 1806D | 1807D |
| 1901D | | 11-1D | 12-1D | 13-1D | 14-1D | 15-1D | 16-1D | 17-1D |
| 1902D | | 11-2D | 12-2D | 13-2D | 14-2D | 15-2D | 16-2D | 17-2D |
| 1903D | | 11-3D | 12-3D | 13-3D | 14-3D | 15-3D | 16-3D | 17-3D |

TABLE 2D-continued

| Depth profile of C | Sample No. | Depth profile of Ge 1801D | 1802D | 1803D | 1804D | 1805D | 1806D | 1807D |
|---|---|---|---|---|---|---|---|---|
| | 1904D | 11-4D | 12-4D | 13-4D | 14-4D | 15-4D | 16-4D | 17-4D |
| | 1905D | 11-5D | 12-5D | 13-5D | 14-5D | 15-5D | 16-5D | 17-5D |
| | 1906D | 11-6D | 12-6D | 13-6D | 14-6D | 15-6D | 16-6D | 17-6D |

TABLE 3D

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | | | | | | |
| First layer region (G) | $SiH_4/He = 0.5$<br>$GeH_4/He = 0.5$<br>$C_2H_4$<br>$B_2H_6/He = 10$ | $SiH_4 + GeH_4 = 200$ | $\frac{GeH_4}{SiH_4 + GeH_4} = (*)$<br>$\frac{C_2H_4}{SiH_4 + C_2H_4} = (**)$<br>$\frac{B_2H_6}{SiH_4 + GeH_4} = 3 \times 10^{-3}$ | 0.18 | 15 | 3 |
| Second layer region (S) | $SiH_4/He = 0.5$<br>$C_2H_4$ | $SiH_4 = 200$ | $\frac{C_2H_4}{SiH_4 + C_2H_4} = (**)$ | 0.18 | 15 | 25 |
| Layer (II) | $SiH_4/He = 0.5$<br>$NH_3$ | $SiH_4 = 100$ | $SiH_4/NH_3 = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 4D

| Depth profile of C | Sample No. | Depth profile of Ge 1801D | 1802D | 1803D | 1804D | 1805D | 1806D | 1807D |
|---|---|---|---|---|---|---|---|---|
| | 1901D | 21-1D | 22-1D | 23-1D | 24-1D | 25-1D | 26-1D | 27-1D |
| | 1902D | 21-2D | 22-2D | 23-2D | 24-2D | 25-2D | 26-2D | 27-2D |
| | 1903D | 21-3D | 22-3D | 23-3D | 24-3D | 25-3D | 26-3D | 27-3D |
| | 1904D | 21-4D | 22-4D | 23-4D | 24-4D | 25-4D | 26-4D | 27-4D |
| | 1905D | 21-5D | 22-5D | 23-5D | 24-5D | 25-5D | 26-5D | 27-5D |
| | 1906D | 21-6D | 22-6D | 23-6D | 24-6D | 25-6D | 26-6D | 27-6D |

TABLE 5D

| Condition | Gases employed | Flow rate (SCCM) | Flow rate ratio or Area ratio | Discharging power ($W/cm^2$) | Layer thickness (μ) |
|---|---|---|---|---|---|
| 5-1D | Ar | 200 | Si wafer:Silicon nitride = 1:30 | 0.3 | 0.5 |
| 5-2D | Ar | 200 | Si wafer:Silicon nitride = 1:60 | 0.3 | 0.3 |
| 5-3D | Ar | 200 | Si wafer:Silicon nitride = 6:4 | 0.3 | 1.0 |
| 5-4D | $SiH_4/He = 1$<br>$NH_3$ | $SiH_4 = 15$ | $SiH_4:NH_3 = 1:100$ | 0.18 | 0.3 |
| 5-5D | $SiH_4/He = 0.5$<br>$NH_3$ | $SiH_4 = 100$ | $SiH_4:NH_3 = 1:30$ | 0.18 | 1.5 |
| 5-6D | $SiH_4/He = 0.5$<br>$SiF_4/He = 0.5$<br>$NH_3$ | $SiH_4 + SiF_4 = 150$ | $SiH_4:SiF_4:NH_3 = 1:1:60$ | 0.18 | 0.5 |
| 5-7D | $SiH_4/He = 0.5$<br>$SiF_4/He = 0.5$<br>$NH_3$ | $SiH_4 + SiF_4 = 15$ | $SiH_4:SiF_4:NH_3 = 2:1:90$ | 0.18 | 0.3 |
| 5-8D | $SiF_4/He = 0.5$<br>$SiF_4/He = 0.5$<br>$NH_3$ | $SiH_4 + SiF_4 = 150$ | $SiH_4:SiF_4:NH_3 = 1:1:20$ | 0.18 | 1.5 |

TABLE 6D

| Layer (II) forming condition | Sample No./Evaluation | | |
|---|---|---|---|
| 5-1D | 11-1-1D<br>○ ○ | 12-1-1D<br>○ ○ | 13-1-1D<br>○ ○ |

TABLE 6D-continued

| | | | |
|---|---|---|---|
| 5-2D | 11-1-2D<br>○ ○ | 12-1-2D<br>○ ○ | 13-1-2D<br>○ ○ |
| 5-3D | 11-1-3D<br>○ ○ | 12-1-3D<br>○ ○ | 13-1-3D<br>○ ○ |
| 5-4D | 11-1-4D<br>◎ ◎ | 12-1-4D<br>◎ ◎ | 13-1-4D<br>◎ ◎ |

TABLE 6D-continued

| | | | |
|---|---|---|---|
| 5-5D | 11-1-5D ◎ ◎ | 12-1-5D ◎ ◎ | 13-1-5D ◎ ◎ |
| 5-6D | 11-1-6D ◎ ◎ | 12-1-6D ◎ ◎ | 13-1-6D ◎ ◎ |
| 5-7D | 11-1-7D ○ ○ | 12-1-7D ○ ○ | 13-1-7D ○ ○ |
| 5-8D | 11-1-8D ○ ○ | 12-1-8D ○ ○ | 13-1-8D ○ ○ |
| | Sample No. | | |
| | Overall image quality evaluation | Durability evaluation | |

Evaluation standards:
◎. . Excellent
○. . . Good

TABLE 10D

| Sample No. | Thickness of layer (II) (μ) | Results |
|---|---|---|
| 1601D | 0.001 | Image defect liable to be formed. |
| 1602D | 0.02 | No image defect formed up to successive copying for 20,000 times. |
| 1603D | 0.05 | Stable up to successive copying for 50,000 times. |
| 1604D | 1 | Stable up to successive copying for 200,000 times. |

TABLE 7D

| Sample No. | 1301D | 1302D | 1303D | 1304D | 1305D | 1306D | 1307D |
|---|---|---|---|---|---|---|---|
| $Si:Si_3N_4$ Target (Area ratio) ($NH_3$/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:N (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○: Good
Δ: Sufficiently practically usable
X: Imgage defect formed

TABLE 8D

| Sample No. | 1401D | 1402D | 1403D | 1404D | 1405D | 1406D | 1407D | 1408D |
|---|---|---|---|---|---|---|---|---|
| $SiH_4:NH_3$ (Flow rate ratio) | 9:1 | 1:3 | 1:10 | 1:30 | 1:100 | 1:1000 | 1:5000 | 1:10000 |
| Si:N (Content ratio) | 9.99:0.01 | 9.9:0.1 | 8.5:1.5 | 7.1:2.9 | 5:5 | 4.5:5.5 | 4:6 | 3.5:6.5 |
| Image quality evaluation | Δ | ◎ | ◎ | ◎ | ○ | Δ | Δ | X |

◎: Very good
○: Good
Δ: Sufficiently practically usable
X: Image defect formed

TABLE 9D

| Sample No. | 1501D | 1502D | 1503D | 1504D | 1505D | 1506D | 1507D | 1508D |
|---|---|---|---|---|---|---|---|---|
| $SiH_4:SiF_4:NH_3$ (Flow rate ratio) | 5:4:1 | 1:1:6 | 1:1:20 | 1:1:60 | 1:2:300 | 2:1:3000 | 1:1:10000 | 1:1:20000 |
| Si:N (Content ratio) | 9.89:0.11 | 9.8:0.2 | 8.4:1.6 | 7.0:3.0 | 5.1:4.9 | 4.6:5.4 | 4.1:5.9 | 3.6:6.4 |
| Image quality evaluation | Δ | ◎ | ◎ | ◎ | ○ | Δ | Δ | X |

◎: Very good
○: Good
Δ: Sufficiently practically usable
X: Image defect formed

TABLE 1E

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = (*)$<br>$\frac{NH_3}{SiF_4 + GeF_4} = (**)$ | 0.18 | 15 | 25 |
| Layer (II) | $SiH_4/He = 0.5$<br>NO | $SiH_4 = 100$ | $SiH_4/NO = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 2E

| Depth profile of C | Sample No. | Depth profile of Ge 1701E | 1702E | 1703E |
|---|---|---|---|---|
| 1801E | | 11-1E | 12-1E | 13-1E |
| 1802E | | 11-2E | 12-2E | 13-2E |
| 1803E | | 11-3E | 12-3E | 13-3E |
| 1804E | | 11-4E | 12-4E | 13-4E |
| 1805E | | 11-5E | 12-5E | 13-5E |
| 1806E | | 11-6E | 12-6E | 13-6E |

TABLE 6E

| Layer (II) forming conditions | Sample No./Evaluation | | |
|---|---|---|---|
| 5-1E | 11-1-E ○ ○ | 12-1-E ○ ○ | 13-1-1E ○ ○ |
| 5-2E | 11-1-2E ○ ○ | 12-1-2E ○ ○ | 13-1-2E ○ ○ |
| 5-3E | 11-1-3E ○ ○ | 12-1-3E ○ ○ | 13-1-3E ○ ○ |
| 5-4E | 11-1-4E ◎ ◎ | 12-1-4E ◎ ◎ | 13-1-4E ◎ ◎ |
| 5-5E | 11-1-5E ◎ ◎ | 12-1-5E ◎ ◎ | 13-1-5E ◎ ◎ |
| 5-6E | 11-1-6E ◎ ◎ | 12-1-6E ◎ ◎ | 13-1-6E ◎ ◎ |
| 5-7E | 11-1-7E ○ ○ | 12-1-7E ○ ○ | 13-1-7E ○ ○ |
| 5-8E | 11-1-8E ○ ○ | 12-1-8E ○ ○ | 13-1-8E ○ ○ |
| | Sample No. Overall image quality evaluation | Durability evaluation | |

Evaluation standards:
◎ . . . Excellent
○ . . . Good

TABLE 3E

| Layer constitution | Gases employed | Flow rate (SCCM) | Flow rate ratio | Discharging power (W/cm$^2$) | Layer formation rate (Å/sec) | Layer thickness (μ) |
|---|---|---|---|---|---|---|
| Layer (I) | | | | | | |
| First layer region | $SiF_4/He = 0.5$<br>$GeF_4/He = 0.5$<br>$C_2H_4$<br>$H_2$<br>$B_2H_6/He = 1 \times 10^{-3}$ | $SiF_4 + GeF_4 = 200$ | $\frac{GeF_4}{(H_2 + SiF_4 + GeF_4)} = (*)$<br>$\frac{B_2H_6}{(SiF_4 + GeF_4)} = 2 \times 10^{-3}$ | 0.18 | 15 | 5 |
| Second layer region | $SiF_4/He = 0.5$<br>$GeF_4/He = 0.5$<br>$C_2H_4$<br>$H_2$ | $SiF_4 + GeF_4 = 200$ | $\frac{GeF_4}{(H_2 + SiF_4 + GeF_4)} = (*)$ | 0.18 | 15 | 20 |
| Layer (II) | $SiH_4/He = 0.5$<br>NO | $SiH_4 = 100$ | $SiH_4/NO = 3/7$ | 0.18 | 10 | 0.5 |

(*) Flow rate ratio was changed with regard to each sample according to the flow rate ratio change rate curve previously designed by controlling automatically the opening of the corresponding valve.

TABLE 4E

| Depth profile of C | Sample No. | Depth profile of Ge 1701E | 1702E | 1703E |
|---|---|---|---|---|
| 1801E | | 21-1E | 22-1E | 23-1E |
| 1802E | | 21-2E | 22-2E | 23-2E |
| 1803E | | 21-3E | 22-3E | 23-3E |
| 1804E | | 21-4E | 22-4E | 23-4E |
| 1805E | | 21-5E | 22-5E | 23-5E |
| 1806E | | 21-6E | 22-6E | 23-6E |

TABLE 5E

| Condition | Gases employed | Flow rate (SCCM) | Flow rate ratio or Area ratio | Discharging power (W/cm$^2$) | Layer thickness (μ) |
|---|---|---|---|---|---|
| 5-1E | Ar | 200 | Si wafer:$SiO_2$ = 1:30 | 0.3 | 0.5 |
| 5-2E | Ar | 200 | Si wafer:$SiO_2$ = 1:60 | 0.3 | 0.3 |
| 5-3E | Ar | 200 | Si wafer:$SiO_2$ = 6:4 | 0.3 | 1.0 |
| 5-4E | $SiH_4/He = 1$<br>NO | $SiH_4 = 15$ | $SiH_4$:NO = 5:1 | 0.18 | 0.3 |
| 5-5E | $SiH_4/He = 0.5$<br>NO | $SiH_4 = 100$ | $SiH_4$:NO = 1:1 | 0.18 | 1.5 |
| 5-6E | $SiH_4/He = 0.5$<br>$SiF_4/He = 0.5$<br>NO | $SiH_4 + SiF_4 = 150$ | $SiH_4$:$SiF_4$:NO = 1:1:1 | 0.18 | 0.5 |
| 5-7E | $SiH_4/He = 0.5$<br>$SiF_4/He = 0.5$<br>NO | $SiH_4 + SiF_4 = 15$ | $SiH_4$:$SiF_4$:NO = 2:1:4 | 0.18 | 0.3 |
| 5-8E | $SiH_4/He = 0.5$<br>$SiF_4/He = 0.5$<br>NO | $SiH_4 + SiF_4 = 150$ | $SiH_4$:$SiF_4$:NO = 1:1:3 | 0.18 | 1.5 |

TABLE 7E

| Sample No. | 1301E | 1302E | 1303E | 1304E | 1305E | 1306E | 1307E |
|---|---|---|---|---|---|---|---|
| $Si:SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | ○ | ◎ | ◎ | ○ | Δ | X |

◎: Very good
○: Good
Δ: Sufficiently pratically usable
X: Image defect formed

TABLE 8E

| Sample No. | 1401E | 1402E | 1403 | 1404E | 1405E | 1406E | 1407E |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999:0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

◎: Very good
○: Good
Δ: Sufficiently practically usable
X: Image defect formed

TABLE 9E

| Sample No. | 1501E | 1502E | 1503E | 1504E | 1505E | 1506E | 1507E |
|---|---|---|---|---|---|---|---|
| $SiH_4:SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:00002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○: Good
Δ: Sufficiently practically usable
X: Image defect formed

TABLE 10E

| Sample No. | Thickness of layer (II) (μ) | Results |
|---|---|---|
| 1601E | 0.001 | Image defect liable to be formed. |
| 1602E | 0.02 | No image defect formed up to successive copying for 20,000 times. |
| 1603E | 0.05 | Stable up to successive copying for 50,000 times or more. |
| 1604E | 1 | Stable up to successive copying for 200,000 times or more. |

TABLE 1F

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | | | | | | |
| First layer region (G) | $SiH_4/He = 0.5$ $GeH_4/He = 0.5$ $C_2H_4$ | $SiH_4 + GeH_4 = 200$ | $\frac{GeH_4}{SiH_4 + GeH_4} = (*)$ $\frac{C_2H_4}{SiH_4 + C_2H_4} = (**)$ | 0.18 | 15 | 3 |
| Second layer region (S) | $SiH_4/He = 0.5$ $C_2H_4$ | $SiH_4 = 200$ | $\frac{C_2H_4}{SiH_4 + C_2H_4} = (**)$ | 0.18 | 15 | 25 |
| Layer (II) | $SiH_4/He = 0.5$ NO | $SiH_4 = 100$ | $SiH_4/NO = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 2F

| Depth profile of C | Sample No. | Depth profile of Ge 1801F | 1802F | 1803F | 1804F | 1805F | 1806F | 1807F |
|---|---|---|---|---|---|---|---|---|
| | 1901F | 11-1F | 12-1F | 13-1F | 14-1F | 15-1F | 16-1F | 17-1F |
| | 1902F | 11-2F | 12-2F | 13-2F | 14-2F | 15-2F | 16-2F | 17-2F |
| | 1903F | 11-3F | 12-3F | 13-3F | 14-3F | 15-3F | 16-3F | 17-3F |
| | 1904F | 11-4F | 12-4F | 13-4F | 14-4F | 15-4F | 16-4F | 17-4F |
| | 1905F | 11-5F | 12-5F | 13-5F | 14-5F | 15-5F | 16-5F | 17-5F |
| | 1906F | 11-6F | 12-6F | 13-6F | 14-6F | 15-6F | 16-6F | 17-3F |

TABLE 3F

| Layer constitution | Gases employed | Flow rate (SCCM) | Flow rate ratio | Discharging power ($W/cm^2$) | Layer formation rate (Å/sec) | Layer thickness (μ) |
|---|---|---|---|---|---|---|
| Layer (I) | | | | | | |
| First layer region (G) | $SiH_4/He = 0.5$<br>$GeH_4/He = 0.5$<br>$C_2H_4$<br>$B_2H_6/He = 10$ | $SiH_4 + GeH_4 = 200$ | $\frac{GeH_4}{SiH_4 + GeH_4} = (*)$<br>$\frac{C_2H_4}{SiH_4 + C_2H_4} = (**)$<br>$\frac{B_2H_6}{SiH_4 + GeH_4} = 3 \times 10^{-3}$ | 0.18 | 15 | 3 |
| Second layer region (S) | $SiH_4/He = 0.5$<br>$C_2H_4$ | $SiH_4 = 200$ | $\frac{C_2H_4}{SiH_4 + C_2H_4} = (**)$ | 0.18 | 15 | 25 |
| Layer (II) | $SiH_4/He = 0.5$<br>NO | $SiH_4 = 100$ | $SiH_4/NO = 3/7$ | 0.18 | 10 | 0.5 |

(*), (**) Flow rate ratio was changed with regard to each sample according to the flow rate ratio change rate curve previously designed by controlling automatically the opening of the corresponding valve.

TABLE 4F

| Depth profile of C | Sample No. | Depth profile of Ge 1801F | 1802F | 1803F | 1804F | 1805F | 1806F | 1807F |
|---|---|---|---|---|---|---|---|---|
| | 1901F | 21-1F | 22-1F | 23-1F | 24-1F | 25-1F | 26-1F | 27-1F |
| | 1902F | 21-2F | 22-2F | 23-2F | 24-2F | 25-2F | 26-2F | 27-2F |
| | 1903F | 21-3F | 22-3F | 23-3F | 24-3F | 25-3F | 26-3F | 27-3F |
| | 1904F | 21-4F | 22-4F | 23-4F | 24-4F | 25-4F | 26-4F | 27-4F |
| | 1905F | 21-5F | 22-5F | 23-5F | 24-5F | 25-5F | 26-5F | 27-5F |
| | 1906F | 21-6F | 22-6F | 23-6F | 24-6F | 25-6F | 26-6F | 27-6F |

TABLE 5F

| Conditions | Gases employed | Flow rate (SCCM) | Flow rate ratio or Area ratio | Discharging power ($W/cm^2$) | Layer thickness (μ) |
|---|---|---|---|---|---|
| 5-1F | Ar | 200 | Si wafer:$SiO_2$ = 1:30 | 0.3 | 0.5 |
| 5-2F | Ar | 200 | Si wafer:$SiO_2$ = 1:60 | 0.3 | 0.3 |
| 5-3F | Ar | 200 | Si wafer:$SiO_2$ = 6:4 | 0.3 | 1.0 |
| 5-4F | $SiH_4/He = 1$<br>NO | $SiH_4 = 15$ | $SiH_4$:NO = 5:1 | 0.18 | 0.3 |
| 5-5F | $SiH_4/He = 0.5$<br>NO | $SiH_4 = 100$ | $SiH_4$:NO = 1:1 | 0.18 | 1.5 |
| 5-6F | $SiH_4/He = 0.5$<br>$SiF_4/He = 0.5$<br>NO | $SiH_4 + SiF_4 = 150$ | $SiH_4$:$SiF_4$:NO = 1:1:1 | 0.18 | 0.5 |
| 5-7F | $SiH_4/He = 0.5$<br>$SiF_4/He = 0.5$<br>NO | $SiH_4 + SiF_4 = 15$ | $SiH_4$:$SiF_4$:NO = 2:1:4 | 0.18 | 0.3 |
| 5-8F | $SiH_4/He = 0.5$<br>$SiF_4/He = 0.5$<br>NO | $SiH_4 + SiF_4 = 150$ | $SiH_4$:$SiF_4$:NO = 1:1:3 | 0.18 | 1.5 |

TABLE 6F

| Layer (II) forming |
|---|

TABLE 6F-continued

| conditions | Sample No./Evaluation | | |
|---|---|---|---|
| 5-1F | 11-1-F<br>○ ○ | 12-1-F<br>○ ○ | 13-1-F<br>○ ○ |

TABLE 6F-continued

| | | | |
|---|---|---|---|
| 5-2F | 11-1-2F<br>○ ○ | 12-1-2F<br>○ ○ | 13-1-2F<br>○ ○ |
| 5-3F | 11-1-3F<br>○ ○ | 12-1-3F<br>○ ○ | 13-1-3F<br>○ ○ |
| 5-4F | 11-1-4F<br>◎ ◎ | 12-1-4F<br>◎ ◎ | 13-1-4F<br>◎ ◎ |
| 5-5F | 11-1-5F<br>◎ ◎ | 12-1-5F<br>◎ ◎ | 13-1-5F<br>◎ ◎ |
| 5-6F | 11-1-6F<br>◎ ◎ | 12-1-6F<br>◎ ◎ | 13-1-6F<br>◎ ◎ |
| 5-7F | 11-1-7F<br>○ ○ | 12-1-7F<br>○ ○ | 13-1-7F<br>○ ○ |
| 5-8F | 11-1-8F<br>○ ○ | 12-1-8F<br>○ ○ | 13-1-8F<br>○ ○ |

Sample No.

Overall image quality evaluation — Durability evaluation

Evaluation standards:
◎. . . Excellent
○. . . Good

TABLE 7F

| Sample No. | 1301F | 1302F | 1303F | 1304F | 1305F | 1306F | 1307F |
|---|---|---|---|---|---|---|---|
| $Si:SiO_2$ Target (Area ratio) (NO/Ar) | 9:1 (0/1) | 6.5:3.5 (1/1) | 4:10 (1/1) | 2:60 (1/1) | 1:100 (2/1) | 1:100 (3/1) | 1:100 (4/1) |
| Si:O (Content ratio) | 9.7:0.3 | 8.8:1.2 | 7.3:2.7 | 5.0:5.0 | 4.5:5.5 | 4:6 | 3:7 |
| Image quality evaluation | Δ | ◎ | ◎ | ○ | ○ | Δ | X |

◎: Very good
○: Good
Δ: Sufficiently practically usable
X: Image defect formed

TABLE 8F

| Sample No. | 1401F | 1402F | 1403F | 1404F | 1405F | 1406F | 1407F |
|---|---|---|---|---|---|---|---|
| $SiH_4$:NO (Flow rate ratio) | 1000:1 | 99:1 | 5:1 | 1:1 | 1:2 | 3:10 | 1:1000 |
| Si:O (Content ratio) | 9.9999:0.0001 | 9.9:0.1 | 9:1 | 6:4 | 5:5 | 3.3:6.7 | 2:8 |
| Image quality evaluation | Δ | ○ | ◎ | ◎ | ○ | Δ | X |

◎: Very good
○: Good
Δ: Sufficiently practically usable
X: Image defect formed

TABLE 9F

| Sample No. | 1501F | 1502F | 1503F | 1504F | 1505F | 1506F | 1507F |
|---|---|---|---|---|---|---|---|
| $SiH_4$:$SiF_4$:NO (Flow rate ratio) | 500:400:1 | 50:50:1 | 5:5:2 | 5:5:10 | 1:1:4 | 3:3:20 | 1:1:2000 |
| Si:O (Content ratio) | 9.9998:0.0002 | 9.8:0.2 | 8.8:1.2 | 6.3:3.7 | 5.1:4.9 | 3.5:6.5 | 2.3:7.7 |
| Image quality evaluation | Δ | ○ | ◎ | ◎ | ○ | Δ | X |

◎: Very good
○: Good
Δ: Sufficiently practically usable
X: Image defect formed

TABLE 10F

| Sample No. | Thickness of layer (II) (μ) | Results |
|---|---|---|
| 1601F | 0.001 | Image defect liable to be formed. |
| 1602F | 0.02 | No image defect formed up to successive copying for 20,000 times. |
| 1603F | 0.05 | Stable up to successive copying for 50,000 times. |
| 1604F | 1 | Stable up to successive copying for 200,000 times. |

What we claim is:

1. A photoconductive member comprising a substrate for photoconductive member and a light receiving layer having photoconductivity comprising an amorphous material containing silicon atoms and germanium atoms, and at least one of hydrogen atoms and halogen atoms, and wherein the content of germanium atoms in the light receiving layer is 1 to $9.5\times10^5$ atomic percent based on the sum of germanium and silicon atoms, said light receiving layer containing carbon atoms and having a first layer region, a third layer region and a second layer region with the carbon atom content in the layer thickness direction of C(1), C(3) and C(2), respectively, in the order from the substance side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum.

2. A photoconductive member according to claim 1, wherein hydrogen atoms are contained in the light receiving layer.

3. A photoconductive member according to claim 1 wherein halogen atoms are contained in the light receiving layer.

4. A photoconductive member according to claim 2, wherein halogen atoms are contained in the light receiving layer.

5. A photoconductive member according to claim 1, wherein the germanium atoms are distributed in the light receiving layer ununiformly in the layer thickness direction.

6. A photoconductive member according to claim 1, wherein the germanium atoms are distributed in the light receiving layer uniformly in the layer thickness direction.

7. A photoconductive member according to claim 1, wherein a substance for controlling conductivity is contained in the light receiving layer.

8. A photoconductive member according to claim 7, wherein the substance for controlling conductivity is an atom belonging to the group III of the periodic table.

9. A photoconductive member according to claim 7, wherein the substance for controlling conductivity is an atom belonging to the group V of the periodic table.

10. A photoconductive member according to claim 2, wherein the content of hydrogen atoms is 0.01 to 40 atomic %.

11. A photoconductive member according to claim 3, wherein the content of halogen atoms is 0.01 to 40 atomic %.

12. A photoconductive member according to claim 7, wherein the content of the substance for controlling conductivity is 0.01 to $5\times10^4$ atomic ppm.

13. A photoconductive member according to claim 1, wherein the content of carbon atoms contained in the light receiving layer is 0.001 to 50 atomic %.

14. A photoconductive member according to claim 1, wherein the layer thickness of the light receiving layer is 1 to 100μ.

15. A photoconductive member according to claim 1, wherein the light receiving layer has a layer region (PN) containing a substance for controlling conductivity.

16. A photoconductive member accordiang to claim 4, wherein the content of halogen atoms is 0.01 to 40 atomic %.

17. A photoconductive member comprising a substrate for photoconductive member and a light receiving layer provided on said substrate having a layer constitution in which a first layer region (G) comprising an amorphous material containing germanium atoms and at least one of hydrogen and halogen atoms and a second layer (S) exhibiting photoconductivity comprising an amorphous material containing silicon atoms and at least one of hydrogen or halogen atoms are successively provided from the substrate side wherein the content of germanium atoms in the first layer region (G) is 1 to $10\times10^5$ atomic ppm, said light receiving layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum.

18. A photoconductive member according to claim 17, wherein hydrogen atoms are contained in at least one of the first layer region (G) and the second layer region (S).

19. A photoconductive member according to claim 17, wherein halogen atoms are contained in at least one of the first layer region (G) and the second layer region (S).

20. A photoconductive member according to claim 18, wherein halogen atoms are contained in at least one of the first layer region (G) and the second layer region (S).

21. A photoconductive member according to claim 17, wherein the germanium atoms are distributed in the first layer region (G) ununiformly.

22. A photoconductive member according to claim 17, wherein the germanium atoms are distributed in the first layer region (G) uniformly.

23. A photoconductive member according to claim 17, wherein a substance for controlling conductivity is contained in the light receiving layer.

24. A photoconductive member according to claim 23, wherein the substance (C) for controlling conductivity is an atom belonging to the group III of the periodic table.

25. A photoconductive member according to claim 23, wherein the substance (C) for controlling conductivity is an atom belonging to the group V of the periodic table.

26. A photoconductive member according to claim 23, wherein the substance (C) for controlling conductivity is 0.01 to $5\times10^4$ atomic ppm.

27. A photoconductive member according to claim 18, wherein the content of hydrogen atoms contained in the first layer region (G) is 0.01 to 40 atomic %.

28. A photoconductive member according to claim 18, wherein the content of hydrogen atoms contained in the second layer region (S) is 1 to 40 atomic %.

29. A photoconductive member according to claim 19, wherein the content of halogen atoms contained in the first layer region (G) is 0.01 to 40 atomic %.

30. A photoconductive member according to claim 19, wherein the content of halogen atoms contained in the second layer region (S) is 0.01 to 40 atomic %.

31. A photoconductive member according to claim 17, wherein the content of carbon atoms contained in the light receiving layer is 0.001 to 50 atomic %.

32. A photoconductive member according to claim 17, wherein the layer thickness of the first layer region (G) is 30 Å to 50μ.

33. A photoconductive member according to claim 17, wherein the layer thickness of the second layer region (S) is 0.5 to 90μ.

34. A photoconductive member according to claim 17, wherein the layer thickness of the light receiving layer is 1 to 100μ.

35. A photoconductive member according to claim 17, wherein the light receiving layer has a layer region (PN) containing a substance for controlling conductivity.

36. A photoconductive member according to claim 20, wherein the content of halogen atoms contained in the first layer region (G) is 0.01 to 40 atomic %.

37. A photoconductive member according to claim 20, wherein the content of halogen atoms contained in the second layer region (S) is 0.01 to 40 atomic %.

38. A photoconductive member comprising a substrate for photoconductive member and a light receiving layer comprising a first layer provided on said substrate having photoconductivity comprising an amorphous material containing silicon atoms and germanium atoms wherein the content of germanium atoms in the first layer is 1 to $9.5\times10^5$ atomic ppm, based on the sum of germanium and silicon atoms and a second layer provided on said first layer comprising an amorphous material containing at least one of nitrogen atoms and oxygen atoms in a matrix of silicon atoms, wherein said first layer contains at least one of hydrogen and halogen atoms, said first layer containing carbon atoms and having a first layer region, a third layer region and a second layer region with the carbon atom content in the layer thickness direction of C(1), C(3) and C(2) respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum.

39. A photoconductive member according to claim 38, wherein hydrogen atoms are contained in the first layer.

40. A photoconductive member according to claim 38, wherein halogen atoms are contained in the first layer.

41. A photoconductive member according to claim 39, wherein halogen atoms are contained in the first layer.

42. A photoconductive member according to claim 38, wherein the germanium atoms are distributed in the first layer ununiformly in the layer thickness direction.

43. A photoconductive member according to claim 38, wherein the germanium atoms are distributed in the first layer uniformly in the layer thickness direction.

44. A photoconductive member according to claim 38, wherein a substance for controlling conductivity is contained in the first layer.

45. A photoconductive member according to claim 44, wherein the substance for controlling conductivity is an atom belonging to the group III of the periodic table.

46. A photoconductive member according to claim 44, wherein the substance for controlling conductivity is an atom belonging to the group V of the periodic table

47. A photoconductive member according to claim 39 wherein the content of hydrogen atoms is 0.01 to 40 atomic %.

48. A photoconductive member according to claim 40. wherein the content of halogen atoms is 0.01 to 40 atomic %.

49. A photoconductive member according to claim 44, wherein the content of the substance for controlling conductivity is 0.01 to $5\times10^4$ atomic ppm.

50. A photoconductive member according to claim 38, wherein the content of carbon atoms contained in the first layer is 0.001 to 50 atomic %.

51. A photoconductive member according to claim 38, wherein the layer thickness of the first layer is 1 to 100$\mu$.

52. A photoconductive member according to claim 38, wherein hydrogen atoms are contained in the second layer.

53. A photoconductive member according to claim 38, wherein halogen atoms are contained in the second layer.

54. A photoconductive member according to claim 38, wherein the layer thickness of the second layer is 0.003 to 30$\mu$.

55. A photoconductive member according to claim 38, wherein the first layer has a layer region (PN) containing a substance for controlling conductivity.

56. A photoconductive member comprising a substrate for photoconductive member and a light receiving layer comprising a first layer having a first layer region (G) comprising an amorphous material containing germanium atoms in amounts from 1 to $10\times10^5$ atomic ppm provided on said substrate and a second layer region (S) exhibiting photoconductivity comprising an amorphous material containing silicon atoms provided on said first layer region (G) wherein each of said first layer region (G) and said second layer region (S) contains at least one of hydrogen and halogen atoms, and a second layer comprising an amorphous material containing at least one of nitrogen atoms and oxygen atoms in a matrix of silicon atoms provided on said first layer, said first layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum.

57. A photoconductive member according to claim 56, wherein hydrogen atoms are contained in at least one of the first layer region (G) and the second layer region (S).

58. A photoconductive member according to claim 56, wherein halogen atoms are contained in at least one of the first layer region (G) and the second layer region (S).

59. A photoconductive member according to claim 57, wherein halogen atoms are contained in at least one of the first layer region (G) and the second layer region (S).

60. A photoconductive member according to claim 56, wherein the germanium atoms are distributed in the first layer region (G) ununiformly.

61. A photoconductive member according to claim 56, wherein the germanium atoms are distributed in the first layer region (G) uniformly.

62. A photoconductive member according to claim 56, wherein a substance for controlling conductivity is contained in the first layer.

63. A photoconductive member according to claim 62, wherein the substance for controlling conductivity is an atom belonging to the group III of the periodic table.

64. A photoconductive member according to claim 62, wherein the substance for controlling conductivity is an atom belonging to the group V of the periodic table.

65. A photoconductive member according to claim 57, wherein the content of hydrogen atoms contained in the first layer region (G) is 0.01 to 40 atomic %.

66. A photoconductive member according to claim 57, wherein the content of hydrogen atoms contained in the second layer region (S) is 1 to 40 atomic %.

67. A photoconductive member according to claim 58, wherein the content of halogen atoms contained in the first layer region (G) is 0.01 to 40 atomic %.

68. A photoconductive member according to claim 58, wherein the content of halogen atoms contained in the second layer region (S) is 0.01 to 40 atomic %.

69. A photoconductive member according to claim 59, wherein the content of halogen atoms contained in the first layer region (G) is 0.01 to 40 atomic %.

70. A photoconductive member according to claim 59, wherein the content of halogen atoms contained in the second layer region (S) is 0.01 to 40 atomic %.

71. A photoconductive member according to claim 62, wherein the content of the substance for controlling conductivity is 0.01 to $5\times10^4$ atomic ppm.

72. A photoconductive member according to claim 56, wherein the content of carbon atoms contained in the first layer is 0.001 to 50 atomic %.

73. A photoconductive member according to claim 56, wherein the layer thickness of the first layer region (G) is 30 Å to 50μ.

74. A photoconductive member according to claim 56, wherein the layer thickness of the second layer region (S) is 0.5 to 90μ.

75. A photoconductive member according to claim 56. wherein the layer thickness of the first layer is 1 to 100μ.

76. A photoconductive member according to claim 56, wherein hydrogen atoms are contained in the second layer.

77. A photoconductive member according to claim 56, wherein halogen atoms are contained in the second layer.

78. A photoconductive member according to claim 56, wherein the layer thickness of the second layer is 0.003 to 30μ.

79. A photoconductive member according to claim 56, wherein the first layer has a layer region (PN) containing a substance for controlling conductivity.

80. A photoconductive member according to claim 15 or claim 35, wherein the layer region (Z) of the portion excluding the layer region (PN) contains a substance for controlling conductivity of the opposite polarity to that of the substance for controlling conductivity contained in said layer region (PN).

81. A photoconductive member according to claim 55 or claim 79, wherein the layer region (Z) of the portion excluding the layer region (PN) contains a substance for controlling conductivity of the opposite polarity to that of the substance for controlling conductivity contained in said layer region (PN).

82. A photoconductive member according to claim 80 or claim 81, wherein the content of the substance for controlling conductivity contained in the layer region (Z) is smaller than that of the substance for controlling conductivity contained in the layer region (PN).

83. A photoconductive member according to claim 80 or claim 81, wherein the content of the substance for controlling conductivity in the layer region (PN) is 0.01 to $5\times10^4$ atomic ppm.

84. A photoconductive member according to claim 80 or claim 81, wherein the content of the substance for controlling conductivity in the layer region (Z) is 0.001 to 1000 atomic ppm.

85. An electrophotographic process which comprises: (a) applying a charging treatment to a photoconductive member comprising a substrate for photoconductive member and a light receiving layer having photoconductivity comprising an amorphous material containing silicon atoms, germanium atoms, and at least one of hydrogen atoms and halogen atoms, and wherein the content of germanium atoms in the light receiving layer is 1 to $9.5\times10^5$ atomic percent based on the sum of germanium and silicon atoms, said light receiving layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum; and (b) irradiating said photoconductive member with an electromagnetic wave carrying information, thereby forming an electrostatic image.

86. An electrophotographic process which comprises: (a) applying a charging treatment to a photoconductive member comprising a substrate for photoconductive member and a light receiving layer comprising a first layer provided on said substrate having photoconductivity comprising an amorphous material containing silicon atoms, germanium atoms and at least one of hydrogen and halogen atoms and a second layer provided on the first layer comprising an amorphous material containing silicon atoms and at least one of nitrogen atoms and oxygen atoms, wherein the content of germanium atoms in the light receiving layer is 1 to $9.5\times10^5$ atomic ppm based on the sum of germanium and silicon atoms, said first layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum; and (b) irradiating the photoconductive member with an electromagnetic wave carrying information, thereby forming an electrostatic image.

87. An electrophotographic process which comprises: (a) applying a charging treatment to a photoconductive member comprising a substrate for photoconductive member and a light receiving layer provided on said substrate having a layer constitution in which a first layer region (G) comprising an amorphous material containing germanium atoms in amounts from 1 to $10\times10^5$ atomic ppm, and a second layer region (S) exhibiting photoconductivity comprising an amorphous material containing silicon atoms are successively provided from the substrate side, both layer regions (G) and (S) containing at least one of hydrogen and halogen atoms, said light receiving layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum; and (b) irradiating the photoconductive member with an electromagnetic wave carrying information, thereby forming an electrostatic image.

88. An electrophotographic process which comprises: (a) applying a charging treatment to a photoconductive member comprising a substrate for photoconductive member and a light receiving layer comprising a first layer having a first layer region (G) comprising an amorphous material containing germanium atoms in amounts from 1 to $10\times10^5$ atomic ppm provided on said substrate and a second layer region (S) exhibiting photoconductivity comprising an amorphous material containing silicon atoms provided on said first layer region (G), both said layer regions (S) and (G) containing at least one of hydrogen and halogen atoms, and a second layer comprising an amorphous material containing silicon atoms and at least one of nitrogen atoms and oxygen atoms provided on said first layer, said first layer containing carbon atoms and having a first layer region, a third layer region and a second layer region with the carbon atom content in the layer thickness direction of C(1), C(3) and C(2), respectively, in the order from the substrate side with the proviso that when C(3) cannot solely be the maximum and either one of C(1) and C(2) is zero, the other two are not zero and not equal to each other, or when C(3) is zero, the other two are not zero, or when none of C(1), C(2) and C(3) is zero, the three of C(1), C(2) and C(3) cannot be equal at the same time and C(3) cannot solely be the maximum; and (b) irradiating the photoconductive member with an electromagnetic wave carrying information, thereby forming an electrostatic image.

* * * * *

UNITED STATES PATENT AND TRADEMARK OFFICE

CERTIFICATE OF CORRECTION

PATENT NO. : 4,592,981

DATED : June 3, 1986

INVENTOR(S) : KEISHI SAITOH, ET AL.

It is certified that error appears in the above-identified patent and that said Letters Patent is hereby corrected as shown below:

COLUMN 57

Line 10, "8.8:1.2 7.3:2.7 5.0:5.0" should read --8.8:1.2 7.3:2.7 5.0:5.0--.

Line 32, "Si:O 9.9998:00002" should read --Si:O 9.9998:0.0002--.

COLUMN 60

Line 10, "15-6F 16-6F 17-3F" should read --15-6F 16-6F 17-6F--.

COLUMN 63

Line 43, "accordiang" should read --according--.

Signed and Sealed this

Seventeenth Day of March, 1987

*Attest:*

*Attesting Officer*

DONALD J. QUIGG

*Commissioner of Patents and Trademarks*